US007114666B2

(12) United States Patent
Luettgen et al.

(10) Patent No.: US 7,114,666 B2
(45) Date of Patent: Oct. 3, 2006

(54) DUAL MASSAGE SHOWER HEAD

(75) Inventors: Harold A. Luettgen, Windsor, CO (US); Gary D. Golichowski, Cheyenne, WY (US); Gary L. Sokol, Longmont, CO (US)

(73) Assignee: Water Pik, Inc., Fort Collins, CO (US)

( * ) Notice: Subject to any disclaimer, the term of this patent is extended or adjusted under 35 U.S.C. 154(b) by 0 days.

(21) Appl. No.: 10/732,385

(22) Filed: Dec. 9, 2003

(65) Prior Publication Data

US 2004/0195381 A1 Oct. 7, 2004

Related U.S. Application Data

(60) Provisional application No. 60/432,463, filed on Dec. 10, 2002.

(51) Int. Cl.
*B05B 1/34* (2006.01)
*B05B 3/04* (2006.01)
*B05B 3/02* (2006.01)

(52) U.S. Cl. ..... 239/463; 239/397; 239/390; 239/381; 239/383; 239/240; 239/223; 239/222.11; 239/436; 239/443; 239/444; 239/447; 137/883; 4/675

(58) Field of Classification Search ..... 239/463, 239/380, 381, 382, 383, 444, 446, 447, 443, 239/390, 240, 397; 4/615, 601, 675, 676, 4/677; 137/867, 883; 222/548
See application file for complete search history.

(56) References Cited

U.S. PATENT DOCUMENTS

| | | | |
|---|---|---|---|
| 203,094 | A | 4/1878 | Wakeman |
| 204,333 | A | 5/1878 | Josias |
| 309,349 | A | 12/1884 | Hart |
| 428,023 | A | 5/1890 | Schoff |
| 445,250 | A | 1/1891 | Lawless |
| 486,986 | A | 11/1892 | Schinke |
| 566,384 | A | 8/1896 | Engelhart |
| 566,410 | A | 8/1896 | Schinke |
| 570,405 | A | 10/1896 | Jerguson et al. |
| 694,888 | A | 3/1902 | Pfluger |
| 800,802 | A | 10/1905 | Franquist |

(Continued)

FOREIGN PATENT DOCUMENTS

| | | |
|---|---|---|
| CA | 659510 | 3/1963 |

(Continued)

OTHER PUBLICATIONS

Color Copy, Labeled 1A, Gemlo, available at least as early as Dec. 2, 1998.

(Continued)

*Primary Examiner*—Dinh Q. Nguyen
(74) *Attorney, Agent, or Firm*—Dorsey & Whitney LLP

(57) ABSTRACT

A shower head having dual turbines. The shower head includes a body having an inlet for connection to a water conduit, a first outlet nozzle formed on the body, a second outlet nozzle formed on the body, a first turbine operably connected to the first outlet nozzle, and a second turbine operably connected to the second outlet nozzle. The shower head may include a flow actuation system taking the form of an actuator ring, a valve connected to the actuator ring and forming a flow channel, a first actuation point defined on the actuator ring, a second actuation point defined on the actuator ring, and a plunger situated within the flow channel. The plunger extends radially outwardly from a center of the valve when aligned with one of the first and second actuation points.

30 Claims, 46 Drawing Sheets

U.S. PATENT DOCUMENTS

| | | | |
|---|---|---|---|
| 832,523 | A | 10/1906 | Andersson |
| 835,678 | A | 11/1906 | Hammond |
| 854,094 | A | 5/1907 | Klein |
| 926,929 | A | 7/1909 | Dusseau |
| 1,001,842 | A | 8/1911 | Greenfield |
| 1,003,037 | A | 9/1911 | Crowe |
| 1,018,143 | A | 2/1912 | Vissering |
| 1,046,573 | A | 12/1912 | Ellis |
| 1,203,466 | A | 10/1916 | Benson |
| 1,217,254 | A | 2/1917 | Winslow |
| 1,218,895 | A | 3/1917 | Porter |
| 1,255,577 | A | 2/1918 | Berry |
| 1,260,181 | A | 3/1918 | Garnero |
| 1,276,117 | A | 8/1918 | Riebe |
| 1,284,099 | A | 11/1918 | Harris |
| 1,327,428 | A | 1/1920 | Gregory |
| 1,451,800 | A | 4/1923 | Agner |
| 1,459,582 | A | 6/1923 | Dubee |
| 1,469,528 | A | 10/1923 | Owens |
| 1,500,921 | A | 7/1924 | Bramson et al. |
| 1,560,789 | A | 11/1925 | Johnson et al. |
| 1,597,477 | A | 8/1926 | Panhorst |
| 1,633,531 | A | 6/1927 | Keller |
| 1,692,394 | A | 11/1928 | Sundh |
| 1,695,263 | A | 12/1928 | Jacques |
| 1,724,147 | A | 8/1929 | Russell |
| 1,724,161 | A | 8/1929 | Wuesthoff |
| 1,736,160 | A | 11/1929 | Jonsson |
| 1,754,127 | A | 4/1930 | Srulowitz |
| 1,758,115 | A | 5/1930 | Kelly |
| 1,778,658 | A | 10/1930 | Baker |
| 1,821,274 | A | 9/1931 | Plummer |
| 1,890,156 | A | 12/1932 | Konig |
| 1,906,575 | A | 5/1933 | Goeriz |
| 2,011,446 | A | 8/1935 | Judell |
| 2,024,930 | A | 12/1935 | Judell |
| 2,044,445 | A | 6/1936 | Price et al. |
| 2,117,152 | A | 5/1938 | Crosti |
| 2,196,783 | A | 4/1940 | Shook |
| 2,197,667 | A | 4/1940 | Shook |
| 2,216,149 | A | 10/1940 | Weiss |
| D126,433 | S | 4/1941 | Enthof |
| 2,251,192 | A | 7/1941 | Krumsiek et al. |
| 2,268,263 | A | 12/1941 | Newell et al. |
| 2,342,757 | A | 2/1944 | Roser |
| 2,402,741 | A | 6/1946 | Draviner |
| D147,258 | S | 8/1947 | Becker |
| D152,584 | S | 2/1949 | Becker |
| 2,467,954 | A | 4/1949 | Becker |
| 2,546,348 | A | 3/1951 | Schuman |
| 2,567,642 | A | 9/1951 | Penshaw |
| 2,581,129 | A | 1/1952 | Muldoon |
| D166,073 | S | 3/1952 | Dunkelberger |
| 2,648,762 | A | 8/1953 | Dunkelberger |
| 2,664,271 | A | 12/1953 | Arutunoff |
| 2,671,693 | A | 3/1954 | Hyser et al. |
| 2,676,806 | A | 4/1954 | Bachman |
| 2,679,575 | A | 5/1954 | Haberstump |
| 2,680,358 | A | 6/1954 | Zublin |
| 2,726,120 | A | 12/1955 | Bletcher et al. |
| 2,759,765 | A | 8/1956 | Pawley |
| 2,776,168 | A | 1/1957 | Schweda |
| 2,873,999 | A | 2/1959 | Webb |
| 2,931,672 | A | 4/1960 | Merritt et al. |
| 2,935,265 | A | 5/1960 | Richter |
| 2,966,311 | A | 12/1960 | Davis |
| D190,295 | S | 5/1961 | Becker |
| 3,007,648 | A | 11/1961 | Fraser |
| D192,935 | S | 5/1962 | Becker |
| 3,032,357 | A | 5/1962 | Shames et al. |
| 3,034,809 | A | 5/1962 | Greenberg |
| 3,037,799 | A | 6/1962 | Mulac |
| 3,092,333 | A | 6/1963 | Gaiotto |
| 3,098,508 | A | 7/1963 | Gerdes |
| 3,103,723 | A | 9/1963 | Becker |
| 3,104,827 | A | 9/1963 | Aghnides |
| 3,111,277 | A | 11/1963 | Grimsley |
| 3,143,857 | A | 8/1964 | Eaton |
| 3,196,463 | A | 7/1965 | Farneth |
| 3,239,152 | A | 3/1966 | Bachli et al. |
| 3,266,059 | A | 8/1966 | Stelle |
| 3,306,634 | A | 2/1967 | Groves et al. |
| 3,329,967 | A | 7/1967 | Martinez et al. |
| 3,341,132 | A | 9/1967 | Parkison |
| 3,342,419 | A | 9/1967 | Weese |
| 3,344,994 | A | 10/1967 | Fife |
| 3,383,051 | A | 5/1968 | Fiorentino |
| 3,389,925 | A | 6/1968 | Gottschald |
| 3,393,311 | A | 7/1968 | Dahl |
| 3,393,312 | A | 7/1968 | Dahl |
| 3,404,410 | A | 10/1968 | Sumida |
| 3,492,029 | A | 1/1970 | French et al. |
| 3,516,611 | A | 6/1970 | Piggott |
| 3,546,961 | A | 12/1970 | Marton |
| 3,550,863 | A | 12/1970 | McDermott |
| 3,565,116 | A | 2/1971 | Gabin |
| 3,584,822 | A | 6/1971 | Oram |
| 3,596,835 | A | 8/1971 | Smith et al. |
| 3,612,577 | A | 10/1971 | Pope |
| 3,641,333 | A | 2/1972 | Gendron |
| 3,663,044 | A | 5/1972 | Contreras et al. |
| 3,669,470 | A | 6/1972 | Deurloo |
| 3,682,392 | A | 8/1972 | Kint |
| 3,685,745 | A | 8/1972 | Peschcke-koedt |
| D224,834 | S | 9/1972 | Laudell |
| 3,711,029 | A | 1/1973 | Bartlett |
| 3,722,798 | A | 3/1973 | Bletcher et al. |
| 3,722,799 | A | 3/1973 | Rauh |
| 3,731,084 | A | 5/1973 | Trevorrow |
| 3,754,779 | A | 8/1973 | Peress |
| 3,768,735 | A | 10/1973 | Ward |
| 3,786,995 | A | 1/1974 | Manoogian et al. |
| 3,801,019 | A | 4/1974 | Trenary et al. |
| 3,810,580 | A | 5/1974 | Rauh |
| 3,826,454 | A | 7/1974 | Zieger |
| 3,860,271 | A | 1/1975 | Rodgers |
| 3,861,719 | A | 1/1975 | Hand |
| 3,865,310 | A | 2/1975 | Elkins et al. |
| 3,869,151 | A | 3/1975 | Fletcher et al. |
| 3,896,845 | A | 7/1975 | Parker |
| 3,902,671 | A | 9/1975 | Symmons |
| 3,910,277 | A | 10/1975 | Zimmer |
| D237,708 | S | 11/1975 | Grohe |
| 3,929,164 | A | 12/1975 | Richter |
| 3,958,756 | A | 5/1976 | Trenary et al. |
| D240,322 | S | 6/1976 | Staub |
| 3,967,783 | A | 7/1976 | Halsted et al. |
| 3,979,096 | A | 9/1976 | Zieger |
| 3,998,390 | A | 12/1976 | Peterson et al. |
| 3,999,714 | A | 12/1976 | Lang |
| 4,005,880 | A | 2/1977 | Anderson et al. |
| 4,006,920 | A | 2/1977 | Sadler et al. |
| 4,023,782 | A | 5/1977 | Eifer |
| 4,045,054 | A | 8/1977 | Arnold |
| D245,858 | S | 9/1977 | Grube |
| D245,860 | S | 9/1977 | Grube |
| 4,068,801 | A | 1/1978 | Leutheuser |
| 4,081,135 | A | 3/1978 | Tomaro |
| 4,084,271 | A | 4/1978 | Ginsberg |
| 4,091,998 | A | 5/1978 | Peterson |
| D249,356 | S | 9/1978 | Nagy |
| 4,117,979 | A | 10/1978 | Lagarelli et al. |
| 4,133,486 | A | 1/1979 | Fanella |
| D251,045 | S | 2/1979 | Grube |

4,141,502 A 2/1979 Grohe
4,151,955 A 5/1979 Stouffer
4,151,957 A 5/1979 Gecewicz et al.
4,162,801 A 7/1979 Kresky et al.
4,165,837 A 8/1979 Rundzaitis
4,174,822 A 11/1979 Larsson
4,185,781 A 1/1980 O'Brien
4,190,207 A 2/1980 Fienhold et al.
4,191,332 A 3/1980 De Langis et al.
4,203,550 A 5/1980 On
4,209,132 A * 6/1980 Kwan ..... 239/381
D255,626 S 7/1980 Grube
4,219,160 A 8/1980 Allred, Jr.
4,221,338 A 9/1980 Shames et al.
4,243,253 A 1/1981 Rogers, Jr.
4,244,526 A 1/1981 Arth
D258,677 S 3/1981 Larsson
4,254,914 A 3/1981 Shames et al.
4,258,414 A 3/1981 Sokol
4,272,022 A 6/1981 Evans
4,274,400 A 6/1981 Baus
4,282,612 A 8/1981 King
D261,300 S 10/1981 Klose
D261,417 S 10/1981 Klose
4,303,201 A 12/1981 Elkins et al.
4,319,608 A 3/1982 Raikov et al.
4,330,089 A 5/1982 Finkbeiner
D266,212 S 9/1982 Haug et al.
4,350,298 A 9/1982 Tada
4,353,508 A 10/1982 Butterfield et al.
D267,582 S 1/1983 Mackay et al.
D268,442 S 3/1983 Darmon
D268,611 S 4/1983 Klose
4,383,554 A 5/1983 Merriman
4,396,797 A 8/1983 Sakuragi et al.
4,398,669 A 8/1983 Fienhold
4,425,965 A 1/1984 Bayh, III et al.
D274,457 S 6/1984 Haug
4,461,052 A 7/1984 Mostul
4,465,308 A 8/1984 Martini
4,467,964 A 8/1984 Kaeser
4,495,550 A 1/1985 Visciano
4,527,745 A 7/1985 Butterfield et al.
4,540,202 A 9/1985 Amphoux et al.
4,545,081 A 10/1985 Nestor et al.
4,553,775 A 11/1985 Halling
D281,820 S 12/1985 Oba et al.
4,561,593 A 12/1985 Cammack et al.
4,571,003 A 2/1986 Roling et al.
D283,645 S 4/1986 Tanaka
4,587,991 A 5/1986 Chorkey
4,588,130 A 5/1986 Trenary et al.
4,598,866 A 7/1986 Cammack et al.
4,614,303 A 9/1986 Moseley, Jr. et al.
4,618,100 A 10/1986 White et al.
4,629,124 A 12/1986 Gruber
4,629,125 A 12/1986 Liu
4,643,463 A 2/1987 Halling et al.
4,645,244 A 2/1987 Curtis
4,650,120 A 3/1987 Kress
4,650,470 A 3/1987 Epstein
4,652,025 A 3/1987 Conroy, Sr.
4,657,185 A 4/1987 Rundzaitis
4,669,666 A 6/1987 Finkbeiner
4,669,757 A 6/1987 Bartholomew
4,674,687 A 6/1987 Smith et al.
4,683,917 A 8/1987 Bartholomew
4,703,893 A 11/1987 Gruber
4,719,654 A 1/1988 Blessing
4,733,337 A 3/1988 Bieberstein
D295,437 S 4/1988 Fabian
4,739,801 A 4/1988 Kimura et al.
D296,582 S 7/1988 Haug et al.
4,754,928 A 7/1988 Rogers et al.
D297,160 S 8/1988 Robbins
4,778,104 A 10/1988 Fisher
4,787,591 A 11/1988 Villacorta
4,790,294 A 12/1988 Allred, III et al.
4,801,091 A 1/1989 Sandvik
4,809,369 A 3/1989 Bowden
4,839,599 A 6/1989 Fischer
4,842,059 A 6/1989 Tomek
D302,325 S 7/1989 Charet et al.
4,850,616 A 7/1989 Pava
4,856,822 A 8/1989 Parker
4,865,362 A 9/1989 Holden
4,871,196 A 10/1989 Kingsford
D306,351 S 2/1990 Charet et al.
4,901,927 A 2/1990 Valdivia
4,903,178 A 2/1990 Englot et al.
4,903,897 A 2/1990 Hayes
4,903,922 A 2/1990 Harris, III
4,907,137 A 3/1990 Schladitz et al.
4,914,759 A 4/1990 Goff
4,946,202 A 8/1990 Perricone
4,951,329 A 8/1990 Shaw
4,953,585 A 9/1990 Rollini et al.
4,964,573 A 10/1990 Lipski
4,972,048 A 11/1990 Martin
D313,267 S 12/1990 Lenci et al.
D314,246 S 1/1991 Bache
D315,191 S 3/1991 Mikol
D317,348 S 6/1991 Geneve et al.
5,022,103 A 6/1991 Faist
5,032,015 A 7/1991 Christianson
5,033,528 A 7/1991 Volcani
5,033,897 A 7/1991 Chen
D320,064 S 9/1991 Presman
5,046,764 A 9/1991 Kimura et al.
D321,062 S 10/1991 Bonbright
D322,119 S 12/1991 Haug et al.
D322,681 S 12/1991 Yuen
5,070,552 A 12/1991 Gentry et al.
D323,545 S 1/1992 Ward
5,082,019 A 1/1992 Tetrault
5,086,878 A 2/1992 Swift
5,090,624 A 2/1992 Rogers
5,100,055 A 3/1992 Rokitenetz et al.
D325,769 S 4/1992 Haug et al.
D325,770 S 4/1992 Haug et al.
5,103,384 A 4/1992 Drohan
D326,311 S 5/1992 Lenci et al.
D327,729 S 7/1992 Rogers
5,134,251 A 7/1992 Martin
D328,944 S 8/1992 Robbins
5,141,016 A 8/1992 Nowicki
D329,504 S 9/1992 Yuen
5,143,300 A 9/1992 Cutler
5,145,114 A 9/1992 Monch
D330,068 S 10/1992 Haug et al.
D330,408 S 10/1992 Thacker
D330,409 S 10/1992 Raffo
5,153,976 A 10/1992 Benchaar et al.
5,154,355 A 10/1992 Gonzalez
5,154,483 A 10/1992 Zeller
5,163,752 A 11/1992 Copeland et al.
5,172,860 A 12/1992 Yuch
5,172,862 A 12/1992 Heimann et al.
5,172,866 A 12/1992 Ward
D332,303 S 1/1993 Klose
D332,994 S 2/1993 Huen
D333,339 S 2/1993 Klose
5,197,767 A 3/1993 Kimura et al.
D334,794 S 4/1993 Klose
D335,171 S 4/1993 Lenci et al.
5,201,468 A 4/1993 Freier et al.

5,213,267 A 5/1993 Heimann et al.
5,220,697 A 6/1993 Birchfield
D337,839 S 7/1993 Zeller
5,228,625 A 7/1993 Grassberger
D338,542 S 8/1993 Yuen
5,232,162 A 8/1993 Chih
D339,492 S 9/1993 Klose
D339,627 S 9/1993 Klose
D339,848 S 9/1993 Gottwald
5,246,169 A 9/1993 Heimann et al.
D340,376 S 10/1993 Klose
5,254,809 A 10/1993 Martin
D341,007 S 11/1993 Haug et al.
D341,191 S 11/1993 Klose
D341,220 S 11/1993 Eagan
5,263,646 A 11/1993 McCauley
5,265,833 A 11/1993 Heimann et al.
5,268,826 A 12/1993 Greene
5,276,596 A 1/1994 Krenzel
5,277,391 A 1/1994 Haug et al.
5,286,071 A 2/1994 Storage
5,288,110 A 2/1994 Allread
5,294,054 A 3/1994 Benedict et al.
5,297,735 A 3/1994 Heimann et al.
D345,811 S 4/1994 Van Deursen et al.
D346,426 S 4/1994 Warshawsky
D346,428 S 4/1994 Warshawsky
D346,430 S 4/1994 Warshawsky
D347,262 S 5/1994 Black et al.
D347,265 S 5/1994 Gottwald
5,316,216 A 5/1994 Cammack et al.
D348,720 S 7/1994 Haug et al.
D349,947 S 8/1994 Hing-Wah
5,333,787 A 8/1994 Smith et al.
5,340,064 A 8/1994 Heimann et al.
5,340,165 A 8/1994 Sheppard
D350,808 S 9/1994 Warshawsky
5,344,080 A 9/1994 Matsui
5,349,987 A 9/1994 Shieh
5,356,077 A 10/1994 Shames
D352,347 S 11/1994 Dannenberg
D352,766 S 11/1994 Hill et al.
5,368,235 A 11/1994 Drozdoff et al.
5,369,556 A 11/1994 Zeller
5,370,427 A 12/1994 Hoelle et al.
5,385,500 A 1/1995 Schmidt
D355,242 S 2/1995 Warshawsky
D355,703 S 2/1995 Duell
D356,626 S 3/1995 Wang
5,397,064 A 3/1995 Heitzman
5,398,872 A 3/1995 Joubran
5,398,977 A 3/1995 Berger et al.
5,402,812 A 4/1995 Moineau et al.
5,405,089 A 4/1995 Heimann et al.
5,423,348 A 6/1995 Jezek et al.
5,433,384 A 7/1995 Chan et al.
D361,399 S 8/1995 Carbone et al.
D361,623 S 8/1995 Huen
5,449,206 A 9/1995 Lockwood
D363,360 S 10/1995 Santarsiero
5,454,809 A 10/1995 Janssen
5,468,057 A 11/1995 Megerle et al.
D364,935 S 12/1995 deBlois
D365,625 S 12/1995 Bova
D365,646 S 12/1995 deBlois
5,476,225 A 12/1995 Chan
D366,309 S 1/1996 Huang
D366,707 S 1/1996 Kaiser
D366,708 S 1/1996 Santarsiero
D366,709 S 1/1996 Szmanski
D366,710 S 1/1996 Szymanski
5,481,765 A 1/1996 Wang
D366,948 S 2/1996 Carbone
D367,315 S 2/1996 Andrus
D367,333 S 2/1996 Swyst
D367,696 S 3/1996 Andrus
D367,934 S 3/1996 Carbone
D368,146 S 3/1996 Carbone
D368,317 S 3/1996 Swyst
5,499,767 A 3/1996 Morand
D368,539 S 4/1996 Carbone et al.
D368,540 S 4/1996 Santarsiero
D368,541 S 4/1996 Kaiser et al.
D368,542 S 4/1996 deBlois et al.
D369,204 S 4/1996 Andrus
D369,205 S 4/1996 Andrus
5,507,436 A 4/1996 Ruttenberg
D369,873 S 5/1996 deBlois et al.
D369,874 S 5/1996 Santarsiero
D369,875 S 5/1996 Carbone
D370,052 S 5/1996 Chan et al.
D370,250 S 5/1996 Fawcett et al.
D370,277 S 5/1996 Kaiser
D370,278 S 5/1996 Nolan
D370,279 S 5/1996 deBlois
D370,280 S 5/1996 Kaiser
D370,281 S 5/1996 Johnstone et al.
5,517,392 A 5/1996 Rousso et al.
5,521,803 A 5/1996 Eckert et al.
D370,542 S 6/1996 Santarsiero
D370,735 S 6/1996 deBlois
D370,987 S 6/1996 Santarsiero
D370,988 S 6/1996 Santarsiero
D371,448 S 7/1996 Santarsiero
D371,618 S 7/1996 Nolan
D371,619 S 7/1996 Szymanski
D371,856 S 7/1996 Carbone
D372,318 S 7/1996 Szymanski
D372,319 S 7/1996 Carbone
5,531,625 A 7/1996 Zhong
D372,548 S 8/1996 Carbone
D372,998 S 8/1996 Carbone
D373,210 S 8/1996 Santarsiero
D373,434 S 9/1996 Nolan
D373,435 S 9/1996 Nolan
D373,645 S 9/1996 Johnstone et al.
D373,646 S 9/1996 Szymanski et al.
D373,647 S 9/1996 Kaiser
D373,648 S 9/1996 Kaiser
D373,649 S 9/1996 Carbone
D373,651 S 9/1996 Szymanski
D373,652 S 9/1996 Kaiser
5,551,637 A 9/1996 Lo
5,558,278 A 9/1996 Gallorini
D374,271 S 10/1996 Fleischmann
D374,297 S 10/1996 Kaiser
D374,298 S 10/1996 Swyst
D374,299 S 10/1996 Carbone
D374,493 S 10/1996 Szymanski
D374,494 S 10/1996 Santarsiero
D374,732 S 10/1996 Kaiser
D374,733 S 10/1996 Santasiero
5,560,548 A 10/1996 Mueller et al.
5,567,115 A 10/1996 Carbone
D375,541 S 11/1996 Michaluk
5,577,664 A * 11/1996 Heitzman ..... 239/99
D376,217 S 12/1996 Kaiser
D376,860 S 12/1996 Santarsiero
D376,861 S 12/1996 Johnstone et al.
D376,862 S 12/1996 Carbone
D378,401 S 3/1997 Neufeld et al.
5,613,638 A 3/1997 Blessing
5,613,639 A 3/1997 Storm et al.
5,615,837 A 4/1997 Roman
5,624,074 A 4/1997 Parisi
5,624,498 A 4/1997 Lee et al.

| | | | | |
|---|---|---|---|---|
| D379,212 | S | 5/1997 | Chan | |
| D379,404 | S | 5/1997 | Spelts | |
| 5,632,049 | A | 5/1997 | Chen | |
| D381,405 | S | 7/1997 | Waidele et al. | |
| D381,737 | S | 7/1997 | Chan | |
| D382,936 | S | 8/1997 | Shfaram | |
| 5,653,260 | A | 8/1997 | Huber | |
| 5,667,146 | A | 9/1997 | Pimentel et al. | |
| D385,332 | S | 10/1997 | Andrus | |
| D385,333 | S | 10/1997 | Caroen et al. | |
| D385,334 | S | 10/1997 | Caroen et al. | |
| D385,616 | S | 10/1997 | Dow et al. | |
| D385,947 | S | 11/1997 | Dow et al. | |
| D387,230 | S | 12/1997 | von Buelow et al. | |
| 5,699,964 | A | 12/1997 | Bergmann et al. | |
| 5,702,057 | A | 12/1997 | Huber | |
| D389,558 | S | 1/1998 | Andrus | |
| 5,704,080 | A | 1/1998 | Kuhne | |
| 5,718,380 | A | 2/1998 | Schorn et al. | |
| D392,369 | S | 3/1998 | Chan | |
| 5,730,361 | A | 3/1998 | Thonnes | |
| 5,730,362 | A | 3/1998 | Cordes | |
| 5,730,363 | A | 3/1998 | Kress | |
| 5,742,961 | A | 4/1998 | Casperson et al. | |
| D394,490 | S | 5/1998 | Andrus et al. | |
| 5,746,375 | A | 5/1998 | Guo | |
| 5,749,552 | A | 5/1998 | Fan | |
| 5,749,602 | A | 5/1998 | Delaney et al. | |
| D394,899 | S | 6/1998 | Caroen et al. | |
| D395,074 | S | 6/1998 | Neibrook | |
| D395,075 | S | 6/1998 | Neibrook et al. | |
| D395,142 | S | 6/1998 | Neilhook | |
| 5,765,760 | A | 6/1998 | Kuo | |
| 5,769,802 | A * | 6/1998 | Wang | 601/160 |
| 5,772,120 | A | 6/1998 | Huber | |
| 5,778,939 | A | 7/1998 | Hok-Yin | |
| 5,788,157 | A | 8/1998 | Kress | |
| D398,370 | S | 9/1998 | Purdy | |
| 5,806,771 | A | 9/1998 | Loschelder et al. | |
| 5,819,791 | A | 10/1998 | Chronister et al. | |
| 5,820,574 | A | 10/1998 | Henkin et al. | |
| 5,839,666 | A | 11/1998 | Heimann et al. | |
| D402,350 | S | 12/1998 | Andrus | |
| D404,116 | S | 1/1999 | Bosio | |
| 5,855,348 | A | 1/1999 | Fornara | |
| 5,860,599 | A | 1/1999 | Lin | |
| 5,862,543 | A | 1/1999 | Reynoso et al. | |
| 5,862,985 | A | 1/1999 | Neibrook et al. | |
| D405,502 | S | 2/1999 | Tse | |
| 5,865,375 | A | 2/1999 | Hsu | |
| 5,865,378 | A | 2/1999 | Hollinshead et al. | |
| D408,893 | S | 4/1999 | Tse | |
| D409,276 | S | 5/1999 | Ratzlaff | |
| D410,276 | S | 5/1999 | Ben-Tsur | |
| 5,918,811 | A | 7/1999 | Denham et al. | |
| 5,937,905 | A | 8/1999 | Santos | |
| 5,947,388 | A | 9/1999 | Woodruff | |
| D415,247 | S | 10/1999 | Haverstraw et al. | |
| 5,992,762 | A | 11/1999 | Wang | |
| D418,200 | S | 12/1999 | Ben-Tsur | |
| 5,997,047 | A | 12/1999 | Pimentel et al. | |
| D418,902 | S | 1/2000 | Haverstraw et al. | |
| D418,903 | S | 1/2000 | Haverstraw et al. | |
| D422,053 | S | 3/2000 | Brenner et al. | |
| 6,042,027 | A | 3/2000 | Sandvik | |
| 6,042,155 | A | 3/2000 | Lockwood | |
| D422,336 | S | 4/2000 | Haverstraw et al. | |
| D422,337 | S | 4/2000 | Chan | |
| D423,083 | S | 4/2000 | Haug et al. | |
| D424,160 | S | 5/2000 | Haug et al. | |
| D424,161 | S | 5/2000 | Haug et al. | |
| D427,661 | S | 7/2000 | Haverstraw et al. | |
| D428,110 | S | 7/2000 | Haug et al. | |
| D428,125 | S | 7/2000 | Chan | |
| 6,095,801 | A | 8/2000 | Spiewak | |
| 6,123,272 | A | 9/2000 | Havican et al. | |
| D432,624 | S | 10/2000 | Chan | |
| D433,096 | S | 10/2000 | Tse | |
| D433,097 | S | 10/2000 | Tse | |
| 6,126,091 | A | 10/2000 | Heitzman | |
| D434,109 | S | 11/2000 | Ko | |
| 6,164,569 | A | 12/2000 | Hollinshead et al. | |
| 6,164,570 | A | 12/2000 | Smeltzer | |
| D435,889 | S | 1/2001 | Ben-Tsur et al. | |
| D443,025 | S | 5/2001 | Kollmann et al. | |
| D443,029 | S | 5/2001 | Kollmann et al. | |
| 6,230,984 | B1 * | 5/2001 | Jager | 239/225.1 |
| 6,230,988 | B1 | 5/2001 | Chao et al. | |
| 6,230,989 | B1 | 5/2001 | Haverstraw et al. | |
| 6,250,572 | B1 | 6/2001 | Chen | |
| 6,254,014 | B1 * | 7/2001 | Clearman et al. | 239/222.15 |
| 6,270,278 | B1 | 8/2001 | Mauro | |
| 6,276,004 | B1 | 8/2001 | Bertrand et al. | |
| D450,370 | S | 11/2001 | Wales et al. | |
| D450,805 | S | 11/2001 | Lindholm et al. | |
| D450,806 | S | 11/2001 | Lindholm et al. | |
| D450,807 | S | 11/2001 | Lindholm et al. | |
| D451,169 | S | 11/2001 | Lindholm et al. | |
| D451,170 | S | 11/2001 | Lindholm et al. | |
| D451,171 | S | 11/2001 | Lindholm et al. | |
| D451,172 | S | 11/2001 | Lindholm et al. | |
| D451,583 | S | 12/2001 | Lindholm et al. | |
| D451,980 | S | 12/2001 | Lindholm et al. | |
| D452,553 | S | 12/2001 | Lindholm et al. | |
| D452,725 | S | 1/2002 | Lindholm et al. | |
| D452,897 | S | 1/2002 | Gillette et al. | |
| D453,370 | S | 2/2002 | Lindholm et al. | |
| D453,551 | S | 2/2002 | Lindholm et al. | |
| D457,937 | S | 5/2002 | Lindholm et al. | |
| 6,454,186 | B1 | 9/2002 | Haverstraw et al. | |
| 6,464,265 | B1 | 10/2002 | Mikol | |
| D468,800 | S | 1/2003 | Tse | |
| D471,953 | S | 3/2003 | Colligan et al. | |
| 6,533,194 | B1 * | 3/2003 | Marsh et al. | 239/383 |
| 6,641,057 | B1 | 11/2003 | Thomas et al. | |
| D485,887 | S | 1/2004 | Luettgen et al. | |
| D487,498 | S | 3/2004 | Blomstrom | |
| D490,498 | S | 5/2004 | Golichowski | |
| 6,739,523 | B1 | 5/2004 | Haverstraw et al. | |
| D492,007 | S | 6/2004 | Kollmann et al. | |
| 6,742,725 | B1 * | 6/2004 | Fan | 239/525 |
| D493,208 | S | 7/2004 | Lin | |
| D496,987 | S | 10/2004 | Glunk | |
| D497,974 | S | 11/2004 | Haug et al. | |
| D498,514 | S | 11/2004 | Haug et al. | |
| D500,121 | S | 12/2004 | Blomstrom | |
| D500,547 | S | 1/2005 | Blomstrom | |
| D500,549 | S | 1/2005 | Blomstrom | |
| D501,242 | S | 1/2005 | Blomstrom | |
| 2004/0074993 | A1 | 4/2004 | Thomas et al. | |
| 2005/0061896 | A1 | 3/2005 | Luettgen et al. | |
| 2005/0082824 | A1 | 4/2005 | Luettgen et al. | |

FOREIGN PATENT DOCUMENTS

| | | |
|---|---|---|
| CH | 234284 | 3/1963 |
| DE | 352813 | 5/1922 |
| DE | 848627 | 9/1952 |
| DE | 854100 | 10/1952 |
| DE | 2360534 | 6/1974 |
| DE | 2806093 | 8/1979 |
| DE | 3107808 | 9/1982 |
| DE | 3246327 | 6/1984 |
| DE | 3440901 | 7/1985 |
| DE | 4034695 | 5/1991 |
| DE | 19608085 | 9/1996 |

| | | |
|---|---|---|
| EP | 0167063 | 6/1985 |
| EP | 0478999 | 4/1992 |
| EP | 0617644 | 10/1994 |
| EP | 0683354 | 11/1995 |
| EP | 0687851 | 12/1995 |
| EP | 0695907 | 2/1996 |
| EP | 0719588 | 7/1996 |
| EP | 0721082 | 7/1996 |
| EP | 0733747 | 9/1996 |
| EP | 0808661 | 11/1997 |
| EP | 0726811 | 1/1998 |
| FR | 538538 | 6/1922 |
| FR | 873808 | 7/1942 |
| FR | 1039750 | 10/1953 |
| FR | 1098836 | 8/1955 |
| FR | 2695452 | 3/1994 |
| GB | 3314 | 0/1914 |
| GB | 10086 | 0/1894 |
| GB | 129812 | 7/1919 |
| GB | 204600 | 10/1923 |
| GB | 634483 | 3/1950 |
| GB | 971866 | 10/1964 |
| GB | 2066074 | 1/1980 |
| GB | 2066704 | 7/1981 |
| GB | 2156932 A | 10/1985 |
| GB | 2199771 | 7/1988 |
| GB | 2298595 | 11/1996 |
| IT | 327400 | 7/1935 |
| IT | 350359 | 7/1937 |
| IT | 563459 | 5/1957 |
| JP | S63-181459 | 11/1988 |
| JP | H2-78660 | 6/1990 |
| NE | 8902957 | 6/1991 |
| WO | WO93/12894 | 7/1993 |
| WO | WO93/25839 | 12/1993 |
| WO | WO98/30336 | 7/1998 |

OTHER PUBLICATIONS

Color Copy, Labeled 1B, Gemlo, available at least as early as Dec. 2, 1998.

* cited by examiner

DUAL MASSAGE SHOWER HEAD

CROSS-REFERENCE TO RELATED APPLICATIONS

This application claims priority to U.S. provisional application Ser. No. 60/432,463, filed 10 Dec. 2002 and entitled "Dual Massage Shower Head," the entirety of which is incorporated herein as if fully set forth.

BACKGROUND ART

1. Field of the Invention

The present invention relates generally to the field of shower heads, and more specifically to a shower head having two or more massage orifices capable of simultaneous operation.

2. Background Art

Generally, shower heads are used to direct water from the home water supply onto a user for personal hygiene purposes. Showers are an alternative to bathing in a bath tub.

In the past, bathing was the overwhelmingly popular choice for personal cleansing. However, in recent years showers have become increasingly popular for several reasons. First, showers generally take less time than baths. Second, showers generally use significantly less water than baths. Third, shower stalls and bath tubs with shower heads are typically easier to maintain. Over time, showers tend to cause less soap scum build-up.

With the increase in popularity of showers has come an increase in shower head designs and shower head manufacturers. Many shower heads, for example, may emit pulsating streams of water in a so-called "massage" mode.

However, over time, several shortcomings with existing shower head designs have been identified. For example, many shower heads fail to provide a sufficiently powerful, directed, or pleasing massage. Yet other shower heads have a relatively small number of shower spray patterns.

Accordingly, there is a need in the art for an improved shower head design.

SUMMARY OF THE INVENTION

One embodiment of the present invention generally takes the form of a shower head comprising a body having an inlet for connection to a water conduit, a first outlet nozzle formed on the body, a second outlet nozzle formed on the body, a first turbine operably connected to the first outlet nozzle, and a second turbine operably connected to the second outlet nozzle.

Another embodiment of the present invention takes the form of a flow actuation system, comprising an actuator ring, a valve operably connected to the actuator ring and forming a flow channel, a first actuation point defined on the actuator ring, a second actuation point defined on the actuator ring, and at least one plunger situated within the flow channel, wherein the at least one plunger extends radially outwardly from a center of the valve when aligned with one of the first and second actuation points.

Yet another embodiment of the present invention takes the form of a shower head, comprising an inlet orifice, a valve in fluid communication with the inlet orifice, a backplate in fluid communication with the valve, a first turbine in fluid communication with the backplate, a second turbine in fluid communication with the backplate, and a faceplate comprising first and second nozzle groups, the first nozzle group in fluid communication with the first turbine, the second nozzle group in fluid communication with the second turbine.

Additional embodiments and advantages of the present invention will occur to those skilled in the art upon reading the detailed description of the invention, below.

DETAILED DESCRIPTION OF THE INVENTION

Figure 1:
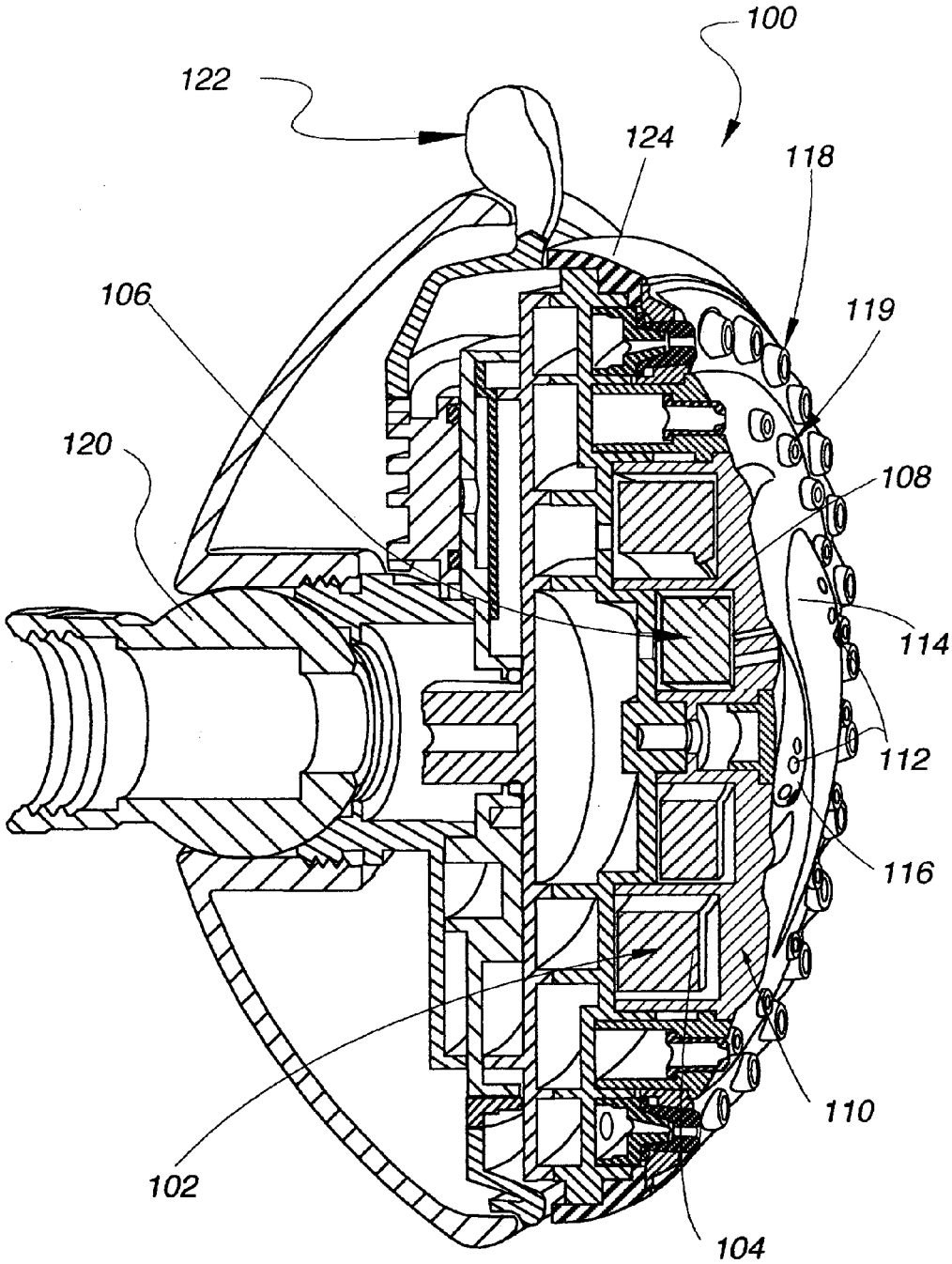
FIG. 1 depicts a cross-section view of a first embodiment of the present invention.

Generally, one embodiment of the present invention encompasses a shower head having two or more turbines, which may act to create a dual massage mode. Other spray modes also may be included on the shower head, and alternate embodiments of the invention may include triple, quadruple, or other multiple massage modes. The dual turbines can be positioned side by side or concentrically. The turbines can spin the same direction or opposite directions. The turbines can be actuated in separate modes, or together in the same mode, or both options can be implemented on a single shower head. FIGS. 1–12 show various drawings of both the side-by-side dual turbine and the concentric dual turbine.

Generally, FIGS. 1–6 show the concentric dual turbine shower head 100. The larger outer turbine 102 is positioned in an outer annular channel 104 into which water flows. The incoming water impacts the turbine, causing it to spin. Part of the turbine blades are blocked off, and part are not blocked off, causing a pulsating effect in the resulting spray as the turbine spins. The smaller turbine 106 is positioned inside of and concentric to the larger turbine 102, and operates the same way. It is positioned in a smaller circular channel 108 positioned within the outer annular channel 104. Both turbines spin generally around the same axis, which in this embodiment is may be positioned so that they spin around different axes, with one turbine still inside the other turbine.

An orifice cup 110 is positioned over the top of the two turbine channels 104, 108 and attached to the shower head 100. The orifice cup has orifices 112, or nozzles, formed therein for emitting the pulsating spray. The orifice cup 110 has an outer circular channel 114 to match the outer annular channel 104, and has an inner circular channel 116 to match the smaller circular channel 108.

In the embodiment shown in FIG. 1, the other spray modes are sent through apertures 118, 119 formed outside of and around the concentric turbine section. These other spray modes may emanate in combination with, or separately from, the aforementioned pulsating spray mode.

Typically, water flows from the shower pipe, into the connection ball 120, into the rear of the shower head 100, and is routed, based on the mode selector 122, to the nozzles 118 corresponding to a selected spray mode. The shower head is generally made of a series of plates having channels and holes formed therein to direct the water to the nozzles 118, 119 corresponding to the selected spray mode(s), as determined by a position of a mode selector 122. A mist control diverts water flow from whatever spray mode is set to various mist apertures 119, and back, as desired. In some embodiments, the mist control can be set so that both the current spray mode and the mist mode are actuated at the same time.

Figure 2:
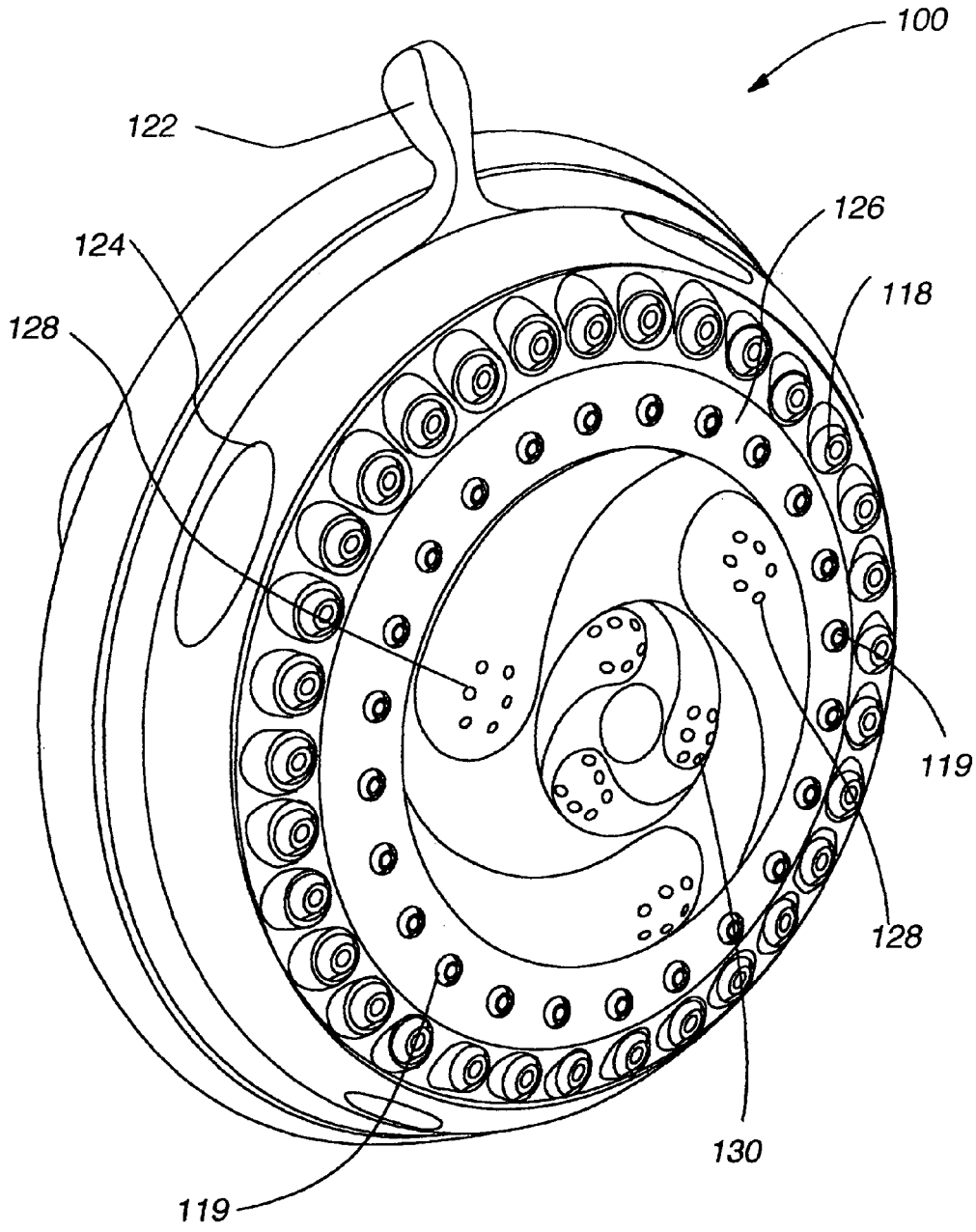
FIG. 2 depicts a front perspective view of the first embodiment, including depicting a mist mode selector.

FIG. 2 shows a front perspective view of the shower head 100 of FIG. 1, with the mode control ring 124 on the perimeter of the shower head. The regular spray mode orifices 118 are positioned around the perimeter of the front face 126, with the mist spray mode orifices 119 forming a circle inside the regular spray mode orifices 118. The outer pulsating mode orifices 128 are typically positioned in groups inside the mist spray mode orifices 22+, and communicate with the channel 104 in which the larger turbine 102 is positioned. The inner pulsating mode orifices 130 are generally positioned in groups inside the outer pulsating mode orifices 128, and communicate with the channel 108 in which the smaller turbine 106 is positioned.

Figure 3:
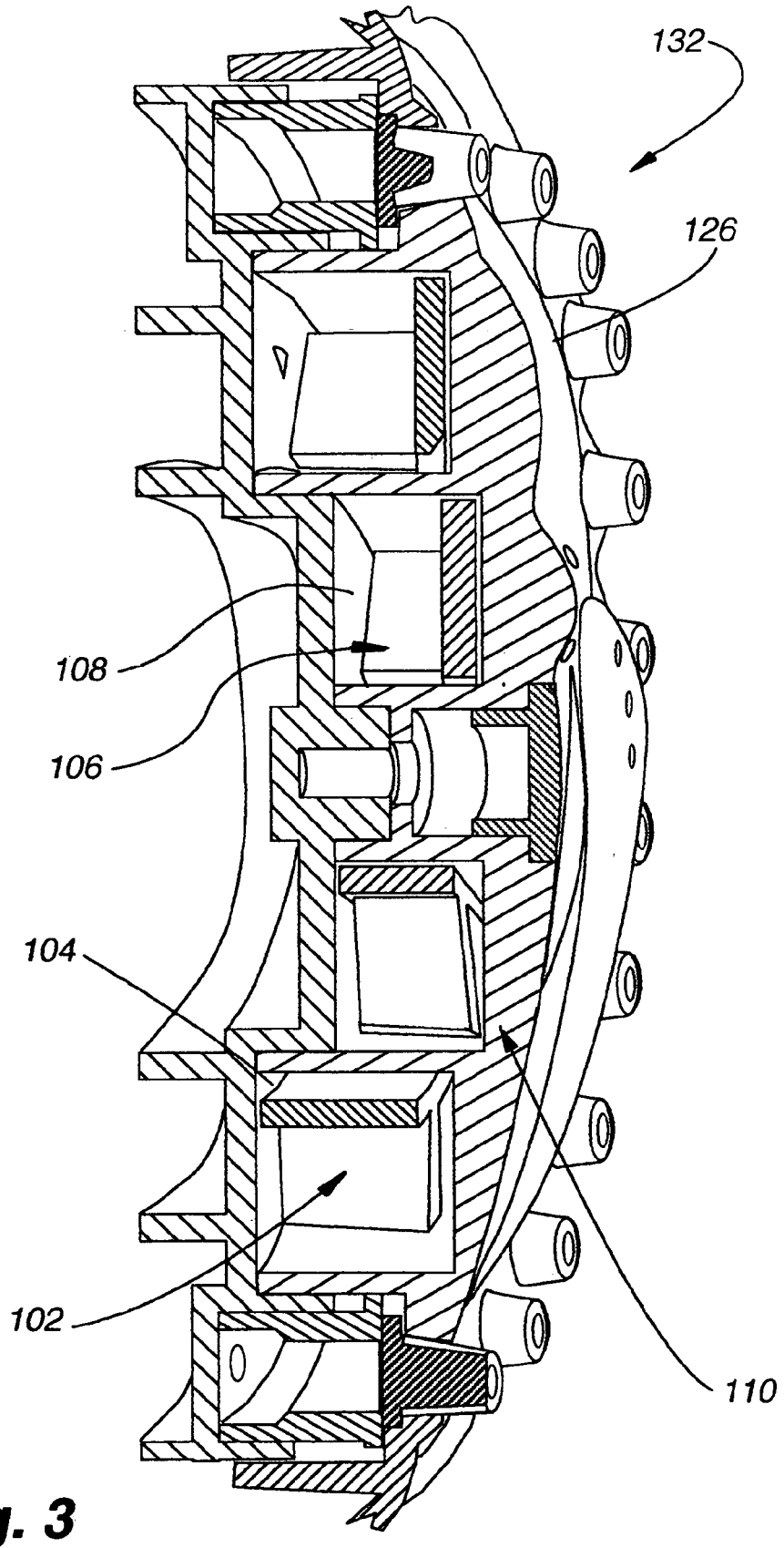
FIG. 3 depicts a partial cross-section view of a second embodiment of the present invention.
Figure 4:
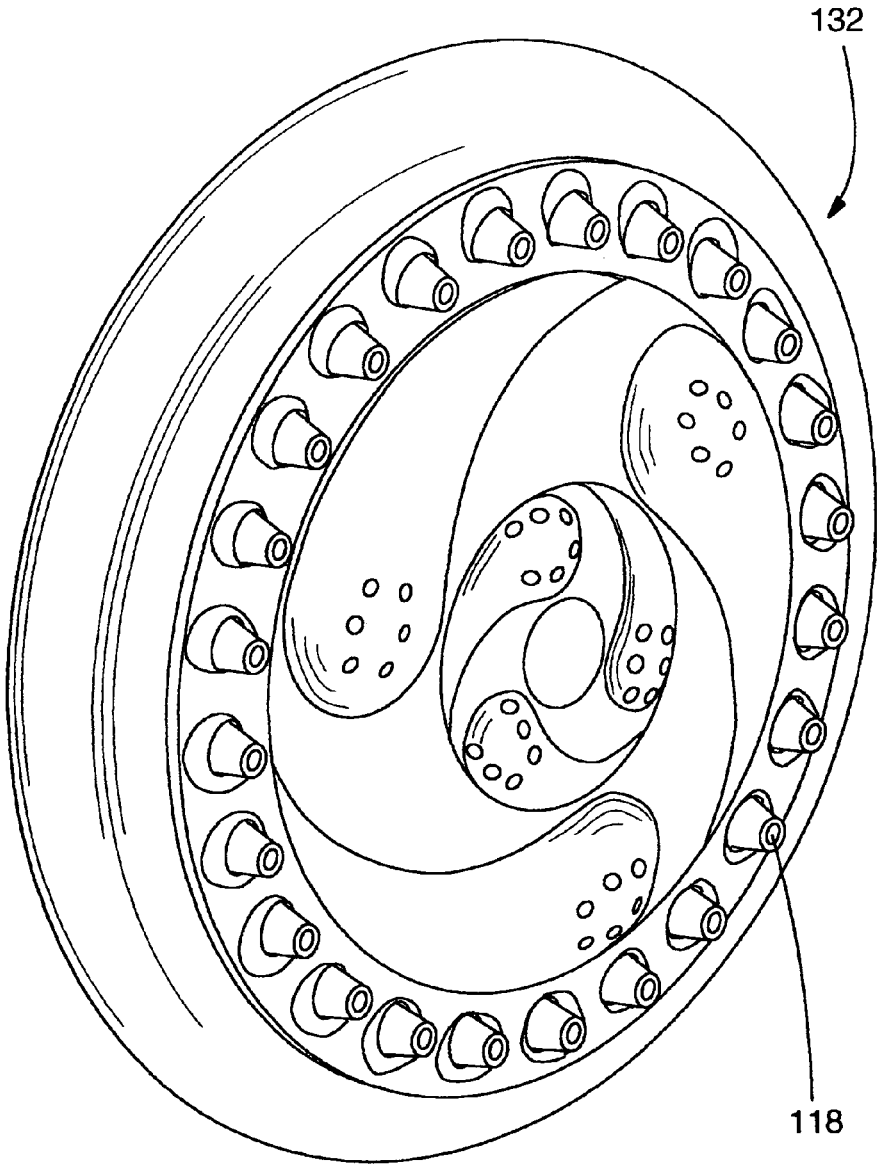
FIG. 4 depicts a front perspective view of the second embodiment.

FIG. 3 depicts another embodiment 132 of the present invention, and also shows the channel 108 for the smaller turbine 106 offset forwardly from the channel 104 for the larger turbine 102, which conforms with the rounded face 126 of the showerhead 132. FIG. 4 shows the concentric turbine design in a shower head 132 that incorporates only one other spray mode- namely, from orifices 118 positioned around the perimeter of the front face of the shower head.

Figure 5:
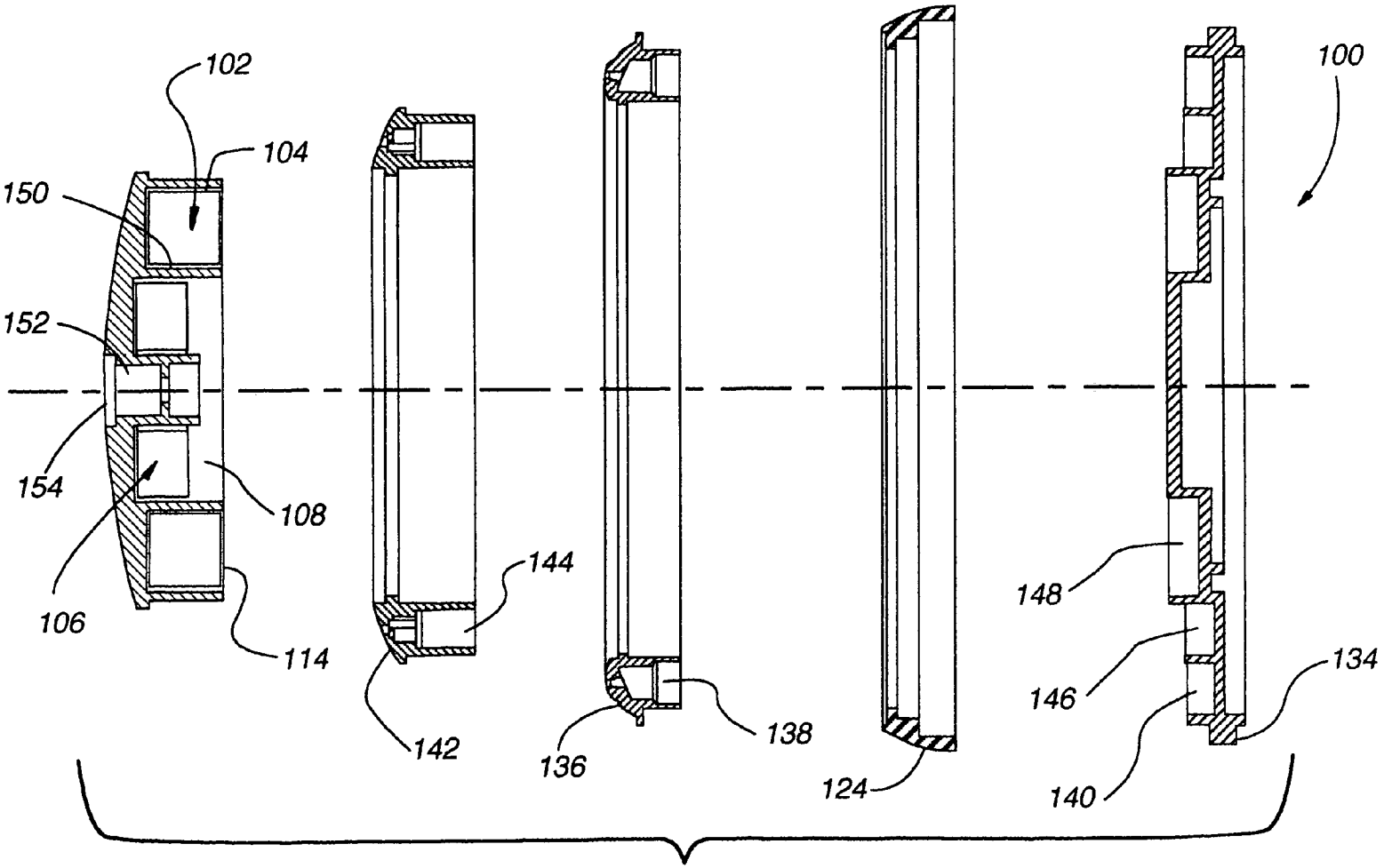
FIG. 5 depicts a partial, exploded view of the first embodiment.

The plate style of the internal structure associated with this type of shower head 100 is shown in FIG. 5, where there are two modes separate from the turbine pulse spray modes. The mode ring 124 fits around the perimeter of the front engine plate 134, and engages and acts to rotate a plate (not shown) positioned behind the front engine plate to divert water to the selected modes. The outer spray ring and nozzle plate 136 fits on the front of the front engine plate 134 and has an outer channel 138 that mates up with the outer channel 140 on the front engine plate 134 to form a water cavity to supply water to the outer ring orifices 118 when that mode is selected.

The mist mode spray ring and nozzle plate 142 fits on the front of the front engine plate 134, inside the outer spray ring and nozzle plate 136. The mist mode spray ring and nozzle plate 142 defines at least one channel 144 that matches with the corresponding channel 146 formed in the front of the front engine plate 134. It forms a water cavity to supply water to the mist mode orifices 119 when that mode is selected.

The dual orifice cup 110 fits on the front of the front engine plate 134 to form the annular channels 104, 108 for holding the turbines 102, 106. The orifice cup 110 has an outer channel 114 to mate with an outer turbine channel 148 on the front engine plate 134. The turbine 102 uses the inner circumferential wall 150 of that channel as a race about which to spin. The orifice cup 110 forms an inner channel 116 to mate with the front engine plate 134 to form the cavity in which the smaller turbine 106 spins. The smaller turbine spins around the central boss 152 used to form the aperture 154 for receiving the fastener used to hold the orifice cup 110 to the shower head 100.

Figure 6:
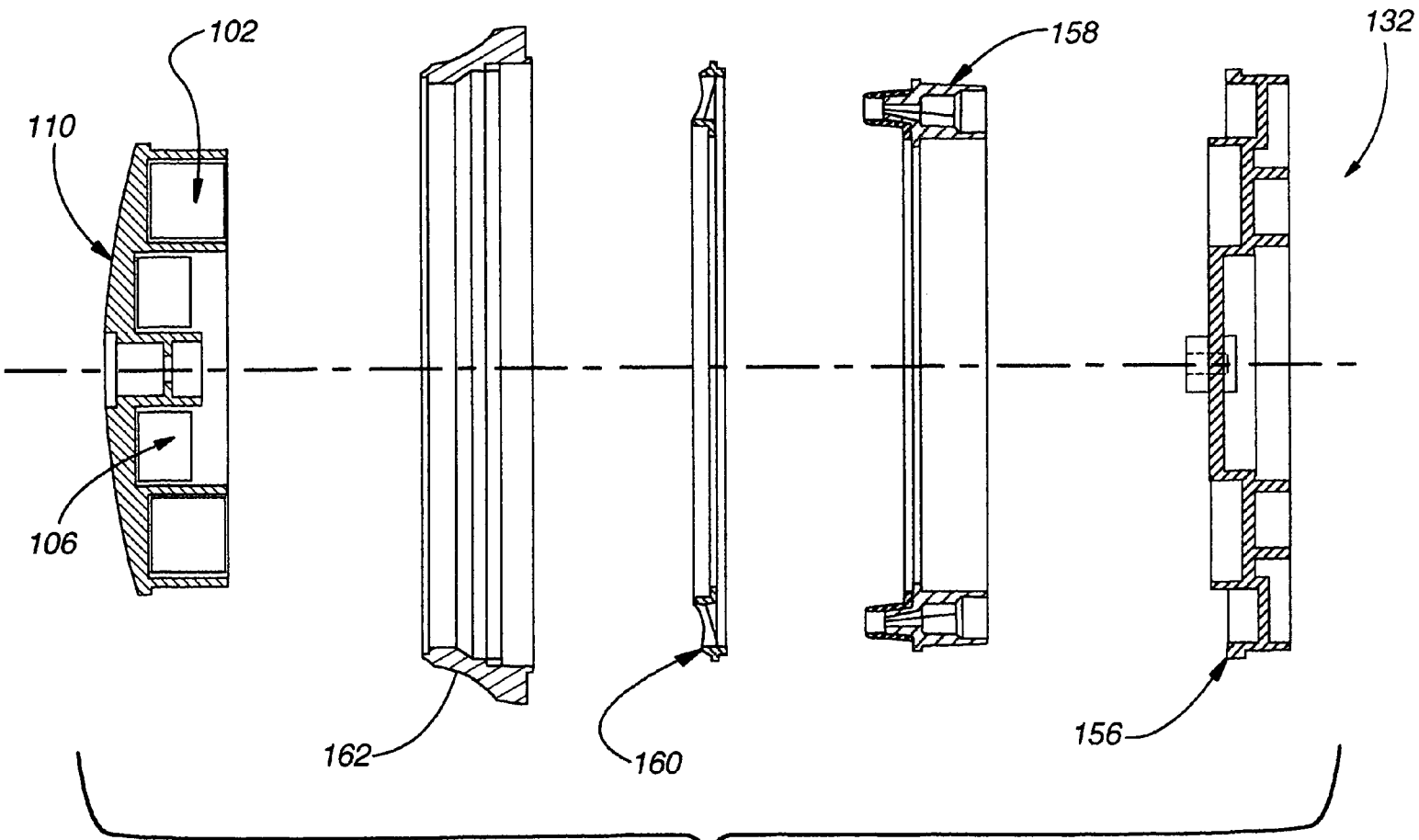
FIG. 6 depicts a partial, exploded view of the second embodiment.

FIG. 6 shows the plate structure for use with the shower head 132 having only one spray mode separate from the two turbine pulse spray modes. The structure is substantially similar to that shown in FIG. 5. For example, the embodiment shown in FIG. 6 includes a front engine plate 156, an outer spray nozzle assembly 158, an outer spray ring 160, and a mode ring 162. The dual orifice cup 110 houses the two turbines 102, 106.

Figure 7:
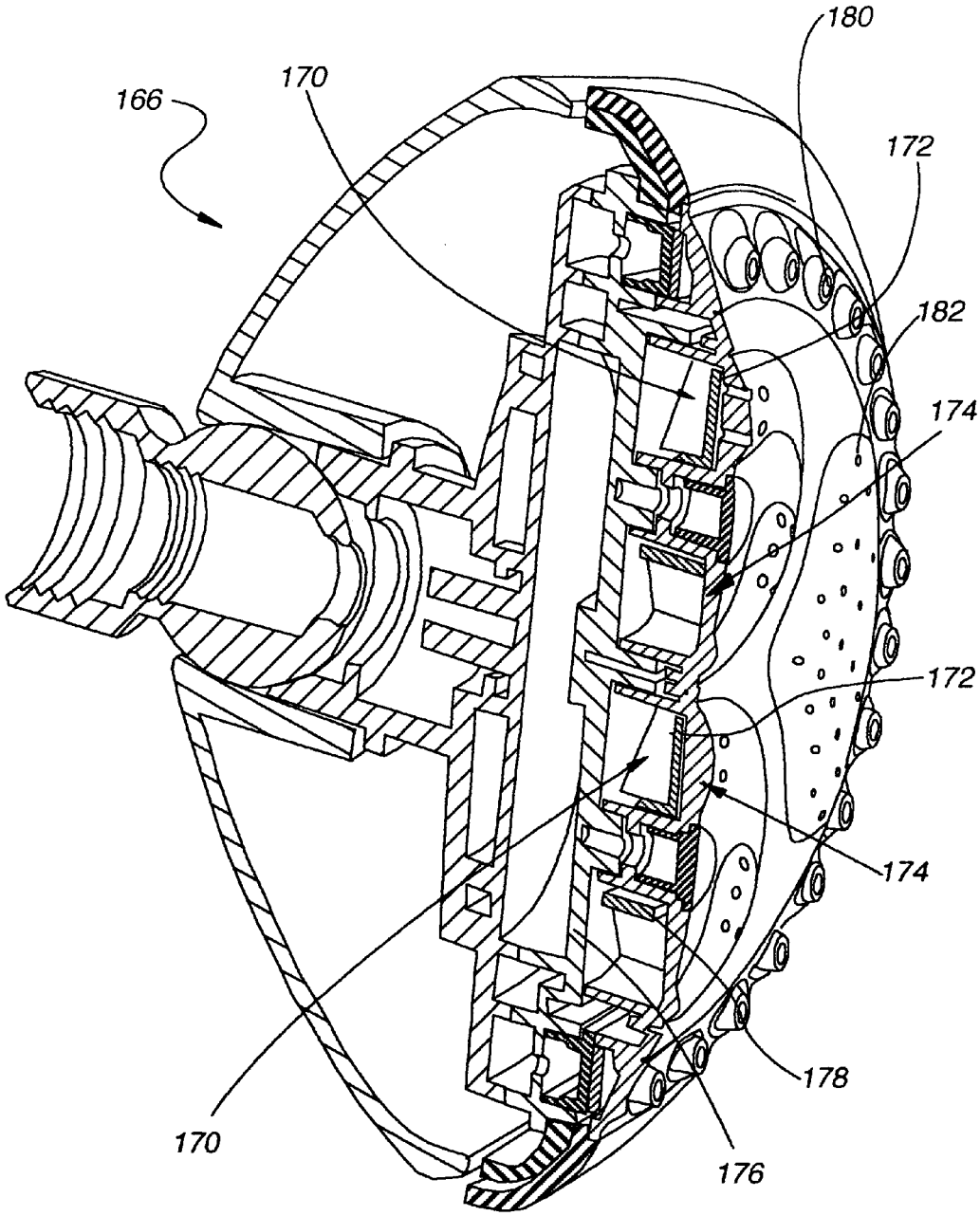
FIG. 7 depicts a cross-section view of a third embodiment of the present invention.
Figure 8:
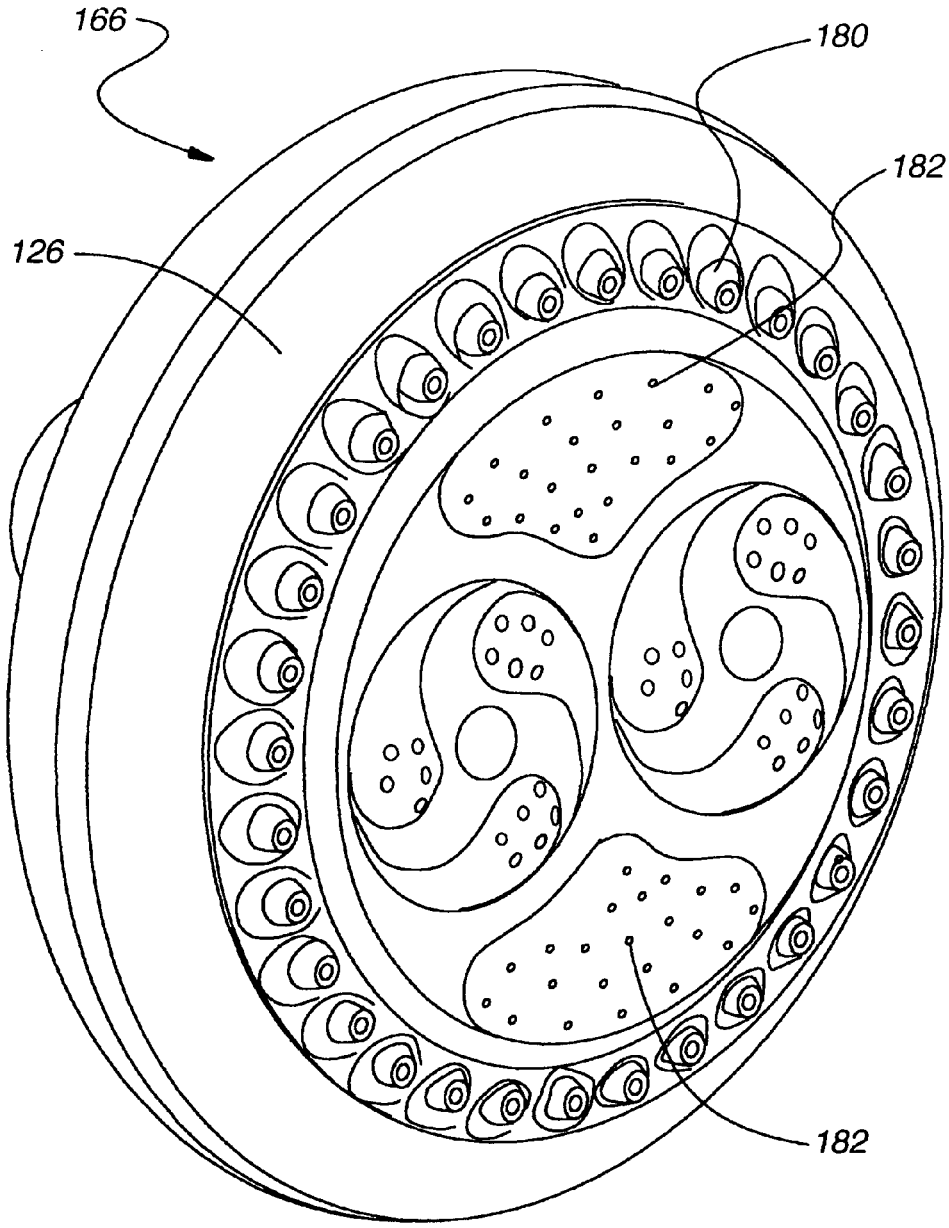
FIG. 8 depicts a front perspective view of the third embodiment.
Figure 9:
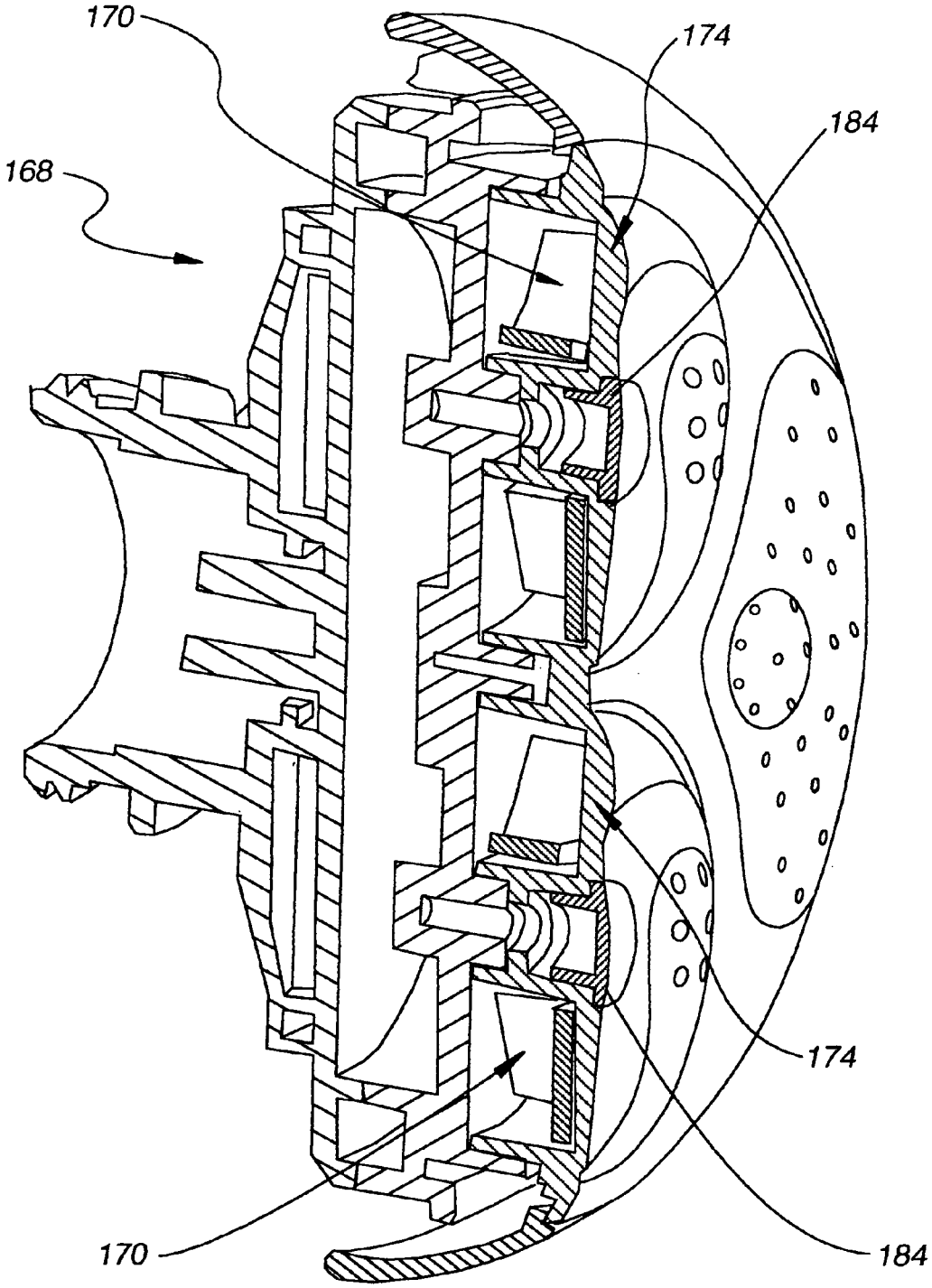
FIG. 9 depicts a cross-section view of a fourth embodiment of the present invention.
Figure 10:
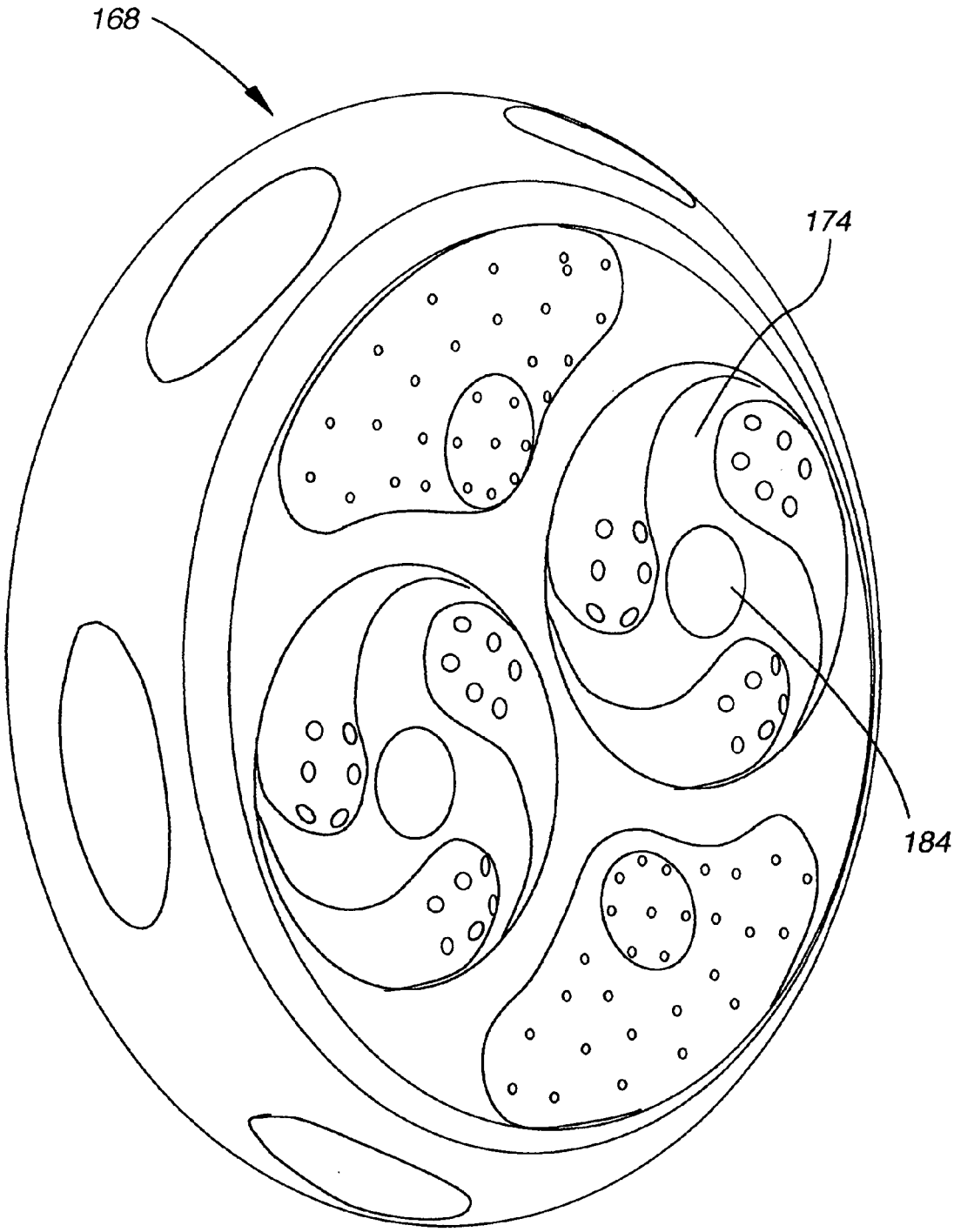
FIG. 10 depicts a front perspective view of the fourth embodiment.

FIGS. 7–12 show two embodiments of a side-by-side dual pulsating shower head. FIGS. 7 and 8 show a shower head 166 having two spray modes separate from the turbine pulsation modes, and FIGS. 9 and 10 show a shower head 168 having only one mode separate from the turbine pulsation modes.

FIG. 7 is a section through both side-by-side turbines 170, their respective chambers 172, and the shower head 166. Each side-by-side turbine 170 resides in its own circular channel 172 formed by the mating of the orifice cup 174 and the front engine plate 176. The routing of the water through this shower head, like previously described above, depends on the mode selector. The mode selector can be set to spin either turbine independently, or together at the same time. And depending on the direction of the incoming jets in the turbine cavity 172, the turbines 170 can be caused to rotate the same direction or opposite directions from one another. Each of the side-by-side turbines 170 spin around a central hub 178 formed by the channel cavity 172 in which each turbine is placed. In this embodiment, the turbines 170 are positioned along a centerline of the shower head. It is contemplated that the turbines can be asymmetrically positioned on the shower head if desired. In this embodiment, one other mode is sprayed through orifices 180 formed on the perimeter of the front face 126 of the shower head 166. Another mode is sprayed through a pair of laterally-spaced, somewhat triangular orifice groupings 182 formed on either side of the side-by-side turbine locations.

FIGS. 9 and 10 show similar structure for a shower head 168 that has only one mode different than the pulsating mode. The structure and placement of the side-by-side turbines 170 is substantially similar to that described above.

Figure 11:
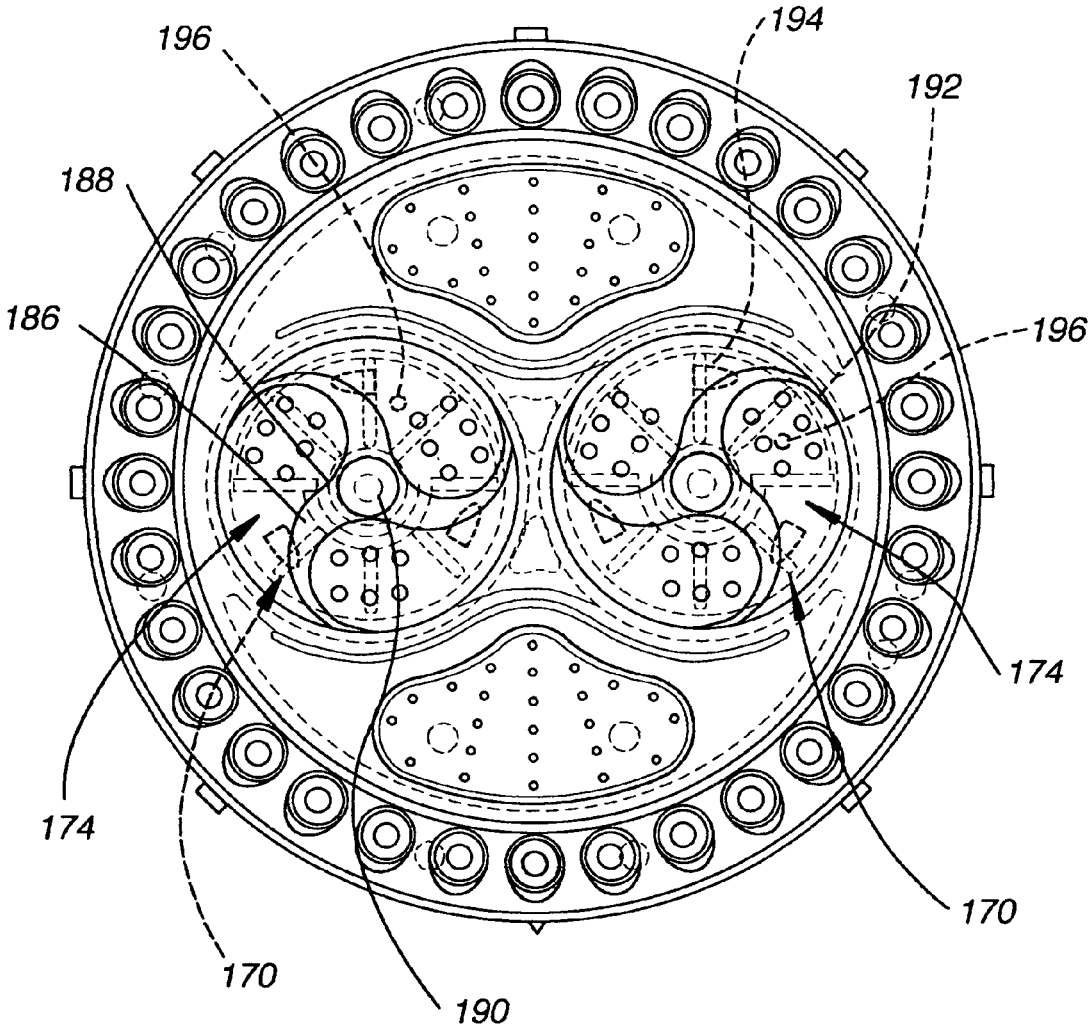
FIG. 11 depicts a front view of the third embodiment.

As can be seen in FIG. 11, each turbine 170 has a series of radially extending blades 186 attached at their inner ends 188 to an inner hub 190. A baseplate 192 (shown by dashed lines) is formed under approximately half of the circle formed by the radiating blades 186. The plate is attached to the hub 190 and the fins 194 (also shown by dashed lines). This plate is positioned against the orifices in the orifice cup 174 to block the water flow therethrough. The plate 192 is what causes the pulsation in the flow, as the turbine 170 rotates in the cavity 172 and alternately blocks/allows the water to pass through the orifices. The plate can extend more or less than halfway around the circle. The fins 194 shown in dashed lines are located on top of the plate. The fins 194 in whole-line do not have a plate under them. The plate has at least one hole 196 in it to keep the incoming water pressure from trapping the turbine 170 against the side of the cavity 172 having the orifices and keeping the turbine from spinning at all. The hole lets water through the plate and releases the pressure sufficiently to allow the turbine to spin.

Figure 12:
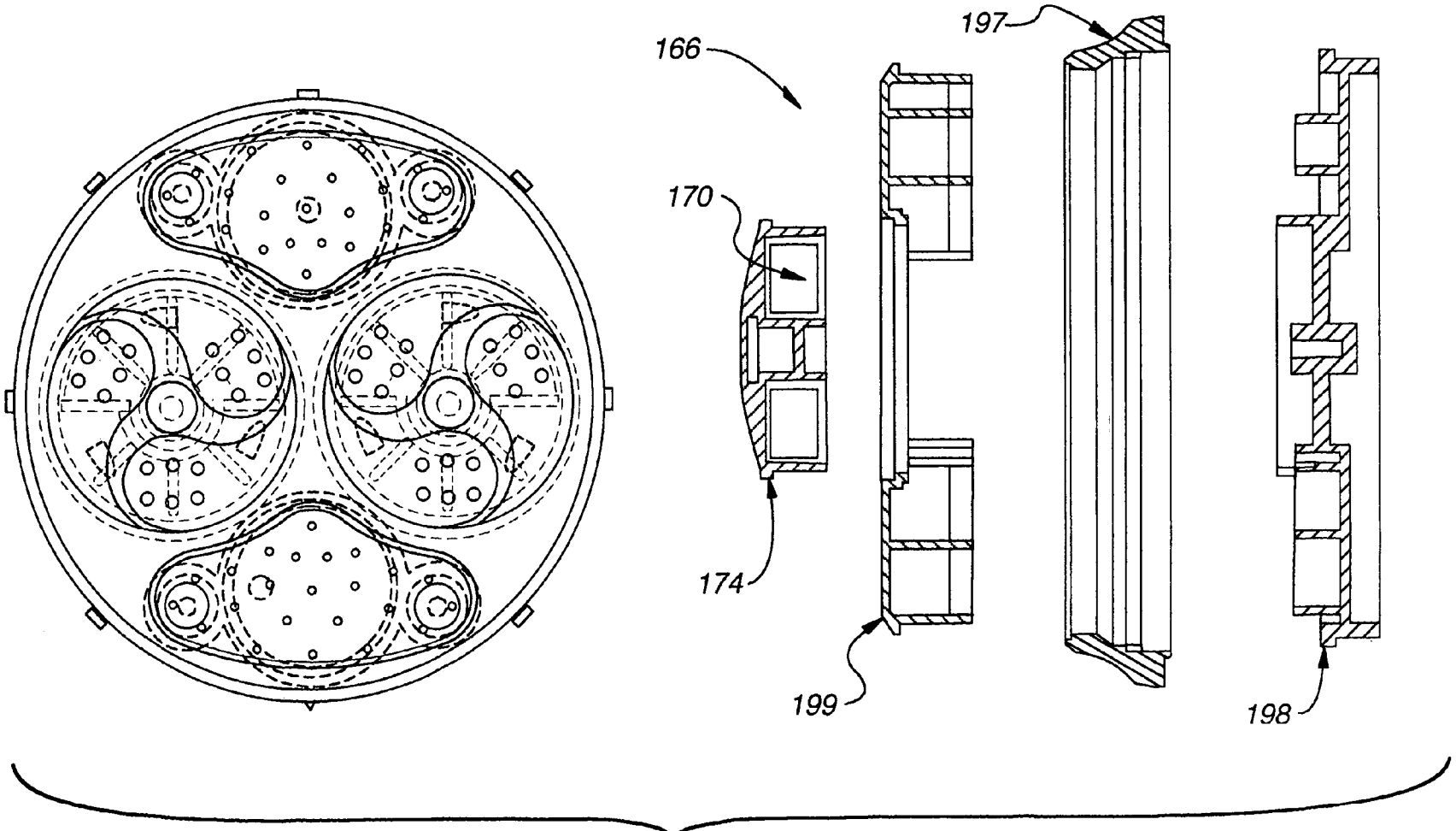
FIG. 12 depicts a partial, exploded view of the third embodiment.

FIG. 12 shows an exploded view of the plate structure for the side-by-side dual turbine pulsating flow showerhead 166, as well as a front view thereof. The structure is similar to that described above, and there is an orifice cup 174 for each of the two turbines 170. Each orifice cup 174 is held in place by a fastener 184 positioned through the hub in the orifice plate and fastened to the front engine plate 198.

Figure 13:
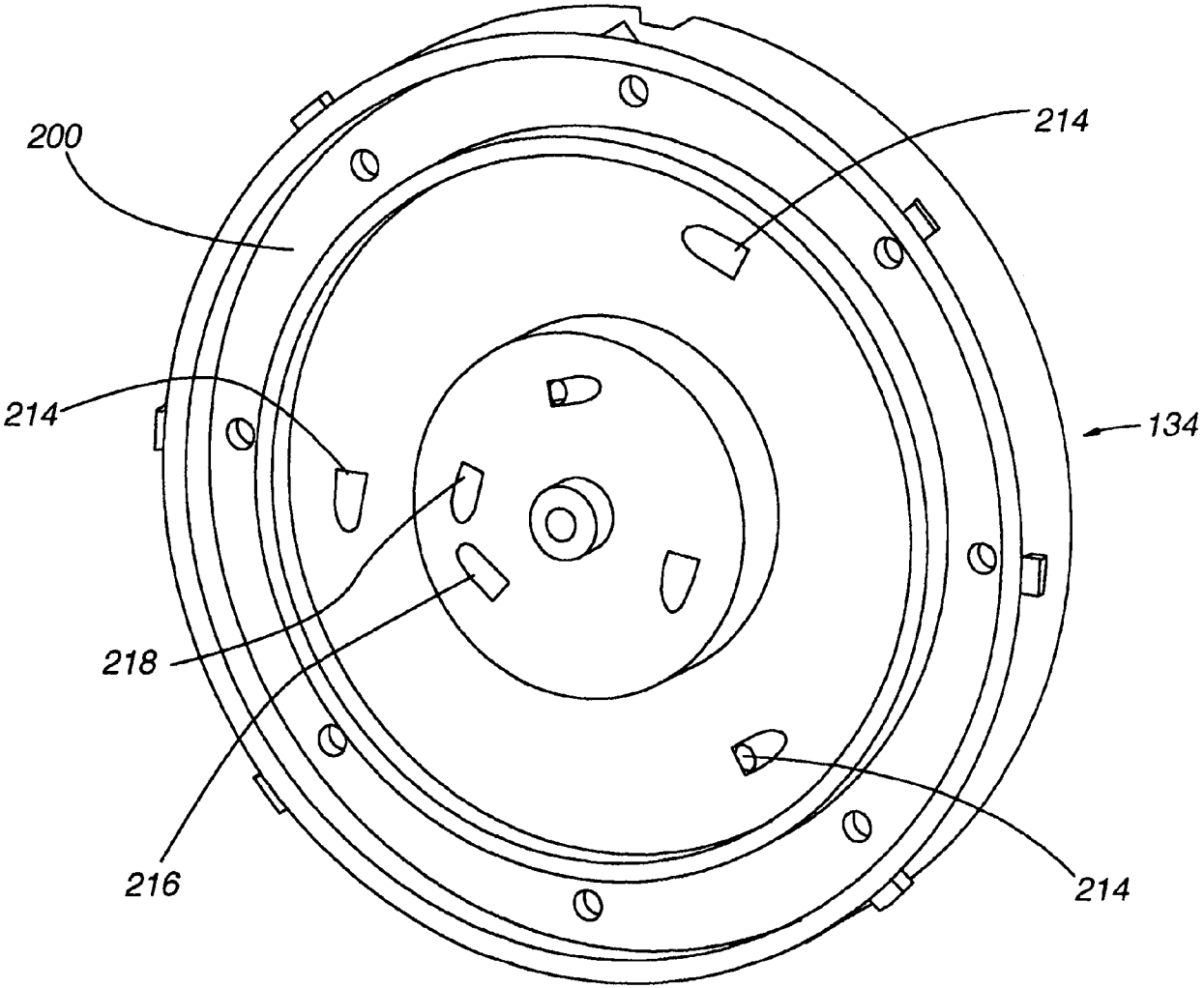
FIG. 13 depicts the front side of a front engine plate having concentric dual turbines.
Figure 14:
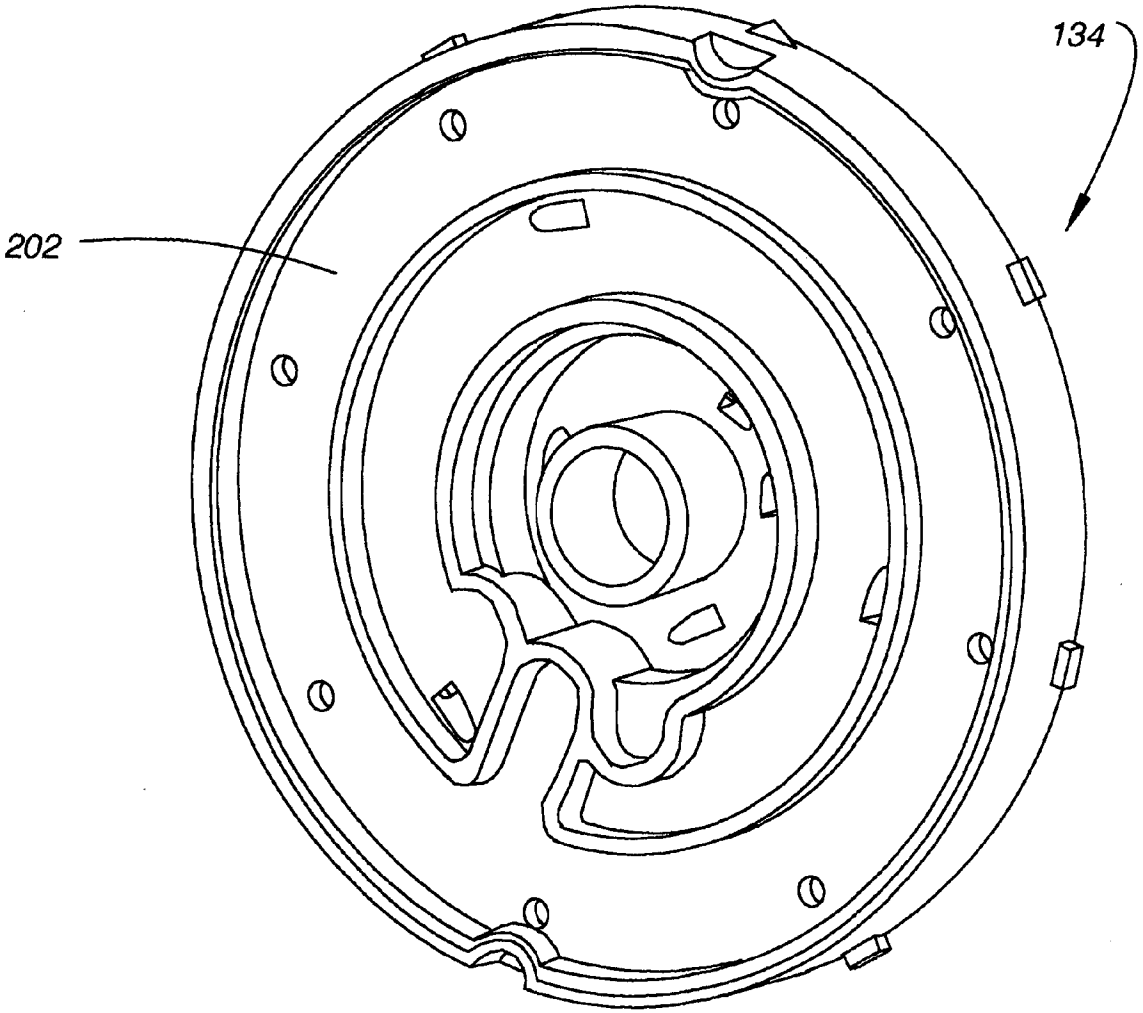
FIG. 14 depicts the rear side of the front engine plate of FIG. 13.
Figure 15:
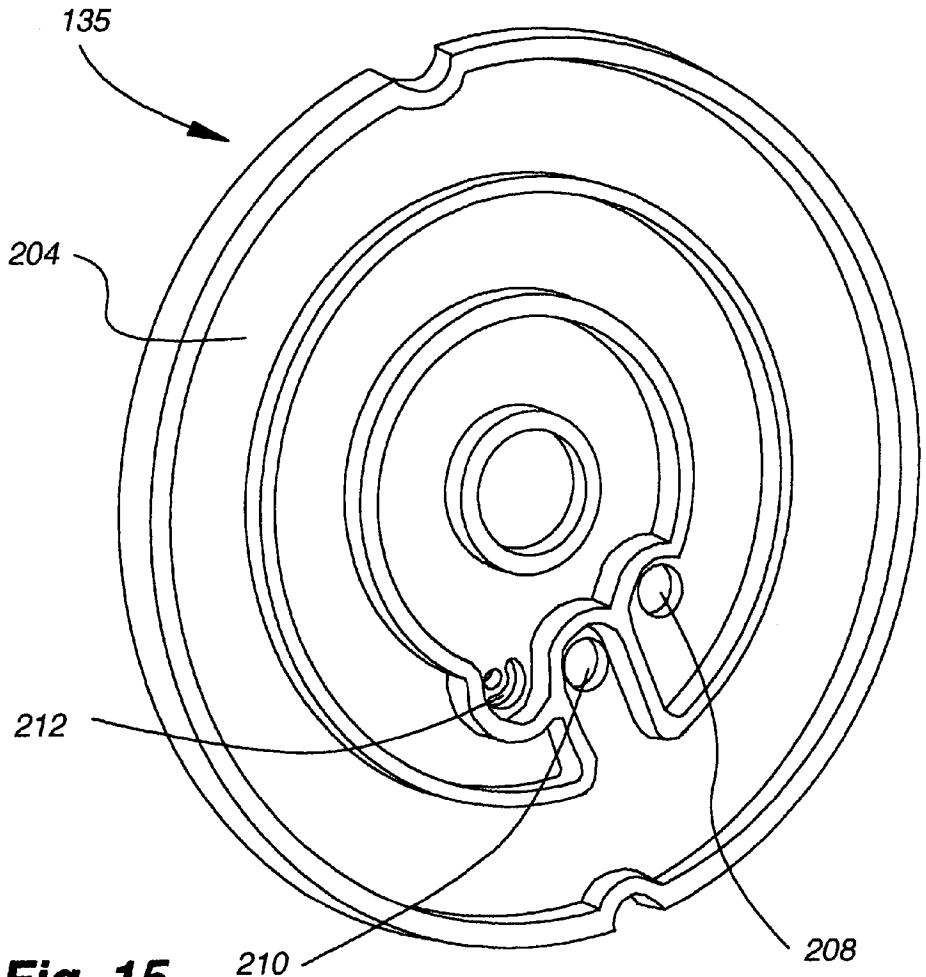
FIG. 15 depicts the front side of a back engine plate having concentric dual turbines.
Figure 16:
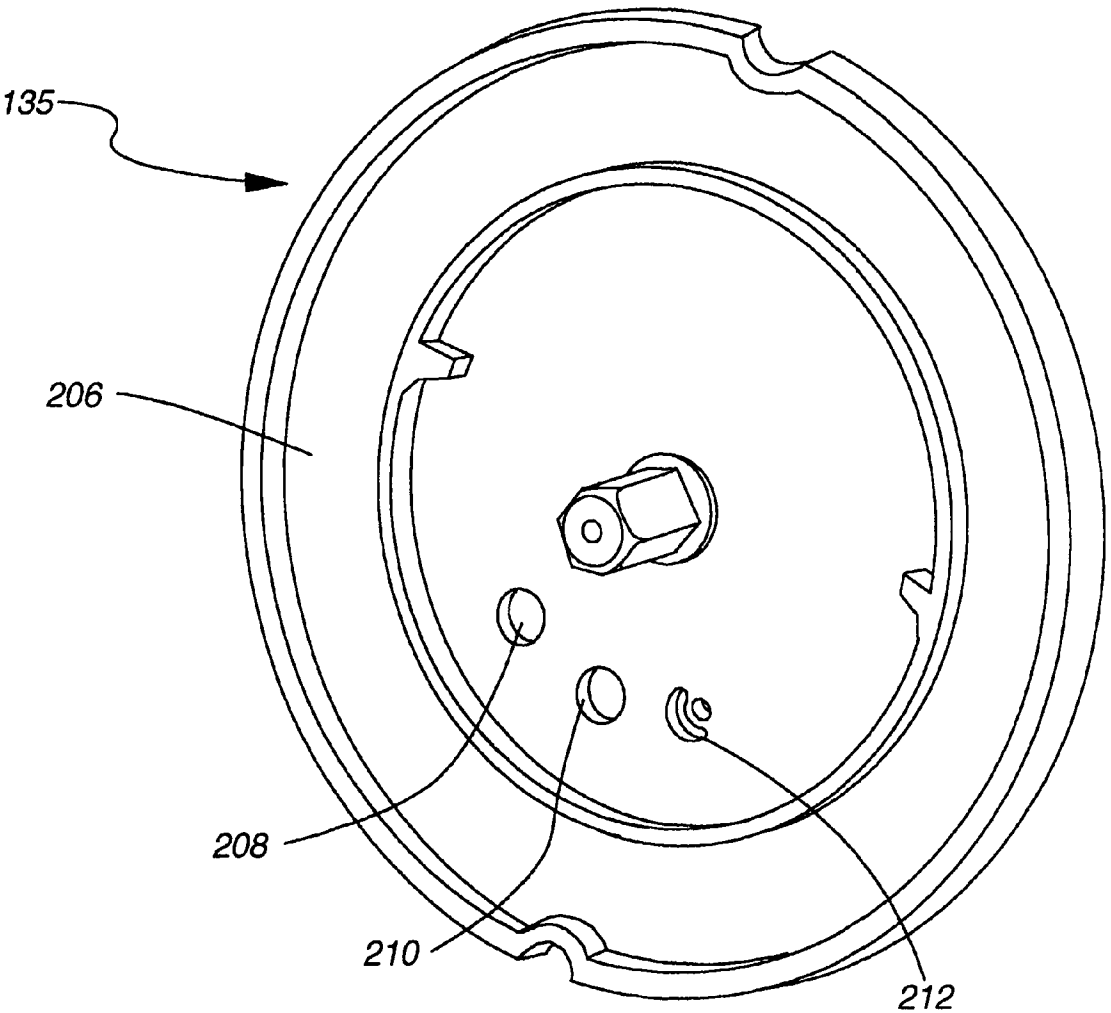
FIG. 16 depicts the rear side of the back engine plate of FIG. 15.

FIGS. 13–17 show the plate structure for the concentric dual turbine pulsating shower head 100. FIG. 13 is the front side 200 of the front engine plate 134. FIG. 14 is the rear side 202 of the front engine plate 134, which mates with the front side 204 of a rear engine plate 135 (shown generally in FIG. 15). FIG. 16 depicts the rear side 206 of the rear engine plate 135. The water flows through one of the three main holes 208, 210, 212, from the rear to the front of the rear engine plate 135 (the small hole is the pause hole to allow some water through and not cause a dead-head in the water flow). The water flows through the hole selected by the mode selector (not shown), which is known in the art, and is a plate, controlled by an outside control ring, that has a sealed aperture which fits over any one of the three apertures in plate two in order to direct the water flow into the selected mode. If the water flows through the hole 208 the water flows to the outer turbine 102 to create the pulsating flow through the outer pulsating flow apertures (see above). If the water flows through the hole 210 the water flows to the outer most channel 104 and through the apertures 128 formed around the perimeter of the shower head. If the water flows through the hole 212 the water flows to the channel 108 directing the flow to the inner turbine 106. In this embodiment, the inner and outer turbines cannot be activated at the same time. However, by rearranging the channels and holes accordingly on the plates, the two turbines can be made to operate at the same time, or the turbines and at least one non-pulsating mode may be selected.

FIGS. 13 and 14 show three inlet jets 214 for the outer turbine channels that are all directed the same way to impinge on the flat, straight turbine blades 186 and drive the turbine 102 around the central hub 178 (as described above). Alternate embodiments may use more or fewer inlet jets. This creates a high-speed pulsating spray.

In FIG. 13, there is a fourth inlet 218 facing against the other three 216. This acts to cause water to impinge the blades in an opposite direction than the other three, which slows the small turbine 106 down sufficiently so that the pulse caused by the bottom plate by the turbine can be discerned by the user. It also lets a full volume of water flow through the mode. This creates a low-speed pulsating spray.

Figure 17:
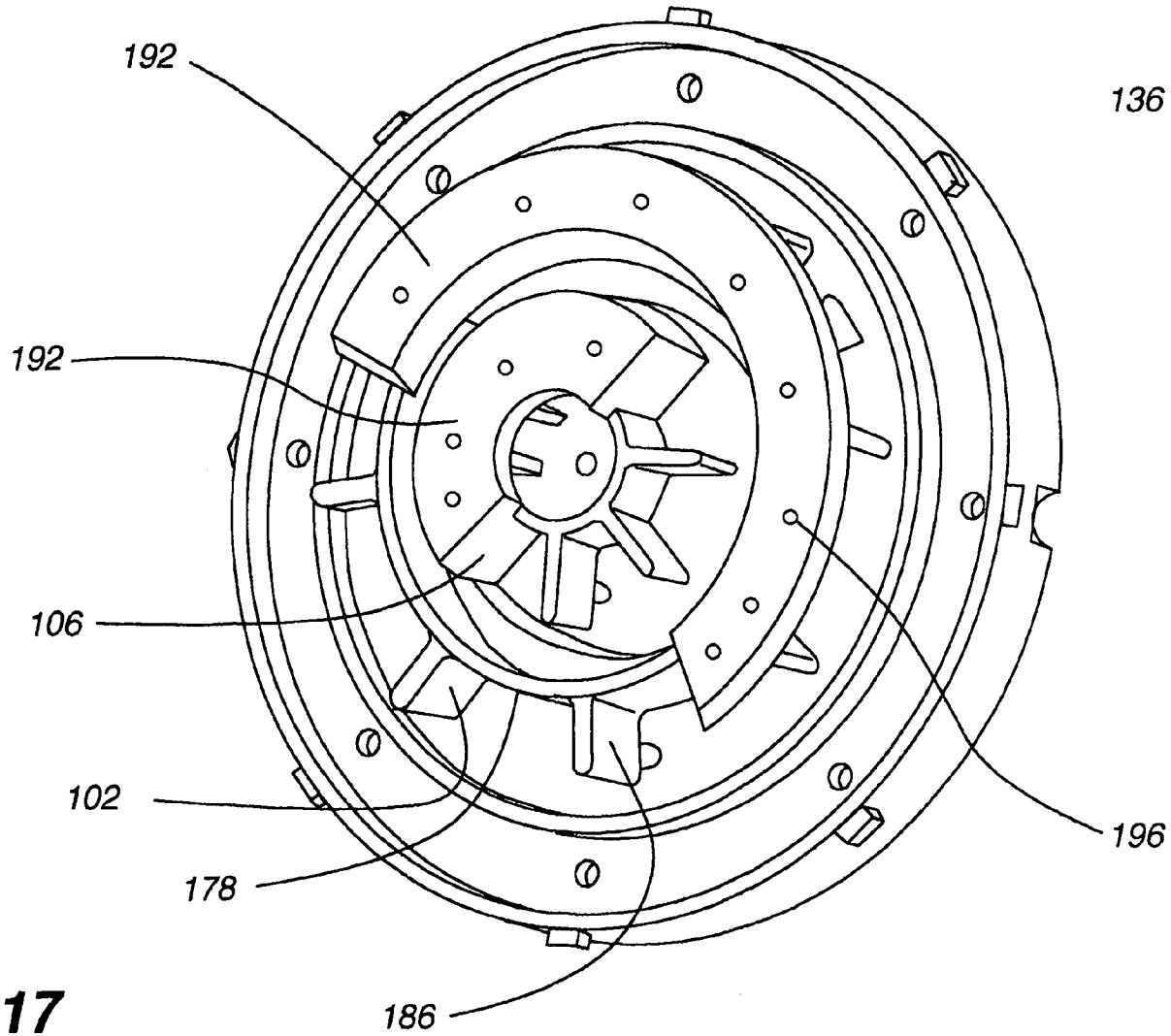
FIG. 17 depicts the front engine plate of FIG. 13 in isometric view.
Figure 18:
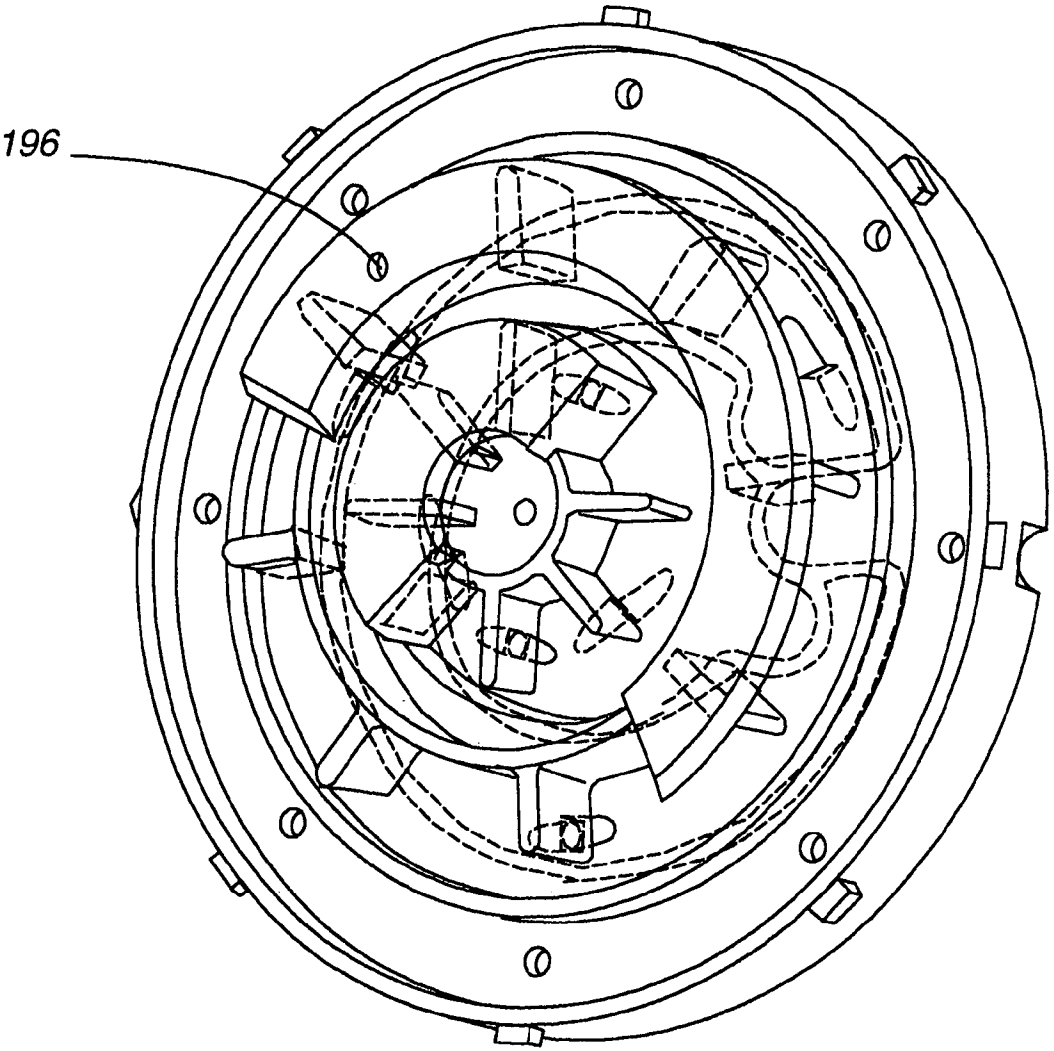
FIG. 18 depicts a wire-frame view of the front engine plate

FIGS. 17 and 18 show the shower head 100 with the faceplate removed to display the relative positioning of the turbines on the front of the front engine plate 134. FIG. 17 depicts the front engine plate in isometric view, while FIG. 18 depicts a wire-frame view of the front engine plate. The larger turbine 102 is mounted concentrically around the smaller turbine 106. Each of the turbines is constructed similarly, as described above. The turbine has a section that has an inner collar 178 with the turbine blades 186 extending radially outwardly therefrom. The collar is the same height as the blades. The other section of the turbine has a base plate 192 from which the blades extend upwardly, still oriented radially from the center of the circle formed by the turbine, but with no inner collar. The base plate has at least one aperture 196 in it to allow water to pass through and keep the turbine from being trapped in one position and not turn.

Figure 19:
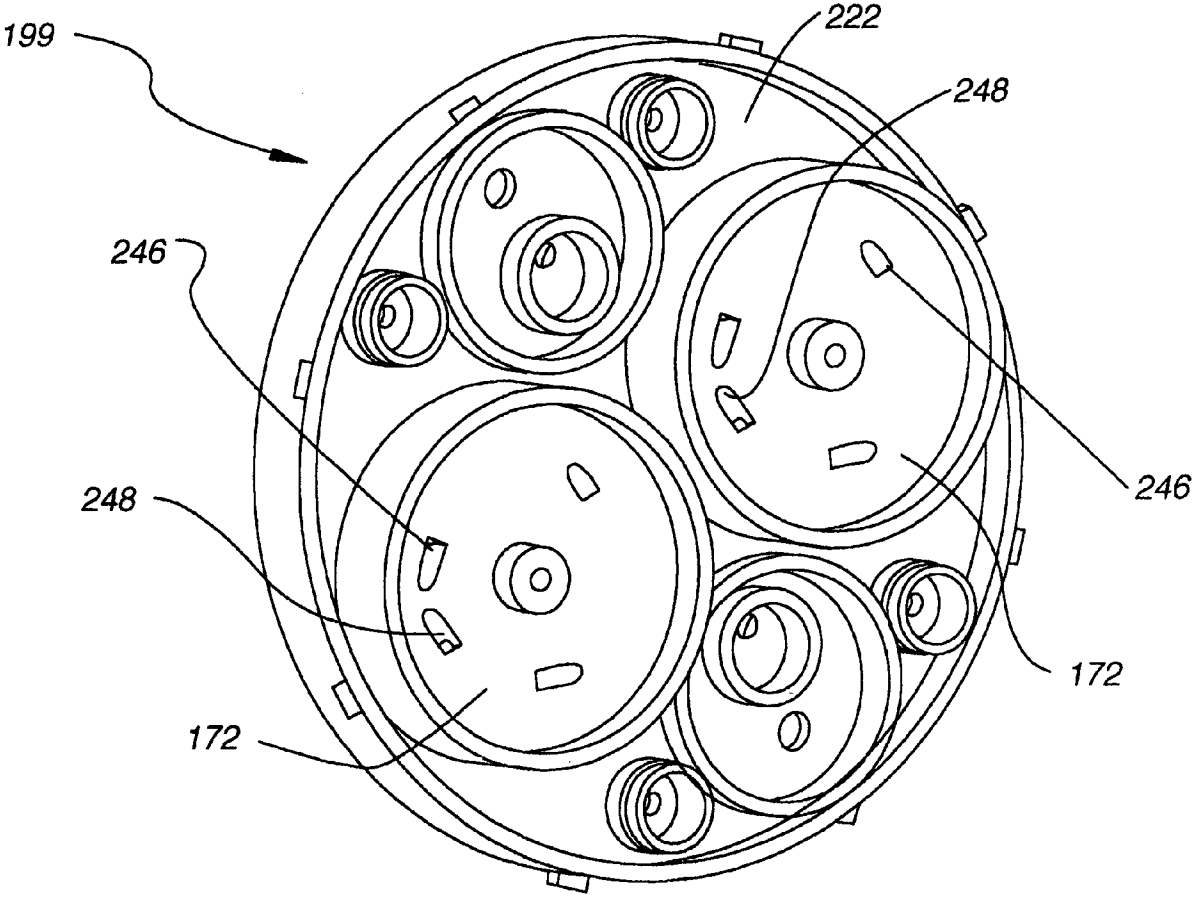
FIG. 19 depicts the front side of an front engine plate having side-by-side dual turbines.
Figure 20:
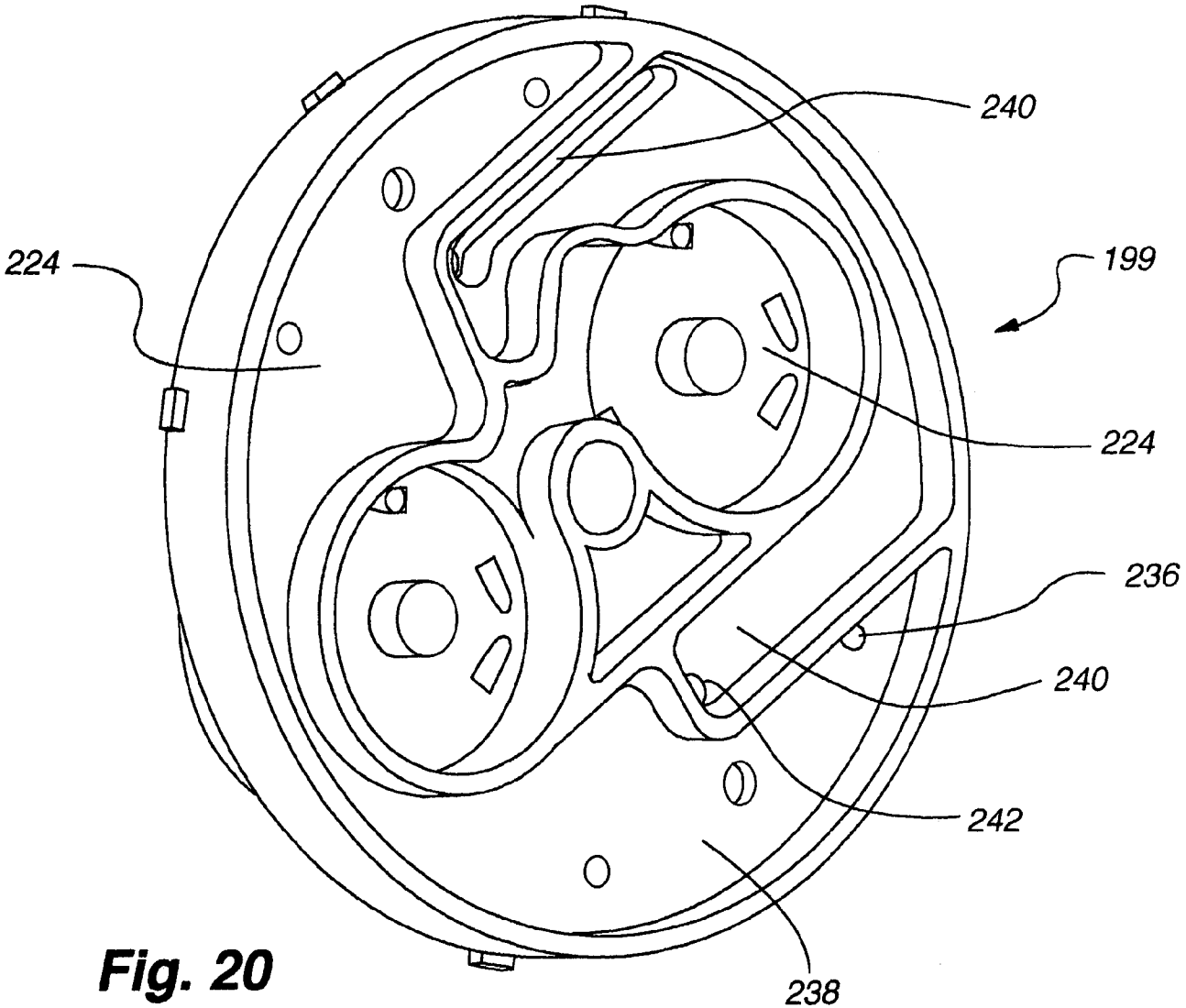
FIG. 20 depicts the rear side of the front engine plate of FIG. 19.
Figure 21:
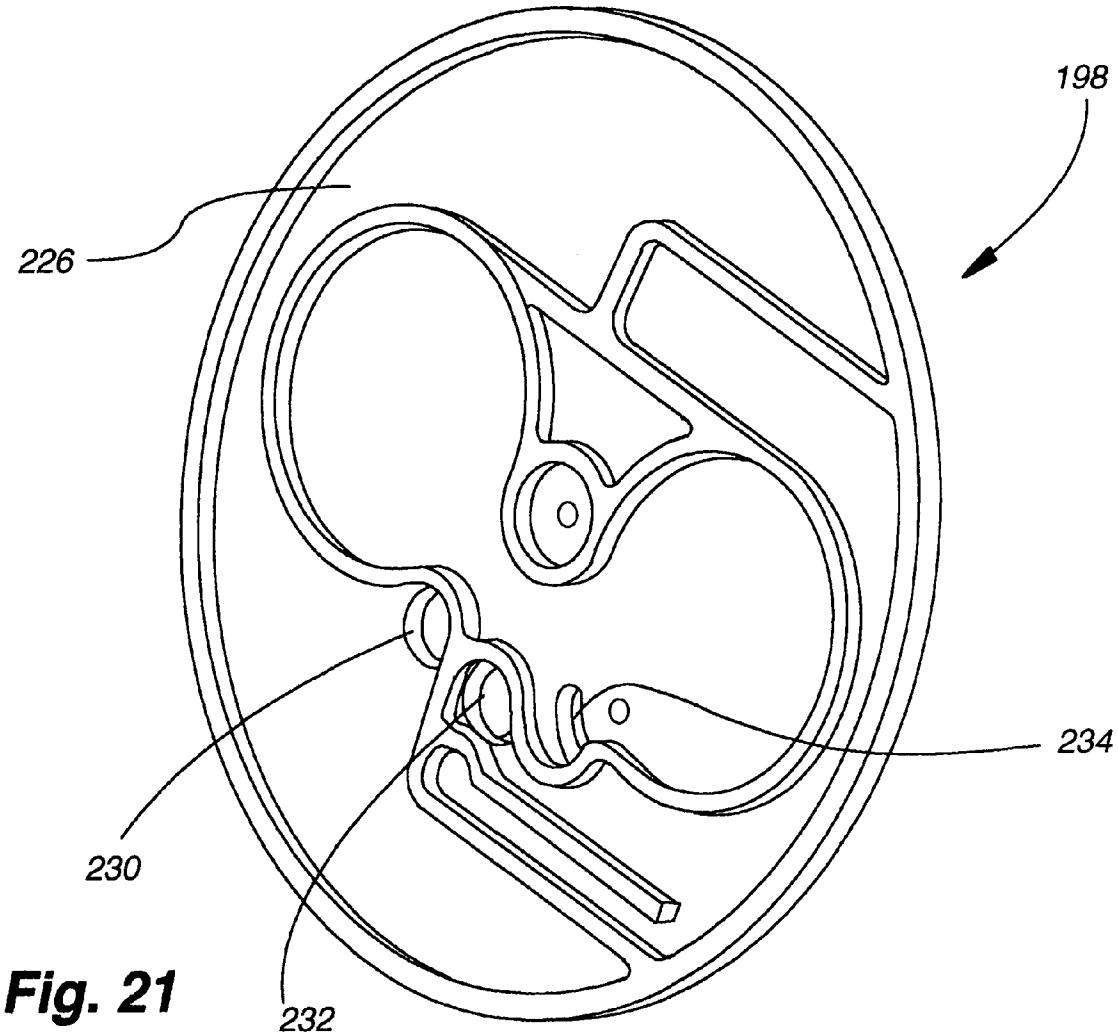
FIG. 21 depicts the front side of a back engine plate for use in an embodiment having side-by-side dual turbines.
Figure 22:
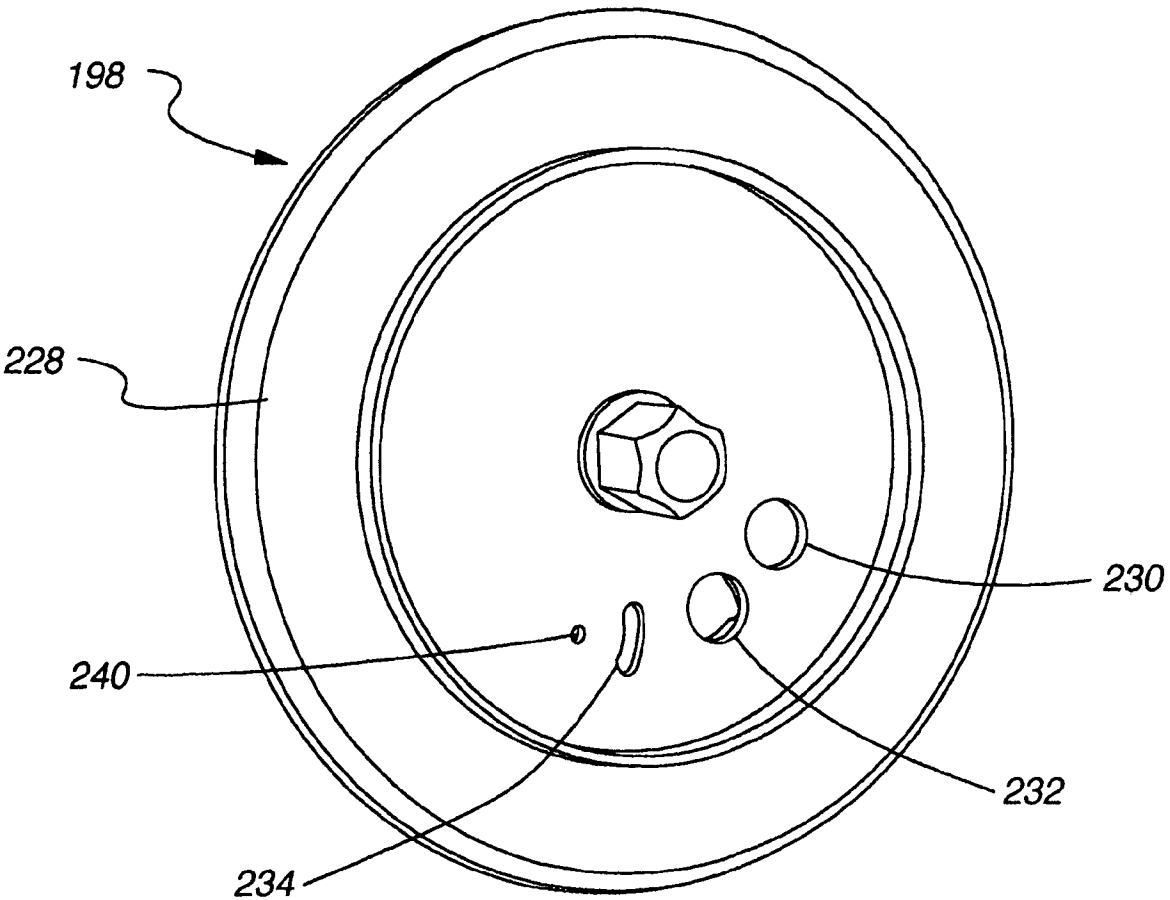
FIG. 22 depicts the rear side of the back engine plate of FIG. 21.

FIGS. 19–23 show the plate structure for the side-by-side dual turbine pulsating shower head 166. FIG. 19 is the front side 222 of the front engine plate 199. FIG. 20 is the rear side 224 of the front engine plate 199, which mates with the front side 226 of the rear engine plate 198 (shown in FIG. 21). FIG. 22 is the rear side 228 of the rear engine plate 198. The water flows through one of the three main holes 230, 232, 234, from the rear to the front of the rear engine plate 198 (note that the small hole is the pause hole 240, shown on FIG. 22, to allow some water through and not cause a dead-head in the water flow). The water flows through the hole selected by the mode selector (not shown), which is known in the art, and is a plate, controlled by an outside control ring, that has a sealed mode selector outlet aperture which fits over any one of the three apertures in plate two in order to direct the water flow into the selected mode. The mode selector rotates relative to the rear engine plate to orient the mode selector outlet hole (in the mode selector plate) over the desired mode selector inlet hole (in the rear engine plate). If the water flows through the hole 230 in the rear engine plate (FIG. 21), the water flows to the orifices 236 around the outer perimeter of the shower head in the prescribed channel 238 shown in FIG. 20. If the water flows through the hole 232 in the rear engine plate (see FIG. 21), the water flows to the channel 240 marked in FIG. 20 and to the apertures 242 formed laterally of the dual pulse apertures in the shower head. If the water flows through the hole 234 in the rear engine plate (see FIG. 21), the water flows to the channel 244 directing the flow to the two side-by-side turbines 170 (not shown in FIG. 20). In this embodiment, the two side-by-side turbines are activated at the same time. However, by rearranging the channels and holes accordingly on the plates, the two turbines can be made to operate separately.

FIG. 19 depicts three inlet jets 246 for both turbines, all of which are directed the same way to impinge on the flat, straight turbine blades and drive the turbine around the central hub (as described above). Alternate embodiments may use more or fewer inlet jets. This creates a high-speed pulsating spray. In this high-speed pulsating mode, water is supplied to the turbine via the three forward-facing inlet jets 246.

In FIG. 19, there is a fourth inlet 248 in each of the two turbine cavities 172, the fourth inlet jet 248 facing against the other three 246. This creates a low-speed pulsating spray. In this low-speed pulsating spray mode, water is supplied to the turbine via two forward-facing inlet jets 246, and also by a fourth, opposite facing inlet jet 248. This allows for the same volume water flow through the turbines in both high-speed and low-speed pulsating modes. Alternately, the turbines may be slowed by reducing water flow through the turbine channel, rather than providing backflow through an opposite-facing inlet jet 248. Such a solution, however, would reduce overall water output.

Figure 23:
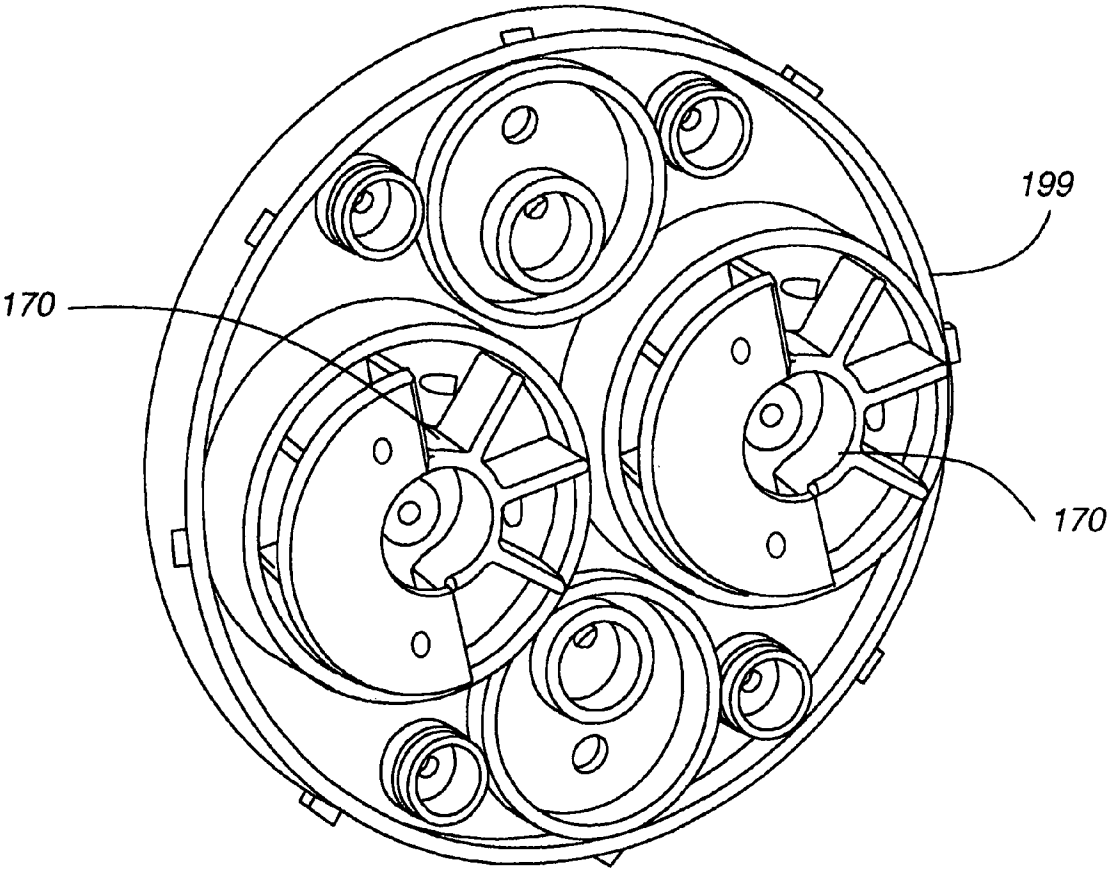
FIG. 23 depicts the third embodiment, with a faceplate removed.

FIG. 23 shows the shower head 166 with the front plate removed to display the relative positioning of the turbines 170 on the front of the outer spray ring 199. The turbines 170 are mounted side by side along a centerline of the head. Each of the turbines is constructed similarly, as described above. These two turbines can be driven by the inlet jets to turn the same way, or the opposite way, of one another. The holes formed on the bottom plate of the turbine can be positioned so as to not affect the blocking effect that it has and thus lessen the pulsating qualities.

In the dual-turbine pulsating spray shower heads described herein, where one of the modes additional to the pulsating mode is a mist mode, the shower head has a mist control feature to convert from the existing non-mist mode to mist mode and back to the same non-mist mode. The mist mode changer is controlled by a lever 248 extending from the shower head 166. The lever controls a rotating face valve 250 which diverts water flow to either the main mode controller or the mist apertures. When the face valve 250 is in a position to divert water to the mode controller, the mode controller is used to divert water between the various modes other than the mist mode, as is known. However, when the face valve is in a position to divert water to the mist apertures, the other modes are not operable. That is, the mode selector can be rotated, but because no water is flowing to the mode selector, the water stays diverted to the mist mode until the mist mode is turned off.

Figure 24:
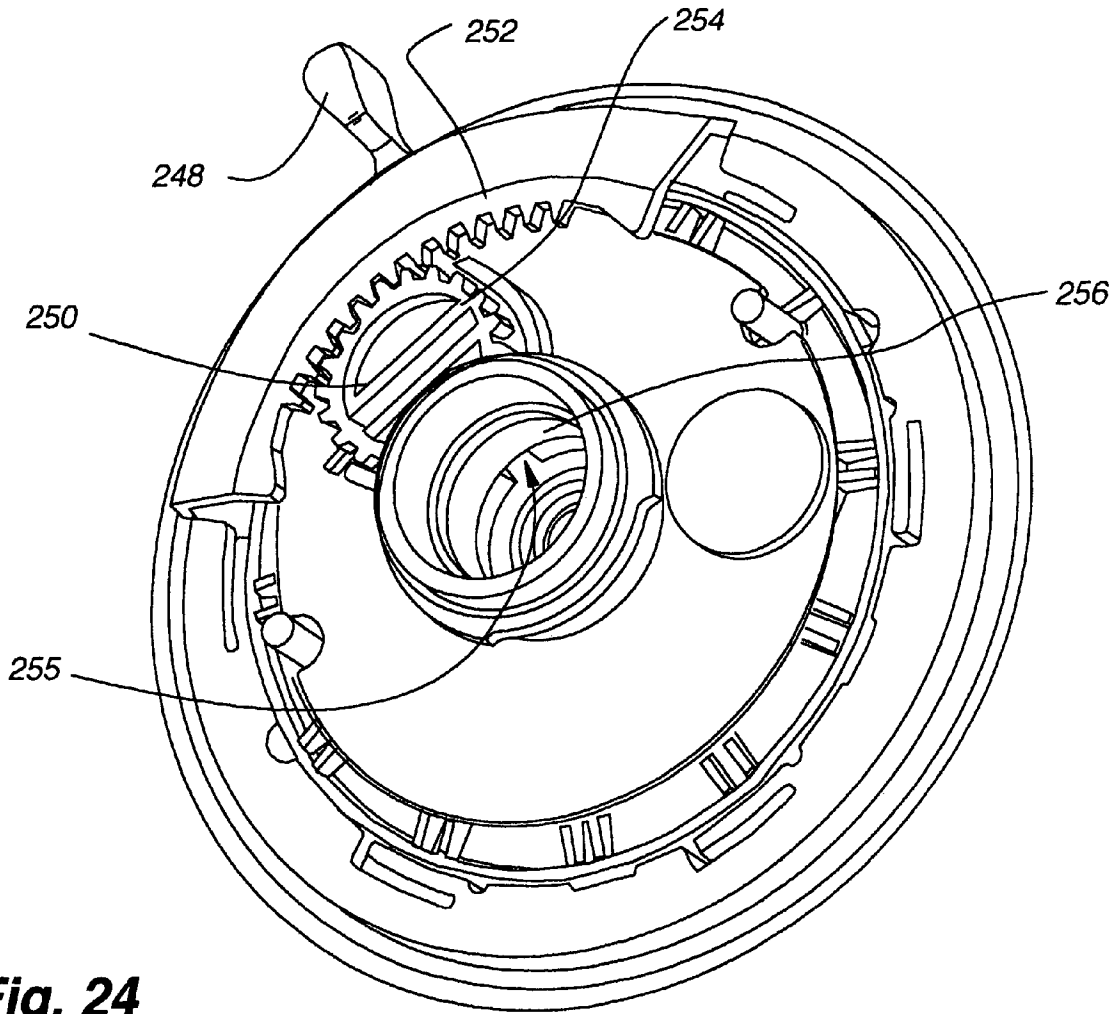
FIG. 24 depicts a face valve and lever.

Referring to FIG. 24, the lever 248 is attached to a rack 252, which in turn is connected to a pinion gear 254 formed on the outer circumference of the face valve. The water flows into the head from the shower pipe and into the main inlet aperture 255 in the back of the shower head. The water flows up a channel 256 to the face valve and face valve cavity.

Figure 25:
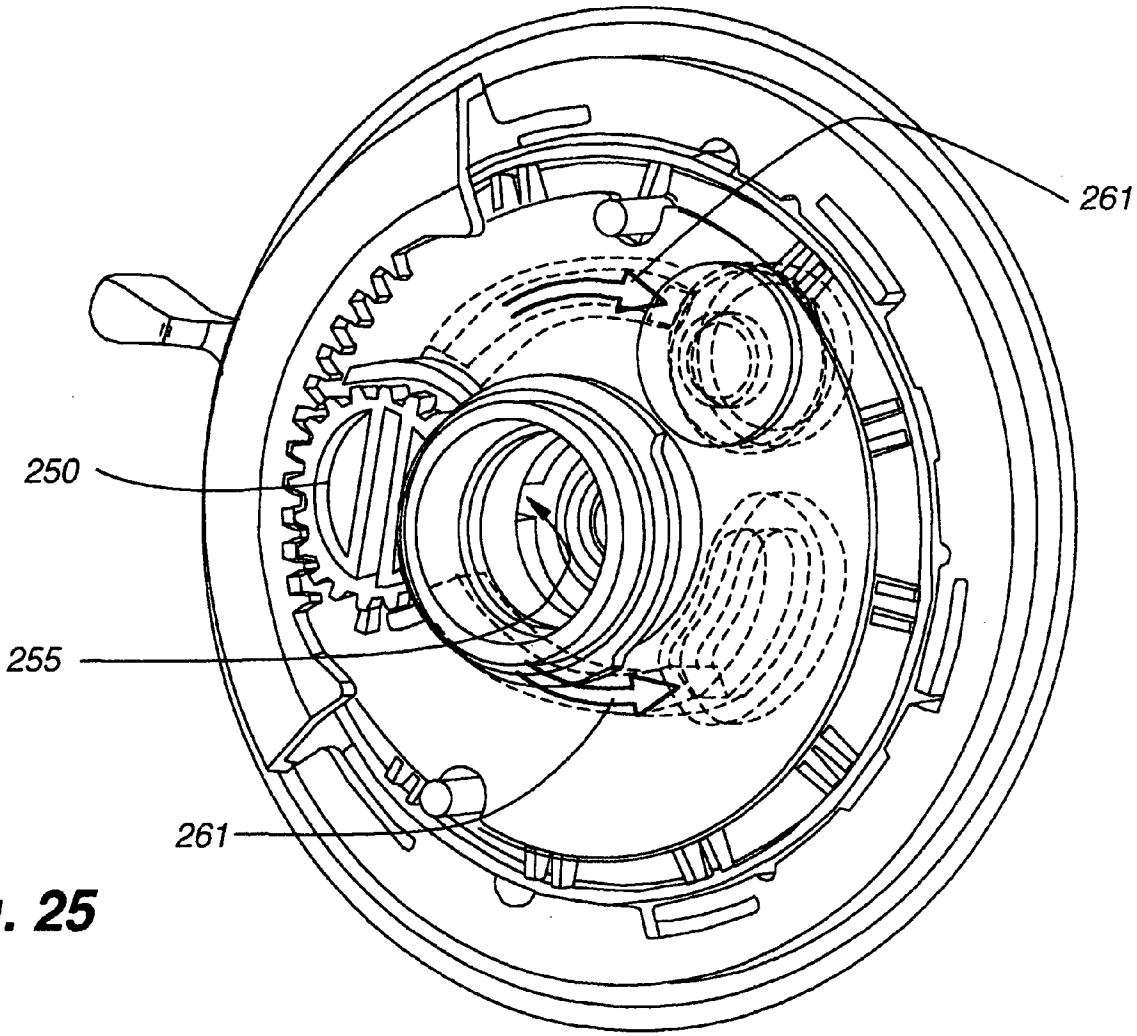
FIG. 25 depicts a wire-frame view of a mode selector, face valve, plate, and inlet pathway.
Figure 26:
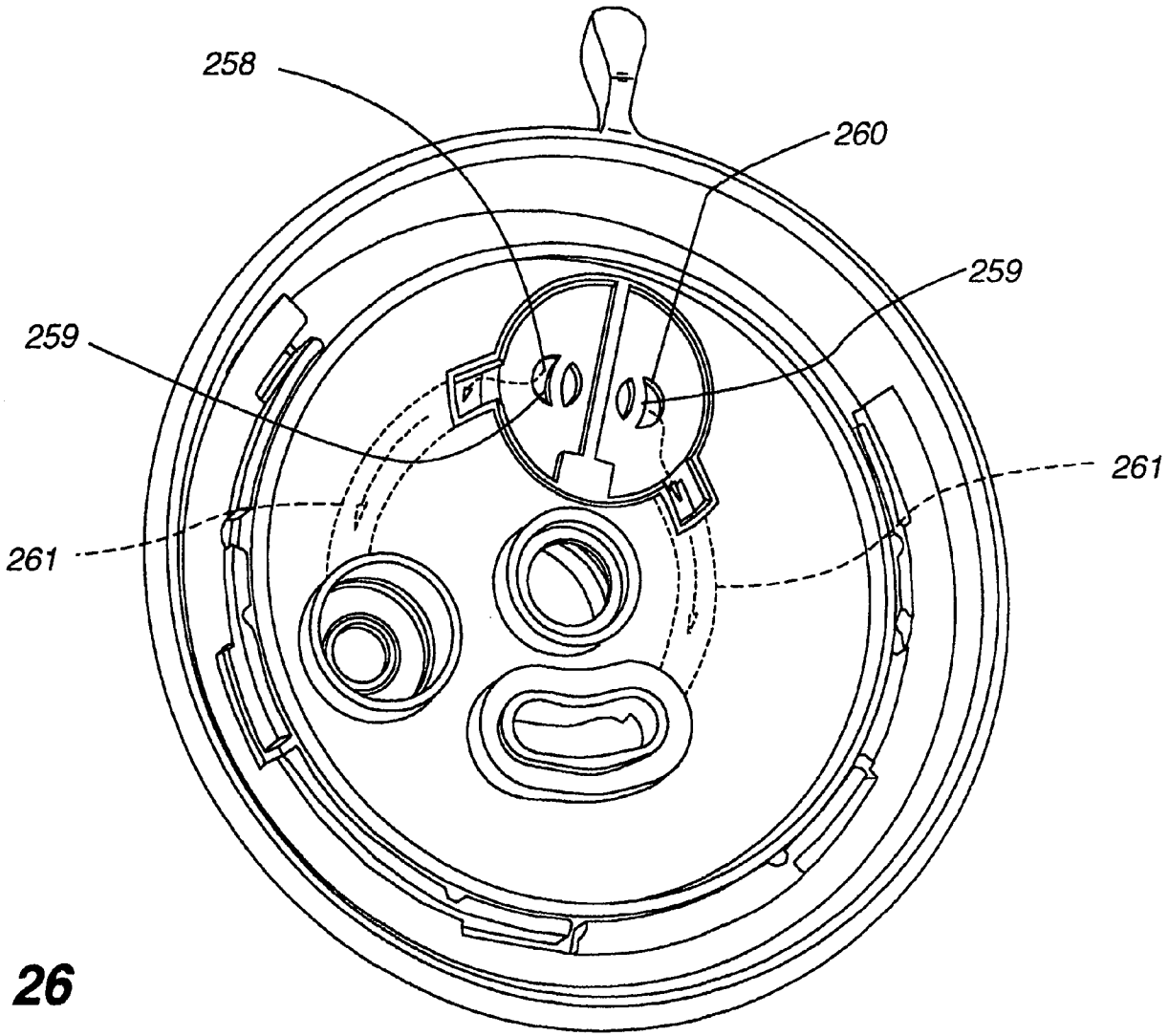
FIG. 26 depicts a mode selector, plate, and dual inlets.
Figure 27:
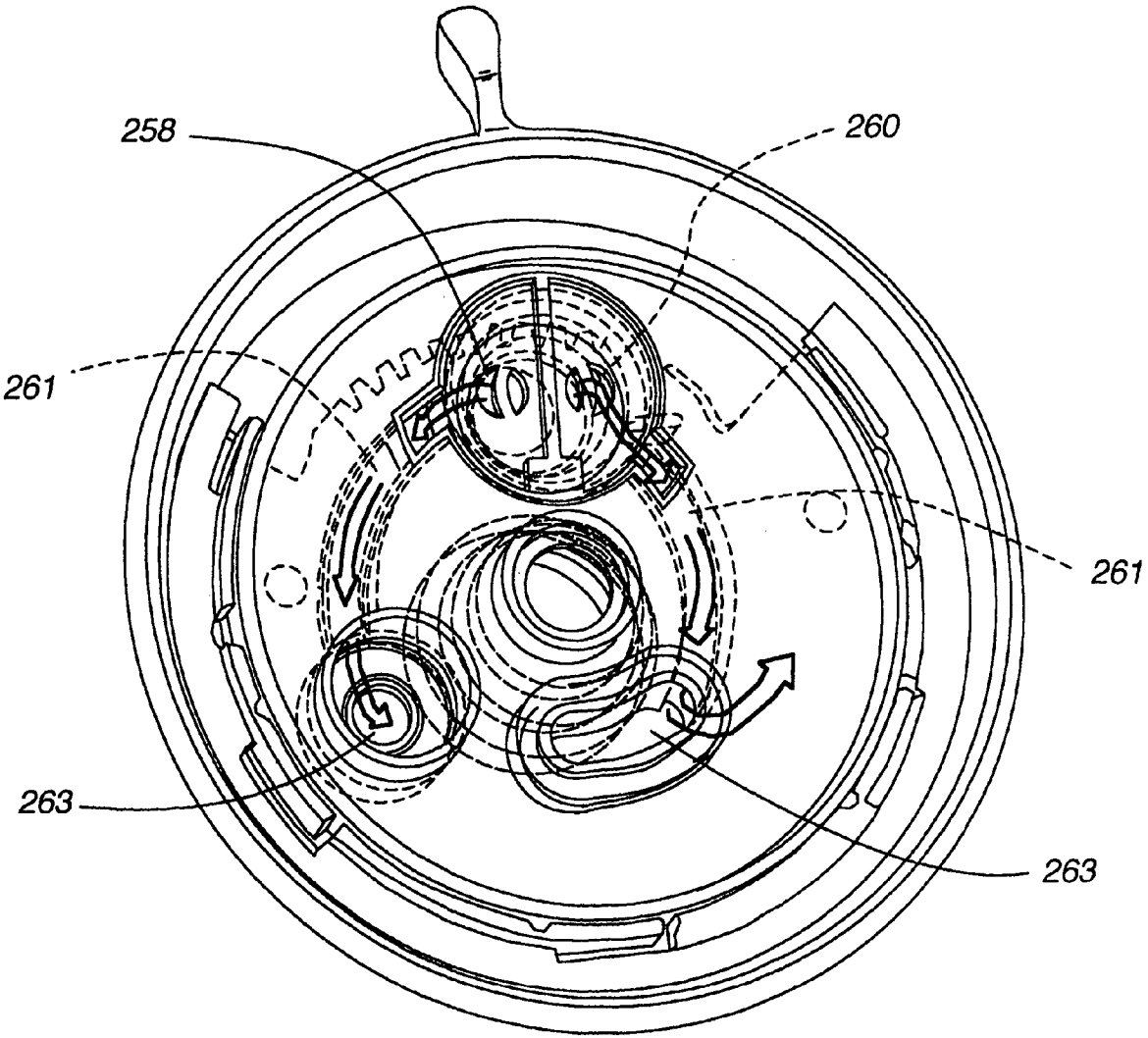
FIG. 27 depicts a wire-frame view of a mode selector, plate, and dual inlets.

The face valve rotates between the inlet to the mode selector 258 and the inlet to the mist mode 260. Each of these inlets 228, 260 has a brace 259 formed across the inlet so that the seal around the outlet aperture of the face valve (o-ring or the like, not shown) does not get caught in the relatively large inlet apertures and wear out quickly. The braces keep the seal from deflecting too far into the aperture, and thus keep the seal from being pinched or abraded. When the face valve 250 blocks water flow to the mist mode, then the water flows to the mode controller for further direction to the various modes (pulsating, regular, etc.). When the face valve 250 blocks water flow to the mode controller, then the water flows to the mist mode and not into the mode selector. The face valve typically moves from only the mode selector inlet aperture 258 to only the mist inlet aperture 260, with a short span of being in communication with both inlet apertures. This transition phase between both inlet apertures is designed to allow the user time to adjust water temperature between the standard mode and mist mode. Generally speaking, because of the fine size of the water droplets emanating from the embodiment while in mist mode, the mist mode water temperature feels cooler than the same water emanating from the embodiment in a shower spray mode. Accordingly, the time to adjust water temperature afforded by the transition phase may prevent burns from scalding water. FIGS. 25, 26, and 27 show the pathways 261 from the inlets, terminating in outlet apertures 263.

Another embodiment of the present invention may also employ multiple turbines to create multiple massage modes. In this embodiment, two turbines are employed to create a dual massage mode. Alternate embodiments may employ three or more turbines, and may create three or more massage modes. As with the previously described embodiment, the dual turbines may be positioned side-by-side or concentrically. The turbines may spin in the same direction or opposite directions. The turbines may be actuated in separate modes, together in the same mode, or both.

The present embodiment generally provides a variety of shower spray modes. These spray modes are achieved by channeling water from an inlet orifice affixed to a shower pipe, through one or more flow channels defined in a valve body, through a flow outlet and into a flow passage, through one or more inlet nozzles or apertures, into a backplate channel, optionally across one or more turbines, and out at least one nozzle formed in a faceplate. Turbines are only located in certain, specific backplate channels. The water flow through backplate channels associated with a turbine causes the turbine to rotate, which intermittently interrupts water flow to the nozzles associated with the specific backplate channel. This water flow interruption results in a pulsating spray. Routing of water flow is discussed in more detail below.

Figure 28:
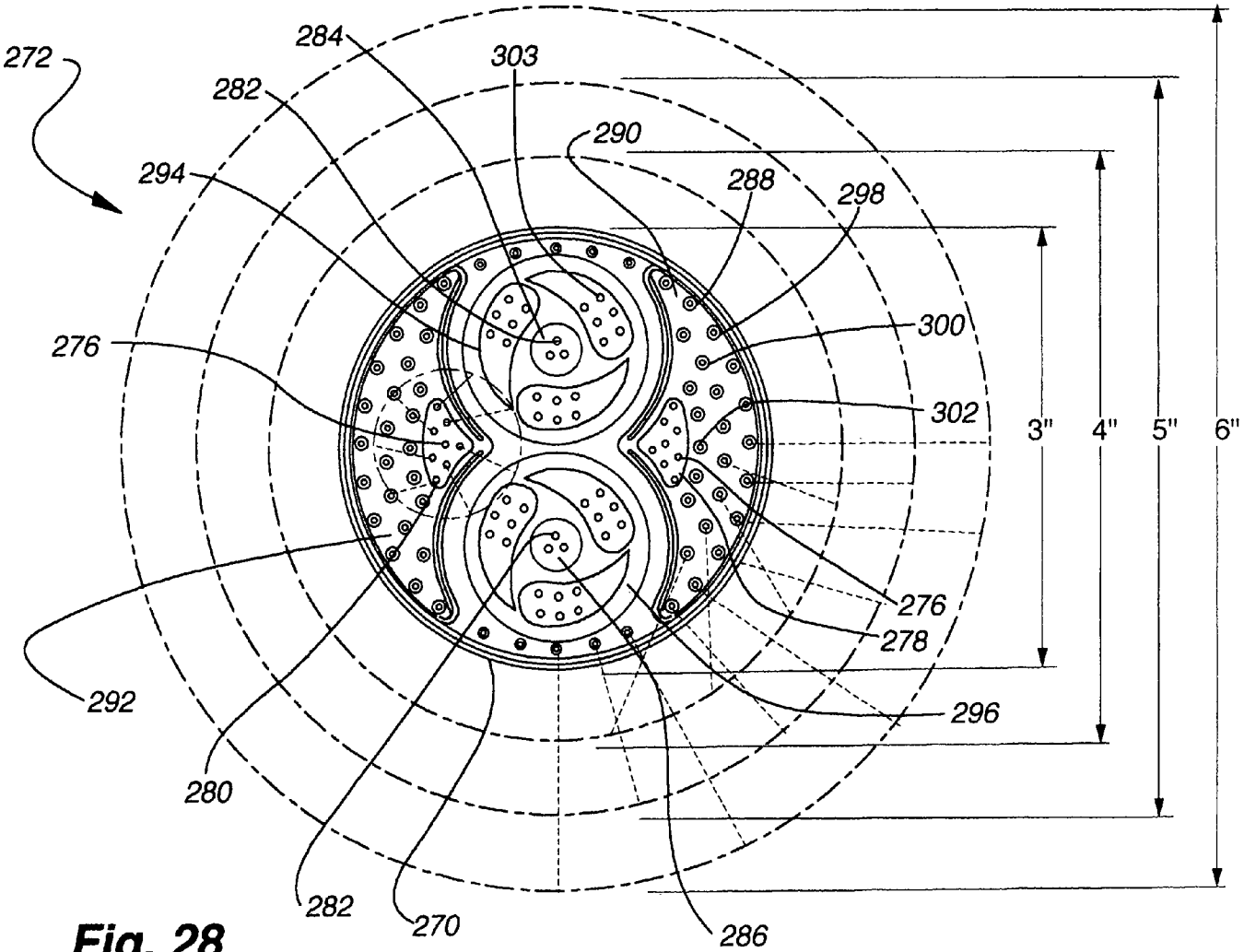
FIG. 28 depicts a front view of a fifth embodiment of the present invention, further depicting a plurality of spray patterns.

FIG. 28 depicts the faceplate 270 of a showerhead 272 corresponding to the present embodiment. Generally, the faceplate includes a plurality of nozzles 274 arranged into a variety of groups or forms. Each group of nozzles may be affected by a turbine to create a unique spray mode. Further, two or more groups of nozzles may be simultaneously active, thus combining spray modes. Activation of one or more groups of nozzles is generally achieved by turning the mode ring.

It should also be noted that each group of nozzles is generally mirrored about a horizontal or vertical axis by a corresponding group of nozzles. For example, and still with reference to FIG. 28, eight center spray nozzles 276 are generally arranged inside an inner triangular face 278 on the right-hand side of the faceplate 270. Eight corresponding center spray nozzles 276 are arranged in a mirror fashion in a second inner triangular face 280 on the left-hand side of the showerhead faceplate, as also shown in FIG. 28. Similarly, still with respect to FIG. 28, three inner massage nozzles 282 are arranged in a triangular pattern at the center of an inner circular plate 284 generally located in the top portion of the faceplate. A mirrored grouping of inner massage nozzles 282 is located in a second inner circular plate 286 generally positioned on the back of the faceplate, also shown in FIG. 28.

The various groups of nozzles may produce a variety of shower sprays. These shower sprays may, for example, create a circular spray pattern of different diameters for each nozzle group. In the present embodiment, the group of first body spray nozzles 288, positioned in the two outer triangular faces 290, 292 and extending outside the outer periphery of the first and second inner circular plates 294, 296, forms a circular spray pattern of approximately 6 inches in diameter when measured 18 inches outward from the faceplate. The group of first body spray nozzles 288 is typically angled such that individual drops or streams of water making up the first, 6 inch diameter shower spray are evenly spaced along the circumference of the spray. It should also be noted that the diameter of the shower spray generally increases with distance from the faceplate. Accordingly, the 6 inch diameter measurement of the first shower spray pattern applies only at the 18 inch distance from the faceplate previously mentioned. Alternate embodiments may increase or decrease the diameter of any of the spray patterns mentioned herein at any distance from the showerhead faceplate.

As shown in FIG. 28, the group of first body spray nozzles 288 includes only every other nozzle along the circumference of the faceplate. Alternating with the group of first body spray nozzles 288 is a group of second body spray nozzles 298. These second body spray nozzles 298 are generally angled to create a shower spray having a 5 inch diameter when measured 18 inches from the faceplate. Although the radial distance from the center of the faceplate is identical for the first and second groups of body spray nozzles, the spray patterns are varied by changing the angulation of the nozzle groups. Essentially, the group of second body spray nozzles is angled closer towards the center of the faceplate, thus creating a shower spray pattern having a smaller diameter.

A third group of body spray nozzles 300 is also located on the shower faceplate 270. This third group of spray nozzles generally sits inwardly (towards the center of the faceplate) from the first 288 and second 298 groups of nozzles, and is entirely contained within the two outer triangular faces 280, 292. The third group of body spray nozzles creates a shower spray pattern of approximately 4 inches in diameter at a distance of 18 inches from the faceplate. As with the first and second groups of nozzles, the third group of body spray nozzles creates a generally circular spray pattern, with each nozzle contributing a jet, stream, or drop of water spaced approximately equidistantly along the circumference of the spray pattern from adjacent jets, drops, or streams of water.

A fourth group of body spray nozzles 302 is also contained within the two outer triangular faces 290, 292. The nozzles in this fourth group are spaced inwardly (towards the center of the faceplate) from the third group of body spray nozzles. This fourth group of nozzles creates a spray pattern approximately 3 inches in diameter, when measured 18 inches outwardly from the faceplate.

In addition to the inner circular plates 294, 296 and outer triangular faces 290, 292, the faceplate also includes two inner triangular faces 278, 286. Each inner triangular face is generally located within an outer triangular face. Located inside each inner triangular face is a group of center spray nozzles 276. In the present embodiment, each inner triangular face includes 8 center spray nozzles.

The two groups of center spray nozzles 276 (one in each inner triangular face) do not cooperate to form a single shower spray pattern. Rather, each group of center spray nozzles creates a separate circular shower spray pattern. Thus, when the two groups of center spray nozzles are activated, two substantially identical spray patterns are formed substantially adjacent one another. These center spray patterns are approximately 1 inch in diameter each when measured 18 inches outward from the faceplate, and may overlap either at the 18 inch measuring point, prior to this point, or after this point. Further, the center sprays are generally orthogonal from the pulsing sprays emitted from the groups of massage nozzles.

The groups of massage nozzles 303 shown in FIG. 28, may each emit a pulsating spray. The pulsation speed of such sprays may vary, and may be selected by turning the mode ring. Generally, and as described in more detail below with reference to FIG. 49, the pulsating spray (and pulsation speed) is controlled by the rotation of one or more turbines 304. The turbines include a series of vanes 306 upon which water flow impacts, imparting rotational energy to the turbines. A shield 308 extends across a portion of the turbines. The shield momentarily blocks one or more of the massage nozzles; as the turbine rotates, the massage nozzles blocked by the shield vary. The blocking of nozzles momentarily interrupts water flow through these nozzles, creating the aforementioned pulsating spray.

While each group of nozzles has been described as creating a separate spray pattern, the present embodiment may activate multiple groups of nozzles simultaneously. For example, all the foregoing nozzle groups may be simultaneously activated, resulting in a combination spray mode. In this combination mode, all the aforementioned spray patterns are formed (i.e., six separate spray patterns are simultaneously active). Generally, the water pressure of the water flow through the embodiment is sufficient to maintain all spray patterns simultaneously. Alternate embodiments may permit the activation of any combination of the aforementioned spray patterns.

Although the diameters of each spray pattern have been given at a distance of 18 inches from the faceplate, it should be noted that the spray patterns may maintain their form at any distance up to approximately 24 inches or more from the showerhead. In the present embodiment, the optimum range for the formation of spray pattern is generally from 12 to 24 inches. After a distance of 24 inches from the faceplate, the spray pattern tends to dissipate. Alternate embodiments may vary this optimum range.

Figure 29:
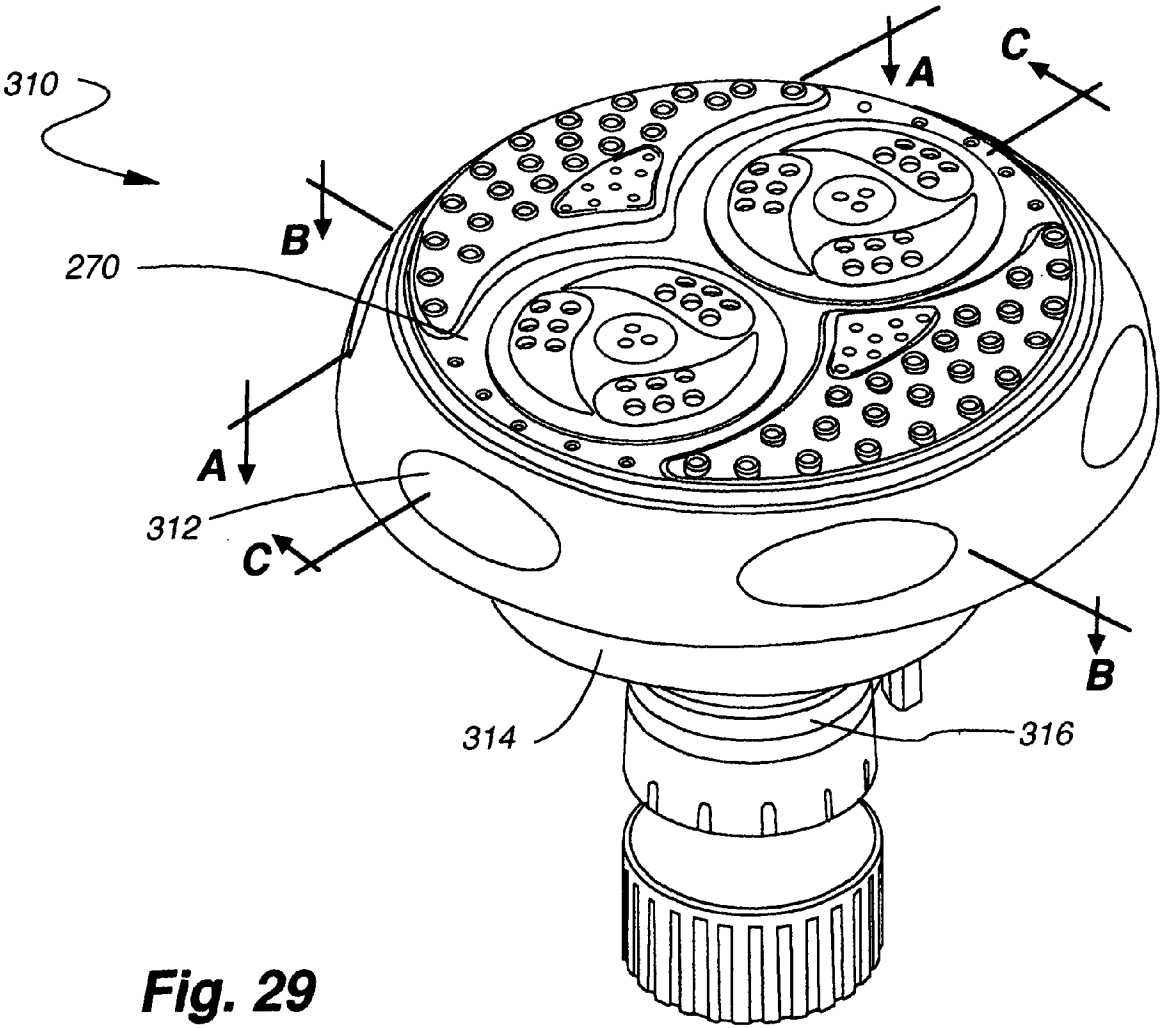
FIG. 29 depicts a perspective view of the fifth embodiment of the present invention.

FIG. 29 shows a perspective view of the present embodiment of a dual massage showerhead 310. In addition to the faceplate 270, the mode ring 312, base cone 314, and a portion of the connection structure 316 may be seen.

Figure 30:
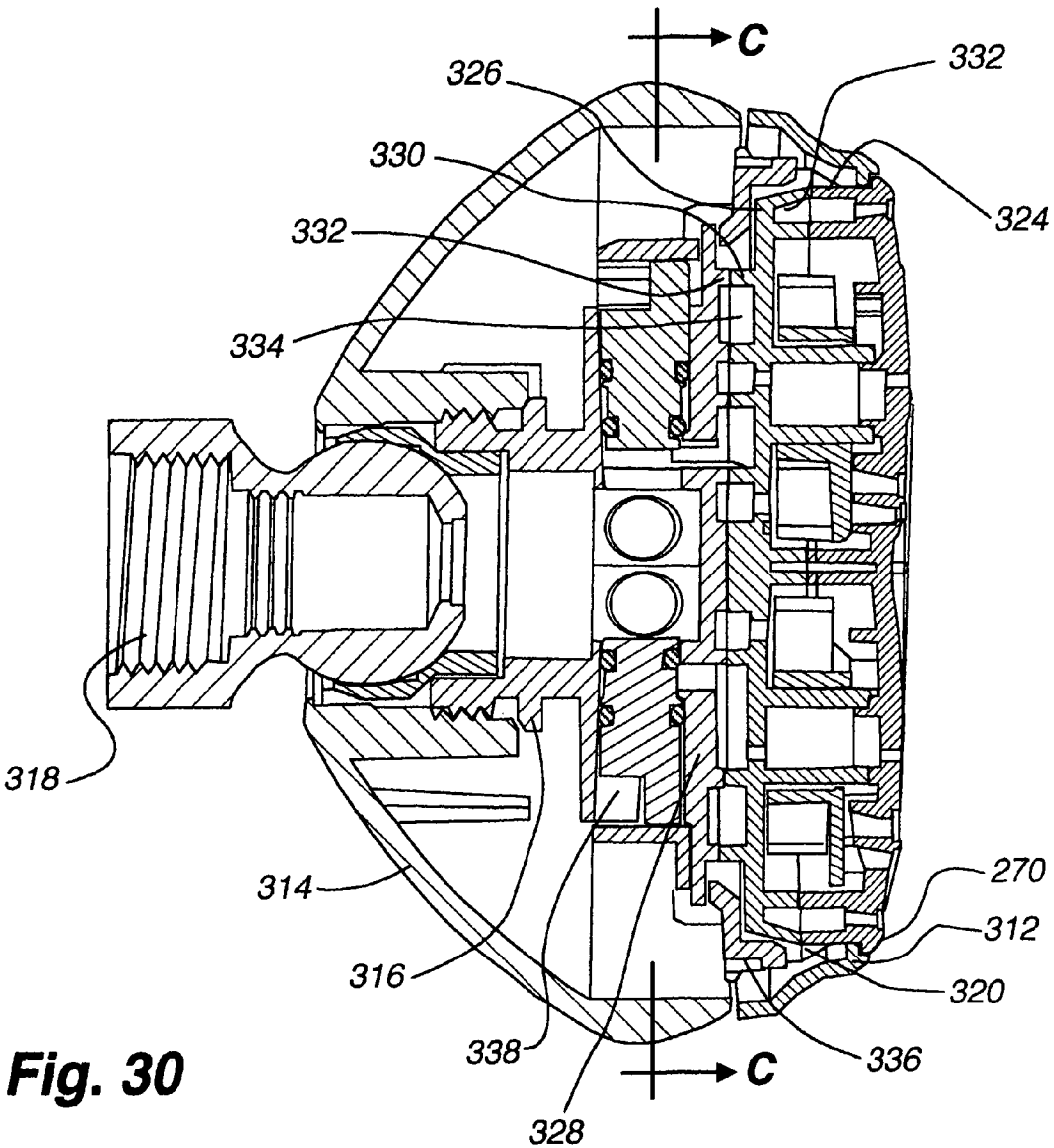
FIG. 30 depicts a cross-sectional view of the fifth embodiment, taken along line A—A of FIG. 29.

FIG. 30 is a cross-section view of the present embodiment, taken along line A—A of FIG. 29. Generally, FIG. 30 shows the relationship between and positioning of various elements of the present embodiment. For example, the faceplate 270 is located at one end of the embodiment, generally opposite a shower pipe connector 318. Located partially beneath and adjacent to the faceplate is a mode ring 312. The mode ring freely rotates about the stationary faceplate.

The back side of the faceplate 270 is connected to the front side of a backplate 370. Backplate channels 372 are defined by sidewalls 324, 326 extending from the back side of the faceplate 270 and front side of the backplate 320, generally abutting one another. A turbine 304 may be positioned in any of the backplate channels 322. The sidewalls 324, 326 extending from the back side of the faceplate 270 and the front side of the backplate 320 may be sonically welded, heat welded, or chemically bonded to one another (or otherwise affixed to one another) to affix the faceplate to the backplate.

The back side of the backplate is connected to the front side of a valve body 328. Sidewalls 330 extend from the back side of the backplate 320 and abut matching sidewalls 332 extending from the front side of the valve body 328, to define one or more flow passages 334. The sidewalls extending from the back side of the backplate and front side of the valve body may be sonically welded, or otherwise affixed to, one another to affix the backplate to the valve body.

A connector structure 316 extends rearwardly from the valve body and engages a similar, mating structure formed on a base cone 314. In the present embodiment, the connector structure and base cone are threadedly attached to one another, although in alternate embodiments they may be affixed through sonic welding, heat welding, or an adhesive.

The mode ring 312 may be freely turned to vary the shower spray patterns when the embodiment is active. The mode ring engages an actuator ring 336, which lies at least partially within the mode ring 312 and beneath the faceplate 270. As the mode ring is rotated, the actuator ring also turns. The actuator ring generally controls the opening and closing of one or more flow channels 334 within a valve body located directly adjacent to the actuator ring. More specifically, one or more plungers 338 may move radially inwardly towards the longitudinal axis (or center) of the present embodiment or radially outwardly away from the longitudinal axis (or center) of the present embodiment as the actuator ring turns. In the present embodiment, a flow channel 334 is closed when the associated plunger 338 is seated in a radially inward position, i.e., is move towards the center of the embodiment. The inward radial movement of a plunger is controlled by one or more actuator ramps, described in more detail below with reference to FIGS. 34–36.

As the plunger 338 moves radially outwardly away from the embodiment's longitudinal axis, a corresponding flow channel 334 is opened through the valve. This permits water to flow through the valve, along the opened channel, and through at least one passage defined by one side of the valve end on adjacent backplate. Generally, the outward motion of a plunger is caused by water pressure exerting force on the portion of the plunger closest to the center of the valve, as described in more detail below. Presuming the plunger is properly aligned with an appropriate actuation point defined on the actuator ring, the water pressure forces the plunger along the flow channel until a flow outlet is exposed. The actuation points, flow channels, and flow outlets are described in more detail below.

Each flow channel 334 permits water to be fed to one or more groups of nozzles. Accordingly, as the mode 312 and actuator 336 ring turns, different plungers 338 move outwardly and inwardly, thus opening or closing different flow channels. In turn, the flow channels permit water to flow to different groups of nozzles. In this manner, a operator may select which groups of nozzles are active at any given moment by turning the mode ring. The operation of the actuator ring, backplate, valve body, and plungers is described in more detail below.

A connector structure 316 typically affixes the valve body 328 to the shower plate connector. The connector structure 316 generally is only in direct contact with the valve body 328, a portion of the shower pipe connector, and possibly a base cone or other covering. As shown in FIG. 30, interlocking teeth, grooves, or flanges may secure the connector structure to a base cone 314. The base cone, in turn, generally covers the various internal components mentioned herein and provides an aesthetic finish. The connector body 316 may be formed unitarily with (and thus as an extension of) the valve body 328, as shown in more detail in FIG. 31.

Figure 31:
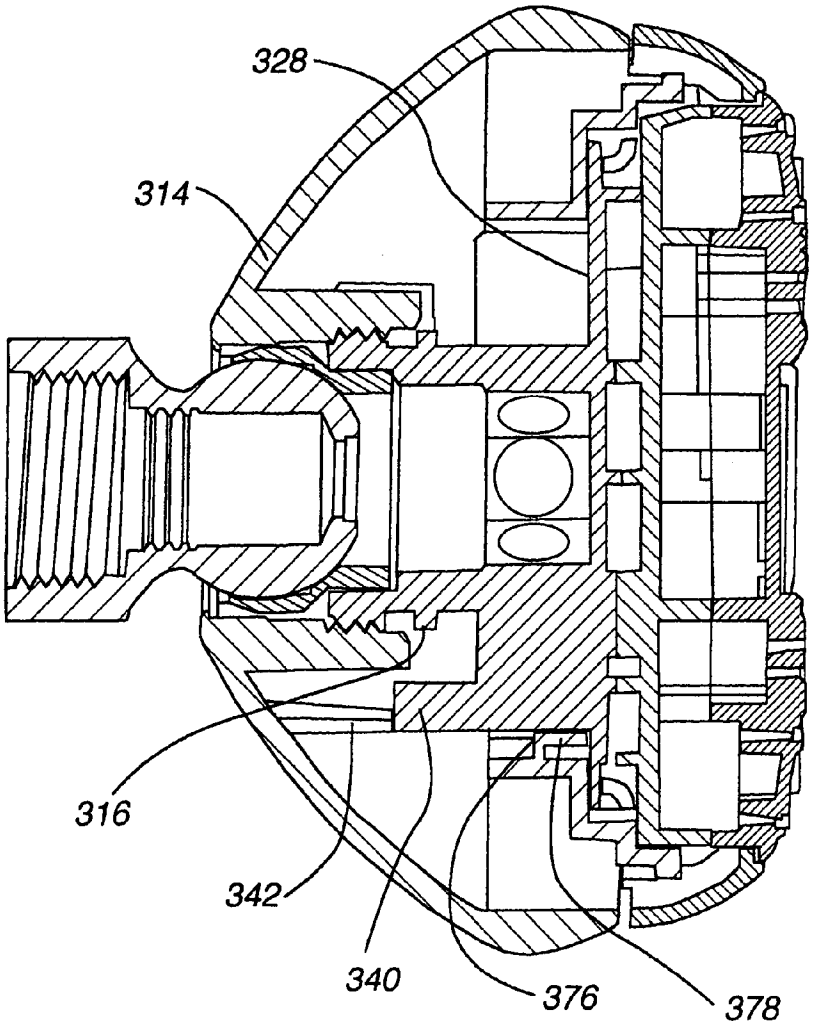
FIG. 31 depicts another cross-sectional view of the fifth embodiment, taken along line B—B of FIG. 29.

FIG. 31 shows a cross-section of the present embodiment, taken along line B—B of FIG. 30. Generally, FIG. 31 depicts the same internal elements as shown in FIG. 30, albeit in a cross-section perpendicular to that shown in FIG. 30.

FIG. 31 depicts the connection structure 316 extending downwardly from the valve body 328. Additionally, FIG. 31 depicts an anti-rotation 340 structure extending downwardly from the valve body. This anti-rotation structure generally prevents the valve from turning as the mode 312 and actuator ring 336 rotate. The anti-rotation structure 340 may, for example, be received in a corresponding cavity formed on the base cone 314. Alternately, and as shown in FIG. 31, the anti-rotation structure may be seated between multiple prongs 342 extending from the base cone 314. These prongs generally abut the side of the anti-rotation structure and resist rotational movement. Thus, as the mode and actuator ring revolve, the anti-rotation structure of the valve abuts a prong which forces the valve to remain stationary. Thus, the actuator ring slides across the top and side of the valve body without rotating the valve body itself.

Figure 32:
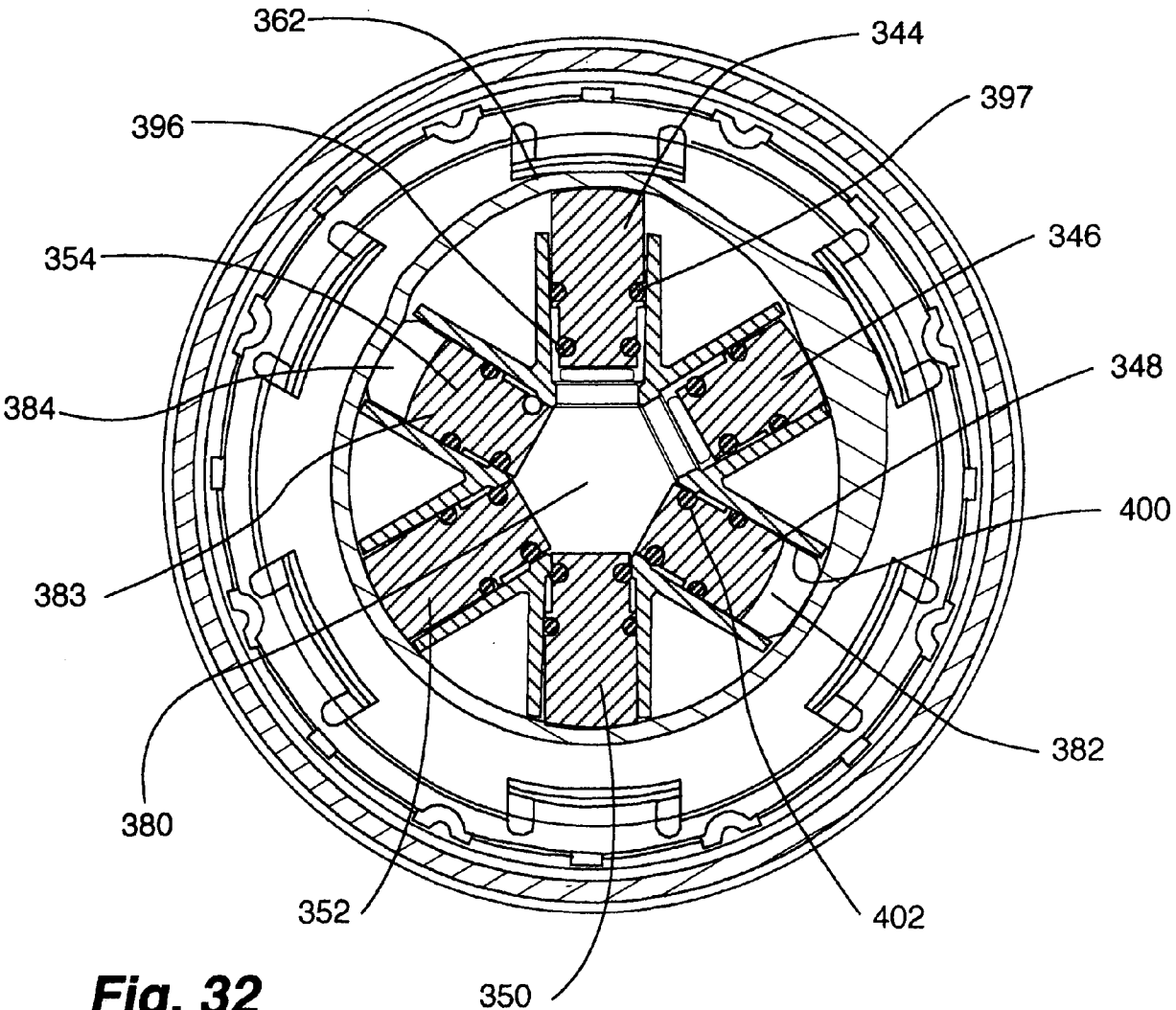
FIG. 32 depicts a third cross-sectional view of the fifth embodiment, taken along line C—C of FIG. 29.

FIG. 32 depicts a lateral cross-section of the present embodiment, taken along line C—C of FIG. 30. In this cross-section, the actuator ring 336, valve 328, and plungers 344, 346, 348, 350, 352, 354 are shown.

Typically, the actuator ring 336 is affixed to the mode ring 312 by one or more pins 356. These pins fit in recesses along the exterior of the actuator. Generally, the pins 356 are sonically welded, heat welded, or chemically bonded (for example, by an adhesive) to both the mode ring and actuator. Alternate embodiments may directly connect the mode and actuator, for example by means of sonic or heat welding.

Various elements may be sonically welded to one another, such as the backplate and faceplate, both discussed below.

Figure 34:
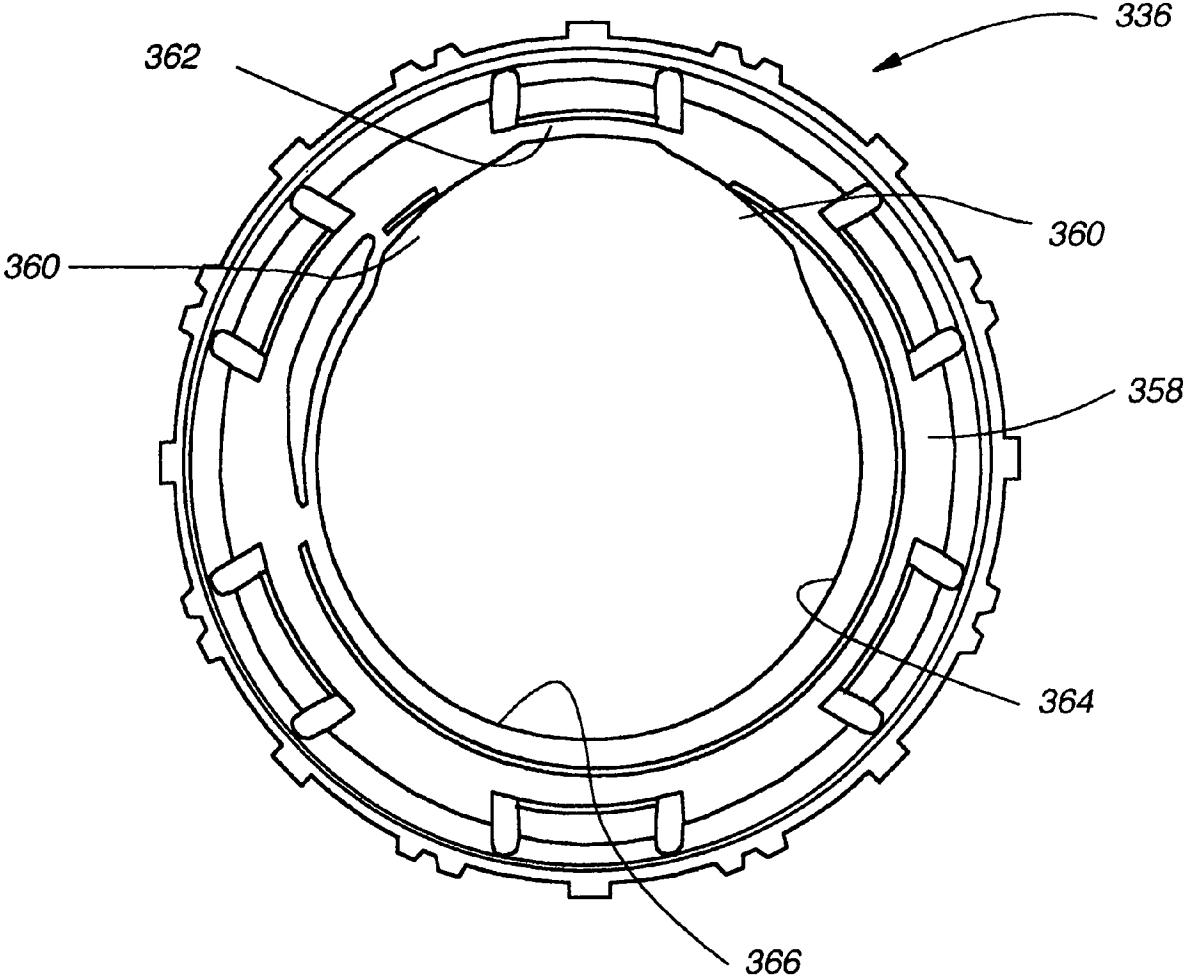
FIG. 34 depicts a front view of an actuator ring.
Figure 35:
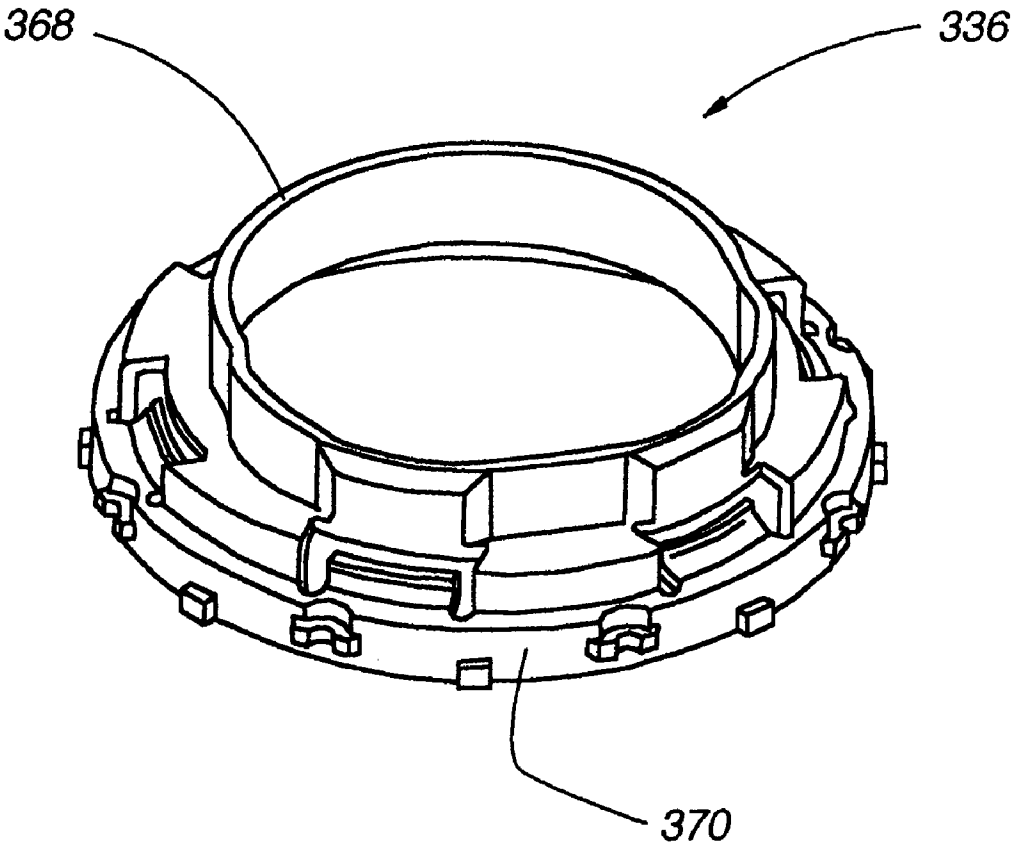
FIG. 35 depicts an isometric view of the actuator ring of FIG. 34.
Figure 36:
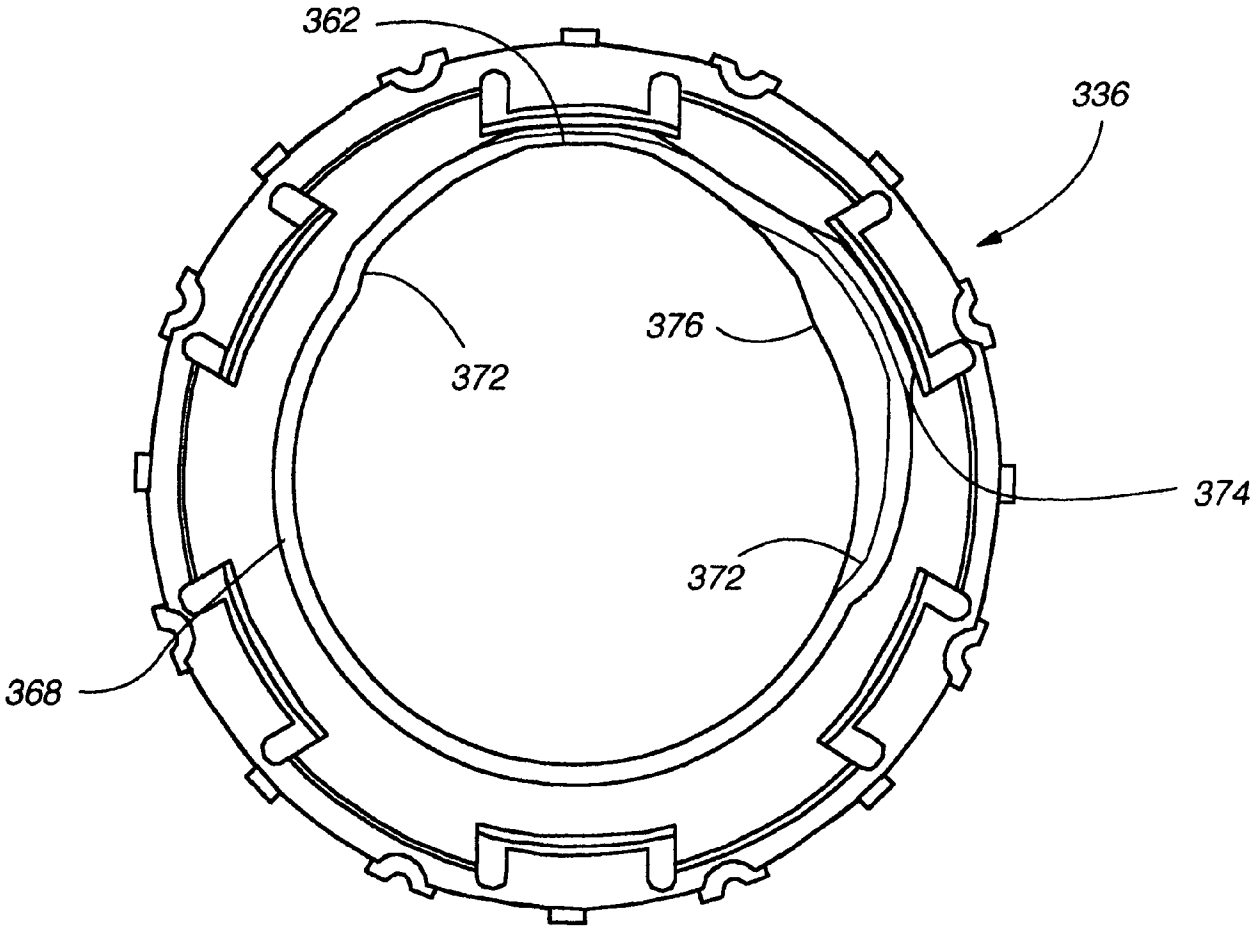
FIG. 36 depicts a rear view of the actuator ring of FIG. 34.

The actuator ring 336 is shown in more detail in FIGS. 34 through 36. FIG. 34 depicts the front of the actuator ring. FIG. 35 is an isometric view of the actuator ring. Similarly, FIG. 36 is a rear view of the actuator ring.

In the present embodiment, the sidewalls 358 of the actuator ring define an interior circular shape having one or more ramps 360 extending therefrom. These ramps terminate in an actuation point 362. For example, FIG. 34 depicts two upper ramps leading to an upper actuation point. As can also be seen, the inner, generally circular surface 364 of the actuator ring is formed from a series of flat, planar segments 360. Similarly, the upper ramp and upper actuation points are also formed from such planar segments. In alternate embodiments, the inner circle, ramps, and actuation points of the actuation ring may not be formed from planar segments. For example, smooth curves could define any or all of these.

The upper ramps 360 extend generally outwardly from the center of the actuator ring and define a depression or cavity of a greater radius than the interior circular ring 364 of the actuator 336. The upper ramps 360 terminate at the aforementioned upper actuation point 362. The distance between the upper actuation point and the center of the actuator ring is generally greater than the distance between the center of the actuator ring and the sidewalls of the inner ring or the upper ramps.

As can be seen in FIGS. 35 and 36, a collar 368 extends downwardly from the main body 370 of the actuator ring 336. With specific reference to FIG. 36, this collar generally follows the contour of the previously mentioned inner ring with one exception. At one point along the collar's circumference, the collar extends to form a pair of lower ramps 372 terminating in a lower actuation point 374. The distance from the center of the actuator ring 336 to the lower actuation point 374 is generally equal to the distance from the actuator ring center to the upper actuation point. Unlike the upper actuation point 362, which extends vertically along the entire length of the collar, the height of the lower actuation point is bounded by a ledge 376. The ledge extends from the inner sidewall of the collar 368 toward the center of the actuator ring 336. An inner actuator wall 378 extends generally upwardly from the innermost portion of the ledge. FIG. 31 depicts the collar 368, ledge 376, and inner actuator wall 378 of the actuator ring 336 in cross-section. As shown in FIG. 31, the height of the lower actuation point 374 is approximately half the height of the collar. By contrast, the height of the upper actuation point 362 is typically equal to the collar height. In other words, while the ledge limits the height of the lower actuation point, it does not impact the height of the upper actuation point.

Returning to FIG. 32, the inner plate of the actuator ring 336, valve 328, and plungers 344, 346, 348, 350, 352, 354 may be seen. Recalling that FIG. 32 depicts a lateral cross-section through the actuator ring and valve body, it may be seen that a first plunger 344 is recessed from the center 380 of the valve. The outer end of the first plunger rests against the upper actuation point 362. Similarly, a second plunger 346 is also recessed from the center of the valve. Although not visible in FIG. 32, the outer end of the second plunger rests against the lower actuation point (also not shown). By contrast, the third 348, fourth 350, fifth 352 and sixth 354 plungers are seated with the inner ends of the plungers flush against the hexagonally-shaped valve center 380.

When the plungers are positioned radially outwardly from the valve center (as is the case with the first and second plungers), water may flow through a corresponding hole in the valve center (hole not shown) and through the flow channel opened by the recessed plunger. Generally, plungers extend radially outwardly when aligned with an appropriate actuation point. The alignment of plunger and appropriate actuation point permits water pressure (generated by water flow through the shower connector and into the valve center) to depress the plunger. Effectively, the water pressure acts to force a plunger radially outwardly against an actuation point, thus opening the flow channel for the water's continued flow.

Figure 33:
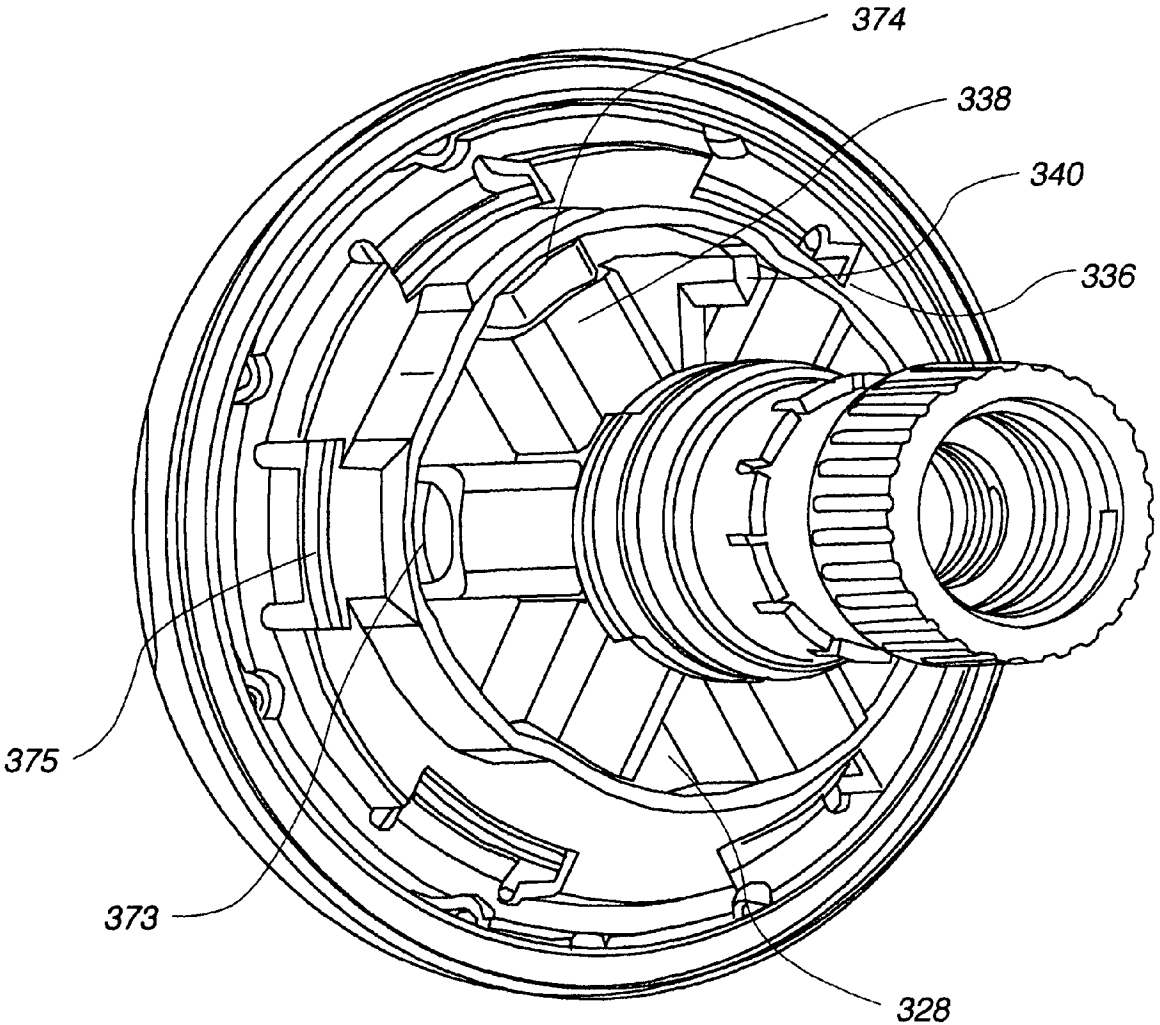
FIG. 33 depicts a perspective view of the fifth embodiment with the base cone removed.

Turning now to FIG. 33, the operation of the plungers, valve body, flow channels, and actuator ring will be explained in more detail. The valve body 328 defines one or more flow channels 382, extending radially from a central water port. Each flow channel leads to a flow outlet 384 (shown to best effect in FIG. 44). As also shown in FIG. 33, a plunger 338 is located inside each flow channel 382. The plunger may move radially along the flow channel, alternating between an inner, closed and sealed position and an outer, open and unsealed position. When the plunger is in the outer (i.e., radially outwardly extending) position, water may flow from the central water inlet, along the flow channel, and to the flow outlet to which the flow channel leads. Ultimately, water flowing through a flow outlet exits the present embodiment through one or more corresponding nozzles.

Generally, the plunger 338 moves radially outwardly from its inner, sealed position under the force of water pressure. This motion, however, may only be accomplished when the outer end of the plunger aligns with an actuator ramp 360, 372 or actuation point 362, 374 defined on the actuator ring 336. The actuator ring fits around the outer ends of the flow channels 382 to typically limited the outward radial motion of the plungers, and to force each plunger inwardly as the actuator ring turns. The actuation points, however, have a greater radius (measured from the center of the actuator ring and/or valve body) than does the rest of the actuator ring. See, for example, FIG. 34. Thus, the actuation point permits outward motion of a plunger.

Still with respect to FIG. 33, an actuation point 375 is aligned with a plunger 338 by rotation of the mode ring 312, and corresponding rotation of the actuator ring 336. As the mode and actuator rings are further rotated, the outer end of the plunger engages the actuator ramp 373, which gradually forces the plunger radially inward, returning the plunger to a seated position. This cuts off water flow through the flow channel, out through the flow outlet, and through the corresponding nozzle(s).

As previously mentioned, the actuator ring 336 may have one or more actuator ramps 373 leading to an actuation point. The front and rear edges of the actuator ring define the position of each plunger in the flow channel. Each edge defines a profile, which either permits the plunger to move to a radially outwardly extending (unsealed) position or pushes the plunger inwardly to an inner, sealed position. The actuator ring "click" or times the position of the plungers to allow or control the water flow to the various nozzles being actuated by the actuator ring.

Figure 38:
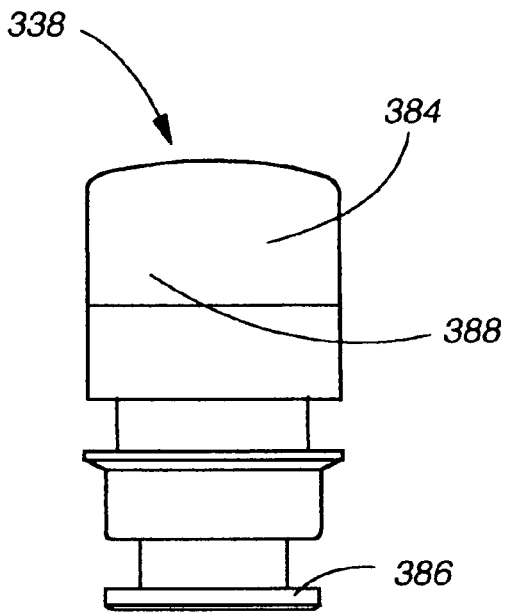
FIG. 38 depicts a back view of the plunger of FIG. 37.
Figure 37:
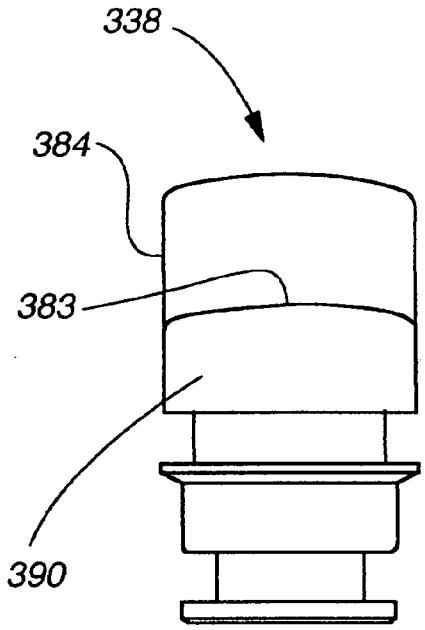
FIG. 37 depicts a front view of a plunger.
Figure 39:
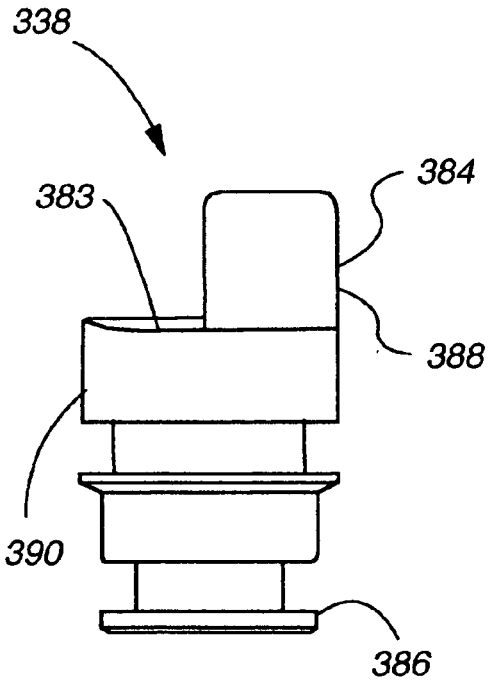
FIG. 39 depicts a side view of the plunger of FIG. 37.

Not all plungers, however, may extend radially outwardly into both the upper and lower actuation points. Referring now to FIGS. 37 through 40, various views of a plunger 338 are shown. FIG. 37 shows a plunger in front view, FIG. 38 depicts a plunger in rear view, and FIG. 39 depicts a plunger in side view. As shown to best effect in FIG. 39, each plunger 338 generally includes a curved lower surface 383 and an extended upper surface 384. The extended upper surface generally projects farther than the curved lower surface from the base 386 of the plunger. The rear wall 388 of the extended upper surface is substantially flat. By contrast, the front wall 390 of the curved lower surface is arcuate. As shown to best effect in the isometric view of FIG. 40, the combination of front 390 and rear walls 388 creates a "D" shape in lateral cross-section. This D-shape mates with the D-shaped flow channels, as described in more detail below with respect to FIG. 41.

Figure 40:
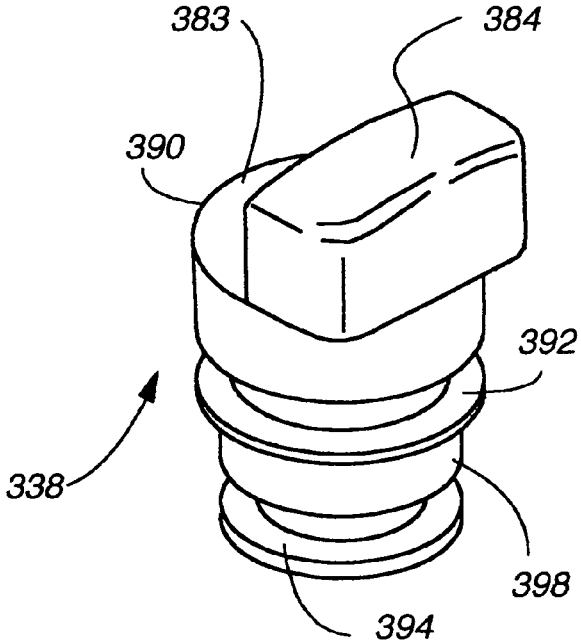
FIG. 40 depicts an isometric view of the plunger of FIG. 37.

As also shown in FIG. 40, the plunger 338 may include a first 392 and second 394 o-ring seat point. Each seat point may accept an o-ring 396 (shown in FIG. 32). When seated, the outer surface of each o-ring 396, 397 generally extends slightly outwardly past the sidewall 398 of the lower portion of the plunger. The o-rings are typically made of neoprene rubber or a similar water-tight sealing material. When a plunger sits in a closed position within a valve flow channel 382, the o-rings abut the sides of the flow channel, forming a water-tight seal. Accordingly, no water may flow from the interior of the valve body 328 through the sealed flow channel 382. However, when the plunger is aligned with an actuation point and partially moves radially outwardly from the valve body, the inner o-ring 396(i.e., the o-ring in the second o-ring seat point, shown in FIG. 40) does not contact the flow channel walls. Accordingly, water may flow past the front of the plunger and at least partially down the flow channel.

Even when the plunger 338 is recessed, the outer o-ring 397 (i.e., the o-ring seated in the first o-ring seat point 392, shown in FIG. 40) maintains its contact with the sidewall 400 of the flow channel 382. Thus, although water may flow past the inner o-ring, it may not flow past the outer o-ring. This is because the diameter of the inner o-ring seat point 392 is larger than the diameter than the outer o-ring seat point 394. The relative diameters of the o-ring seat points are shown to best effect in FIG. 39, while contact (or lack thereof) between the o-rings and the flow channel sidewalls is shown to best effect in FIG. 32.

For example, the first plunger 344 in FIG. 32 is in an actuated (radially outwardly extended) position. Accordingly, water may flow past the inner o-ring 396 of the first plunger 344, but not past the outer o-ring 397 of the first plunger. Comparatively, the third plunger 348 is in a seated (radially inward) position. Thus, both the inner 396 and outer 397 o-rings of the third plunger contact the scalloped walls 402 of the flow channel 382. By scalloping or creating a stair step profile along the flow channel walls, the inner o-ring 396 may contact the flow channel sidewall 400 while in a seated position and not contact the flow channel sidewalls in an actuated position. By contrast, the outer o-ring 397 maintains contact with the flow channel sidewalls regardless of whether the plunger is in an actuated position or not.

Returning to FIG. 32, it can be seen that the second 346, third 348, and sixth 354 plungers are oriented with the curved lower surface 383 above the extended upper surface 384. In other words, the back wall 388 of these plungers sits further into the valve and farther away from the faceplate 270 than the front wall 390. By contrast, the first 344, fourth 350, and fifth 352 plungers are oriented in exactly the opposite manner. That is, the extended upper surface 384 overlies the curved lower surface 383 in these plungers. This orients the back wall 388 closer to the faceplate 270 than the front wall (i.e., closer to the front of the embodiment). Effectively, the first 344, fourth 350, and fifth 352 plungers are oriented 180 degrees from the second 346, third 348, and sixth 354 plungers.

The orientation of the plungers 344, 346, 348, 350, 352, 354 directly affects which actuation points on the actuation ring 336 will permit water pressure to force the plungers radially outwardly. The first 344, fourth 350, and fifth 352 plungers may only be forced radially outwardly when aligned with the upper actuation point 362. When aligned with the lower actuation point 374, the inner actuator wall 378 (see FIG. 31) abuts the top of the extended upper surface 384, keeping the plungers in a radially inward, closed position. By contrast, the second 346, third 348, and sixth 354 plungers may be forced radially outwardly to an open position by water pressure when aligned with either the upper 362 or lower actuation points 374. When aligned with the upper actuation point, the second, third, and sixth plungers behave in the same manner as the first, fourth, and fifth plungers. When aligned with the lower actuation point, the extended upper surface sits beneath the ledge and inner actuator wall. This permits water pressure to force these plungers radially outwardly until the curved lower surface of the plunger contacts the inner actuator wall; the extended upper surface slides beneath the ledge and into the lower actuation point. The second plunger 346 in FIG. 32, for example, is in such a position.

Accordingly, the actuation ring 336 is designed in such a manner that the upper actuation point 362 permits movement of any plunger with which it is aligned, while the lower actuation point 374 permits movement only of properly oriented plungers.

It should be noted that the planar segments 366 making up the inner ring 378 of the actuator 336 generally prevent movement of any adjacent plungers. Further, the length of each planar segment is approximately equal to the width of the extended upper surface of the plunger 384 (see, for example, FIG. 33). This facilitates a firm connection between the planar segments 366 of the inner ring 378 and the extended upper surface 384 of the plungers. Additionally, the upper 360 and lower ramps 372 permit plungers to gradually slide radially outwardly until the flow channel 382 is fully opened with the plungers seated against the appropriate actuation point, instead of abruptly transitioning a plunger from a closed (inner) to an open (outer) position. Without the upper and lower ramps, plungers would abruptly unseat and reseat within the valve, thus causing water flow through the flow channels to vary from non-existent to full flow. Further, moving the plunger inwardly would require excessive force in the absence of the ramps. By permitting such gradual changes in flow, water transition between groups of nozzles is gradual. This, in turn, permits the operator time to acclimate from one spray pattern to the next as the mode ring is turned. It should be noted the mode ring and actuator ring may be turned in either a clockwise or counter-clockwise direction.

Generally, each plunger actuates a different one of the spray modes described with respect to FIG. 28. That is, when a given plunger extends radially outwardly and opens a corresponding flow channel, a specific spray mode is activated. For example, when the first plunger 344 shown on FIG. 32 is radially outwardly extended and the corresponding flow channel 382 is open, any of the first, second, third, and fourth body spray patterns mentioned with respect to FIG. 28 may be active. This is also true when the second plunger 346 shown on FIG. 32 is radially outwardly extended.

When the third plunger 348 shown on FIG. 32 is radially outwardly extended, water flows through the center spray nozzles 276, forming the one-inch center spray patterns discussed with respect to FIG. 28.

When the fourth plunger 350 shown on FIG. 32 is radially outwardly extended, water ultimately flows through the inner massage nozzles 282 in a relatively low-flow, "pause" mode. Holes in the backplate are sized to minimize water flow to the inner massage nozzles 282, resulting in a trickle of water emanating from the embodiment. This trickle generally is insufficient to travel any significant distance beyond the shower head.

By contrast, when the fifth plunger 352 is radially outwardly extended, water flows through the outer massage nozzles 303 in a backflow mode, discussed in more detail below. Water also flows through the outer massage nozzles in a normal flow mode when the sixth plunger 354 is radially outwardly extended. The backflow and normal flow modes are discussed in more detail below, with respect to FIG. 46. In the present embodiment, no more than two plungers are typically radially outwardly extended at any given time. Accordingly, no more than two nozzle groups typically emit water simultaneously. Alternate embodiments may permit more or fewer nozzle groups to simultaneously emit water.

Although the valve 328 defines six flow channels and includes six plungers seated therein, alternate embodiments may employ more or fewer flow channels and plungers. Similarly, the actuator ring 336 discussed herein may have more or fewer upper actuation or lower actuation points without the departing from the spirit or scope of the invention. Additionally, some embodiments may employ an actuator ring wherein the orientation of the ledge and inner actuator wall are reversed. That is, the inner actuator wall may extend towards the back of the embodiment (i.e., towards the shower pipe conductor structure) instead of towards the front of the embodiment, thus defining a "partial upper-actuation point." Further, the orientation and position of the plungers may be varied in alternate embodiments. Essentially, the present invention contemplates and embraces any combination of upper and/or lower actuation points spaced along the actuator ring, flow channels, and/or plungers.

FIG. 33 is a perspective view of the present embodiment with the base cone 314 removed. This figure depicts the lower actuation point 374 of the actuator ring 336 with an exemplary plunger 338 in the open or flow position. This view also generally depicts the valve body 328 and anti-rotation mechanism 340, as well as the mating between actuator ring 378 and valve 328. In the present embodiment, one or more prongs abut the top or sides of the valve, while the collar 368 of the actuator ring 336 sits beneath the valve body 328. The actuator ring is typically not bonded to the valve, but instead may freely rotate about the valve while the prongs maintain the connection there between.

Figure 41:
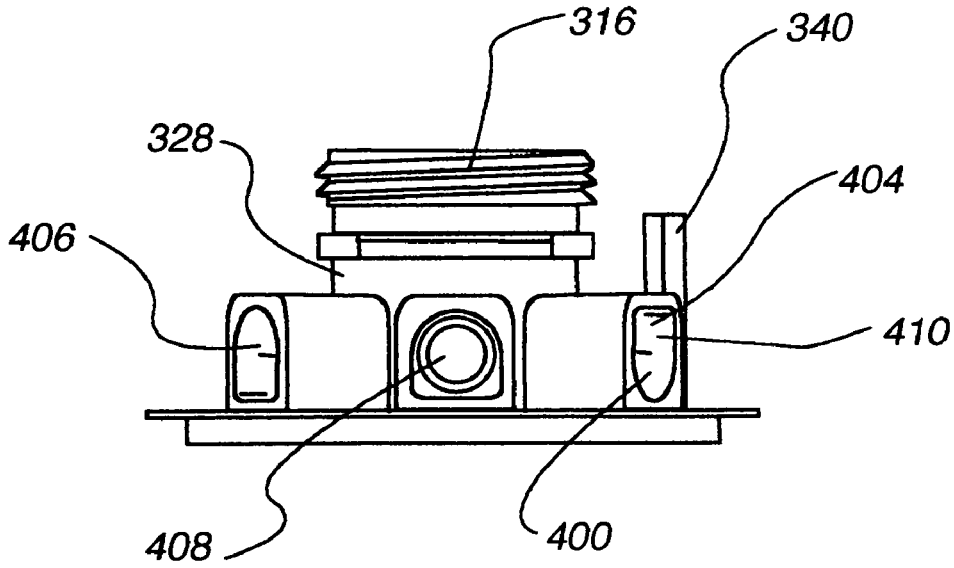
FIG. 41 depicts a side view of a valve for use in the fifth embodiment of the present invention.

FIGS. 41 through 44 depict various views of the valve body 328. FIG. 41 is a side view of the valve, showing the connector structure 316 extending from the valve body 328. The anti-rotation device 340 may also be seen. Further, three flow channels 404, 406, 408 are visible. During operation of the present embodiment, one plunger is at least partially seated within each flow channel 404, 406, 408. In longitudinal cross-section, the wall of each flow channel is generally "D" shaped to match the cross-section of a plunger, and to ensure proper plunger orientation during assembly of the embodiment. However, it should be noted that some flow channels have a "D" shaped cross-section rotated 180 degrees from other flow channels. For example, the first flow channel 404 (i.e., the rightmost flow channel in FIG. 41) is oriented with the flat portion of the "D" shaped cross-section at the back of the flow channel. By contrast, a second flow channel 406 (i.e., the leftmost flow channel in FIG. 41) is oriented with the flat portion of the "D" shaped cross-section at the front of the flow channel. (The valve is shown upside-down in FIG. 41.) Plungers may simply be rotated 180 degrees as necessary to fit within either type of flow channel without requiring structural modifications.

Generally, plungers 338 seated within a flow channel having a "back side flat" configuration (such as the first flow channel 404 of FIG. 41) may be actuated by the either the upper 362 or lower actuation 374 points of the actuator ring 336. As the lower actuation point aligns with the back side flat flow channel, the extended upper surface 384 of the plunger may extend beneath the inner wall 378 of the actuator ring, thus permitting the plunger to move radially outwardly within the flow channel.

By contrast, plungers 338 seated in a "front side flat" flow channel (such as the second flow channel 406 in FIG. 41) may only actuate when aligned with the upper actuation point 362 of the actuator ring 336. When aligned with the lower actuation point 374 of the actuation ring 336, the inner wall 378 of the actuator ring engages the extended upper surface 384 of the plunger, thus preventing radial outward motion in response to water pressure.

As shown to best effect in FIG. 41, it may be noted that the sidewalls 400 of the flow channel 404, 406, 408 are not uniform in cross-sectional shape. The outer ends 410 of the flow channel sidewalls assume the aforementioned "D" shaped cross-section, while the inner ends of the flow channel sidewalls 366 are generally circular in cross-section. Further, the inner end of the flow channel is shaped with scalloped or stair-step profile sidewalls, transitioning from a larger diameter circular cross-section (nearer the outer end of the flow channel) to a smaller diameter circular cross-section (nearer the inner end of the flow channel). The aforementioned o-rings 396, 397 on each plunger 338 engage the sidewalls of the flow channel, with the inner o-ring 396 contacting the sidewall of the flow channel having a smaller circumference and the outer o-ring 397 contacting the sidewall of the flow channel having a larger circumference, while the plunger is in an inner, or sealed, position. As the plunger extends radially outwardly, the inner o-ring extends outwardly past the innermost scalloped section of the flow channel, and disengages from the flow channel sidewall. The outer o-ring 397, however, maintains contact with the sidewall even while the plunger is in a radially-outwardly extended position.

Figure 42:
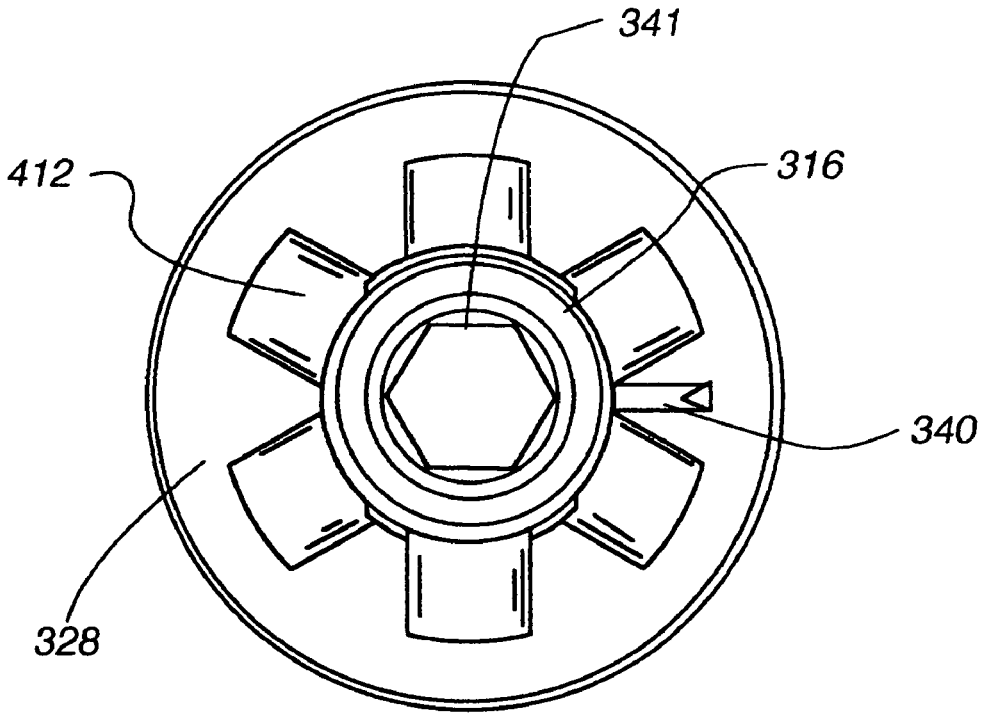
FIG. 42 depicts a back view of the valve of FIG. 41.

FIG. 42 depicts a rear view of the valve 328. The outer housing 412 of each flow channel, the connection structure 316, and the anti-rotation structure 340 may be seen. Also visible is the central water port, and the top of a hexagonal seating point 341. The hexagonal seating point accepts the inner end of the plungers 338 when the plungers occupy an inner, sealed position.

Figure 43:
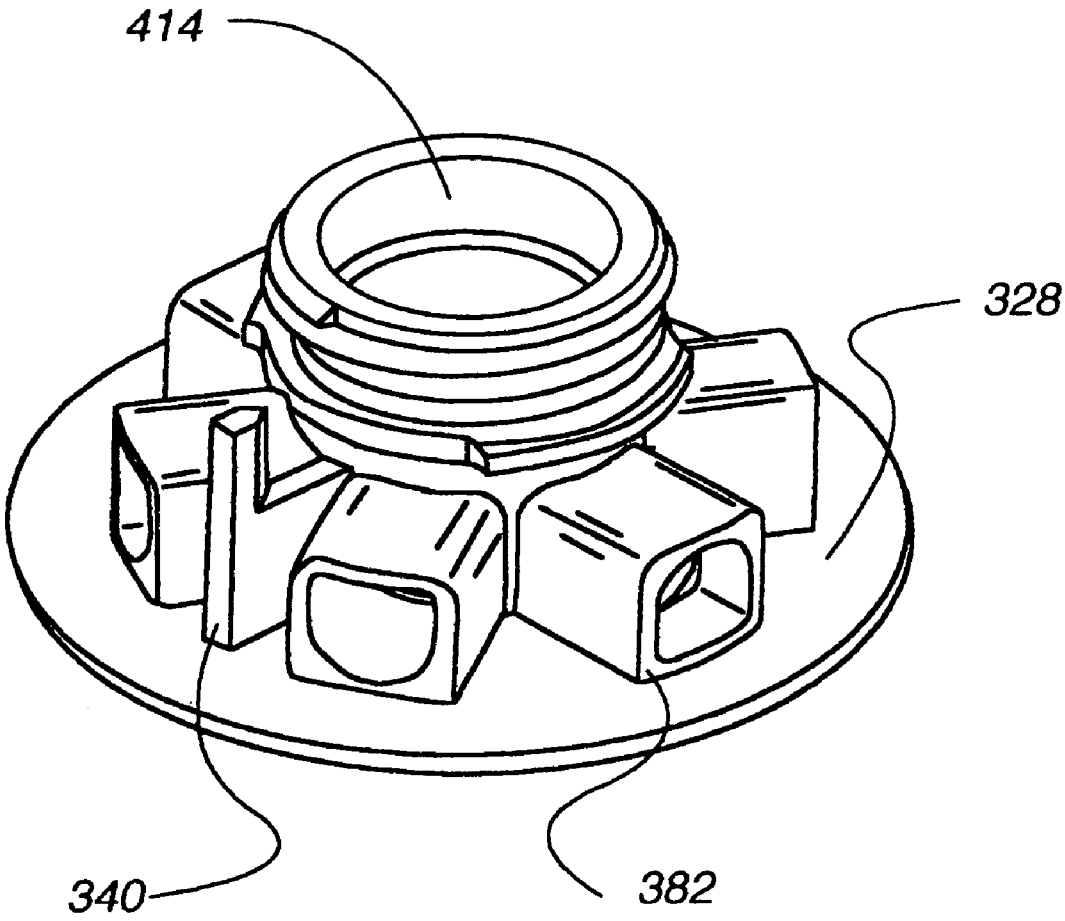
FIG. 43 depicts an isometric view of the valve of FIG. 41.

FIG. 43 depicts an isometric view of the valve 328. In this view, the transition between the "D" shaped and generally circular cross-sections of a flow channel 382 may partially be seen. Further, the central water port 414, which channels water from the shower pipe to the center of the valve and through any open flow channels, may also be seen. The anti-rotation structure 340 of the valve is also visible.

Figure 44:
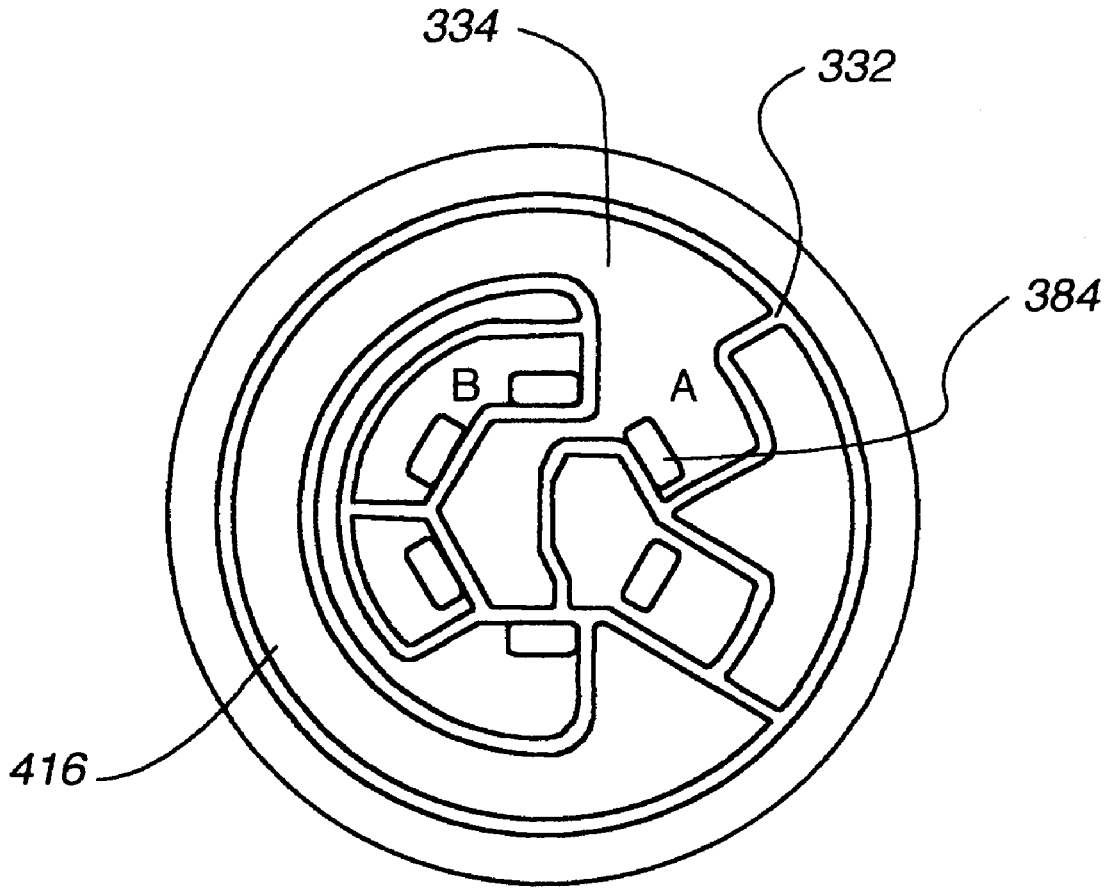
FIG. 44 depicts a front view of the valve of FIG. 41.

FIG. 44 depicts the front surface 416 of the valve 628. The front surface of the valve generally defines a number of passages 418. Each passage is bounded by sidewalls 420 extending outwardly form the valve front. Further, in the present embodiment, six flow passages are defined in the front of the valve. Alternate embodiments may define more or fewer flow passages. Each flow passage is associated with a flow channel via a flow outlet, Further, and as discussed in more detail below, each flow passage leads to an inlet nozzle or aperture, to a backplate channel, and ultimately to one or more nozzles or apertures formed on the faceplate.

At least one flow outlet 384 is present within each of the flow passages 418. Each flow outlet extends through the valve 328 front and into a discrete flow passage. When the aforementioned plungers are in an outer position, water may flow through the valve 328, into the flow passage 418, and outwardly through the flow outlet 384. Some passages may contain multiple flow outlets. For example, flow passage "B" contains two flow outlets, while flow passage "A" contains a single flow outlet. Generally, water only flows along a flow passage when a plunger moves radially outwardly to open the corresponding flow outlet for that passage. As used herein, the term "flow outlet" refers to the aperture in the valve top permitting water flow from the flow channel to the valve top surface.

Figure 45:
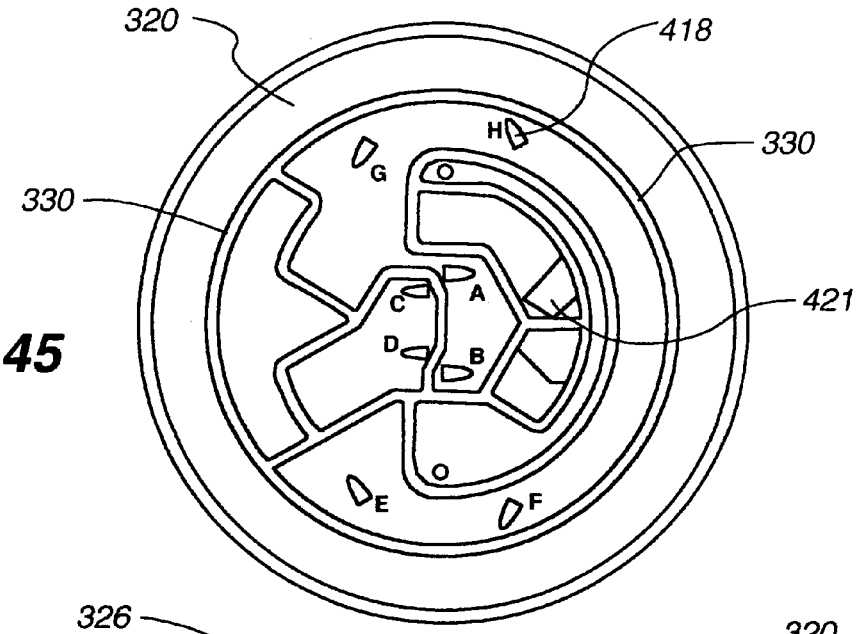
FIG. 45 depicts a back view of a backplate for use in the fifth embodiment of the present invention.

FIG. 45 depicts the rear of the backplate 320. Sidewalls 330 extend outwardly from the backplate rear. When the present embodiment is assembled, the backplate sidewalls 330 typically abut (and are sonically welded to) the valve front sidewalls 332. The pattern of sidewalls on the rear of the backplate is a mirror image of the sidewall pattern on the valve front. Thus, both the valve front sidewalls and the backplate rear sidewalls contribute to define the flow passages 334, as do the front of the valve and the rear of the backplate themselves.

Unlike the front of the valve 328, the backplate 330 rear contains no flow outlets. Instead, the flow channels defined on the rear of the backplate include at least one inlet nozzle 418 or backplate aperture 421. Accordingly, in the present embodiment water flows into the valve center 380 from a shower pipe, along a flow channel and at least partially past a radially outwardly extended plunger, through a flow outlet, into a flow passage, along the flow passage, and out either an inlet nozzle or an aperture. Water may then flow through a backplate channel, potentially across a turbine, and out an aperture or nozzle formed on the faceplate.

For example, consider a flow channel "A" on FIGS. 44 and 45. Water flows into the channel 334 through the designated flow outlet 384, around the flow passage, and into inlet nozzles A, B, E, F, G, and H located on the rear of the backplate (i.e., "roof" of the flow passage). The water then flows through the inlet nozzles 418, into the first 422 and second backplate 424 channels defined on the front of the backplate 320 (see FIG. 46), across a first turbine located in the first backplate channel and a second turbine located in the second backplate channel, and emerges from the outer massage nozzles 303 on the front of the faceplate 270.

Figure 46:
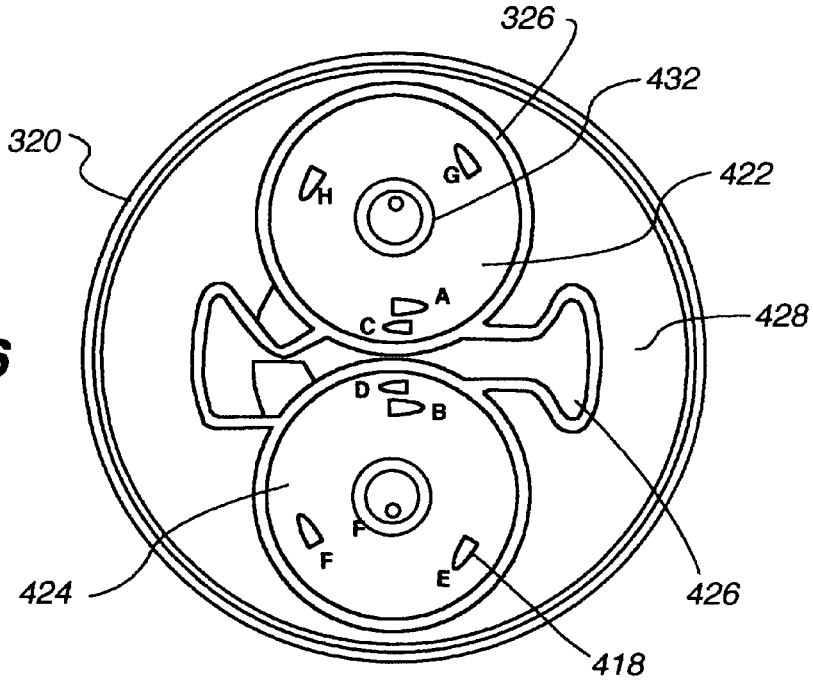
FIG. 46 depicts a front view of the backplate of FIG. 45.
Figure 47:
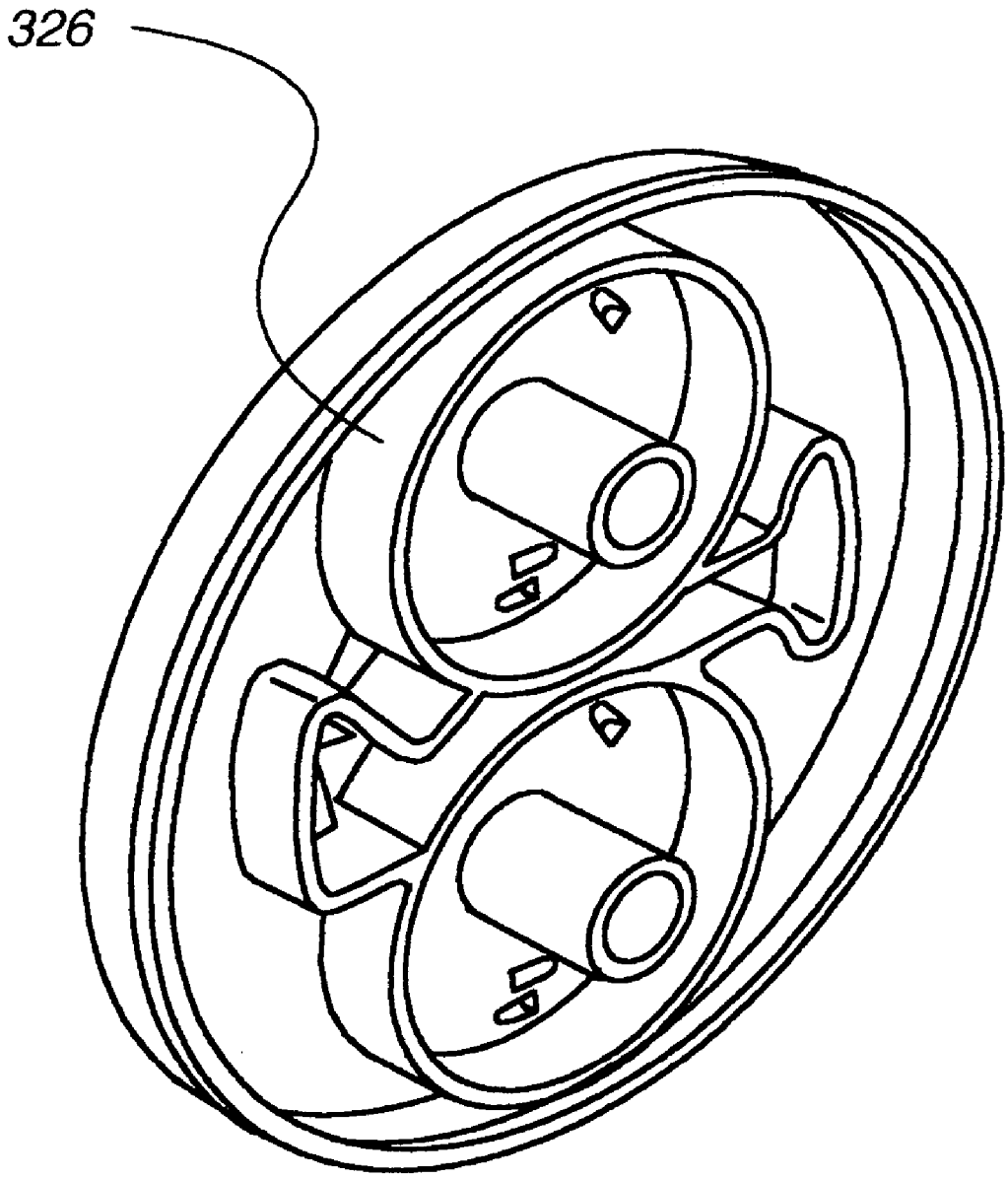
FIG. 47 depicts an isometric view of the backplate of FIG. 45.

As water flows through the inlet nozzles 418 or apertures 421 shown on FIG. 45, the water emerges through the same inlet nozzles or apertures and into at least one backplate flow channel 422, 424, 426, 428. The backplate flow channels are generally formed on the front of the backplate as shown in FIG. 46. The backplate channels are defined by one or more front backplate sidewalls 326. The front backplate sidewalls 326 shown to better effect in the isometric view of FIG. 47.

The various backplate channels 422, 424, 426, 428 correlate with different nozzle groups located on the faceplate front and discussed with respect to FIG. 28. For example, the first backplate channel 422 corresponds to the outer massage nozzles 303 of the first (upper) inner circular plate, while the second backplate 424 channel corresponds to the outer massage nozzles 303 of the second (lower) inner circular plate. The inner backplate channel 426 corresponds to the center spray nozzles 276 defined in the inner triangular faces 278, 280. The outer backplate channel 428 corresponds to the first 288, second 298, third 300, and fourth 302 groups of body spray nozzles. In the present embodiment, water is simultaneously supplied to the first through fourth groups of body spray nozzles, and accordingly all the corresponding body spray patterns are simultaneously active. In alternate embodiments, the first through fourth body spray patterns may be active singly or in other combinations.

Figure 48:
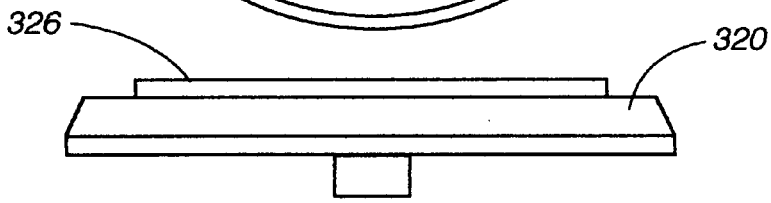
FIG. 48 depicts a side view of the backplate of FIG. 45.

For reference, FIG. 48 depicts a side view of the backplate, also showing a front and backplate sidewall.

Returning to FIG. 46, in the present embodiment, the front backplate sidewalls 326 define first 422 and second 424 circular backplate channels. Each of the first and second circular backplate channels is fed by multiple inlet nozzles 408. In the present embodiment, four inlet nozzles feed each circular backplate channel. In alternate embodiments, more or fewer inlet nozzles may be employed per circular backplate channel. It may also be seen that one of the four inlet nozzles is oriented in an opposite direction with respect to the other three inlet nozzles in each backplate channel. For example, in the first circular back channel 422, inlet nozzles A, G, and H are oriented such that water flowing out of these nozzles enters the circular backplate channel flowing at generally clockwise direction, looking at the front of the backplate. This clockwise water flow impacts one or more vanes of a turbine (shown in FIG. 50), thus imparting rotational motion to the turbine. The rotational motion results in the pulsating spray through the massage nozzles, as discussed in more detail below.

By contrast, nozzle C emits water into the circular backplate channel 422 flowing in a generally counter-clockwise position. Depending on which flow channels inside the valve are open, inlet nozzle C may emit water into the first circular backplate channel simultaneously with one or more of nozzles A, G, and H. Generally, this reverse flow through inlet nozzle C acts to counter at least a portion of the water pressure resulting from flow through one or more inlet nozzles A, G, and H, by impacting the turbine vanes and imparting rotational energy in a direction opposite that imparted by flow through nozzles A,G, and H. Thus, when inlet nozzle C emits water simultaneously with one of inlet nozzles A, G, or H, the water pressure in the first circular backplate is decreased, the turbine spins more slowly, and the pulsation of spray through the outer massage nozzles is slowed.

Figure 49:
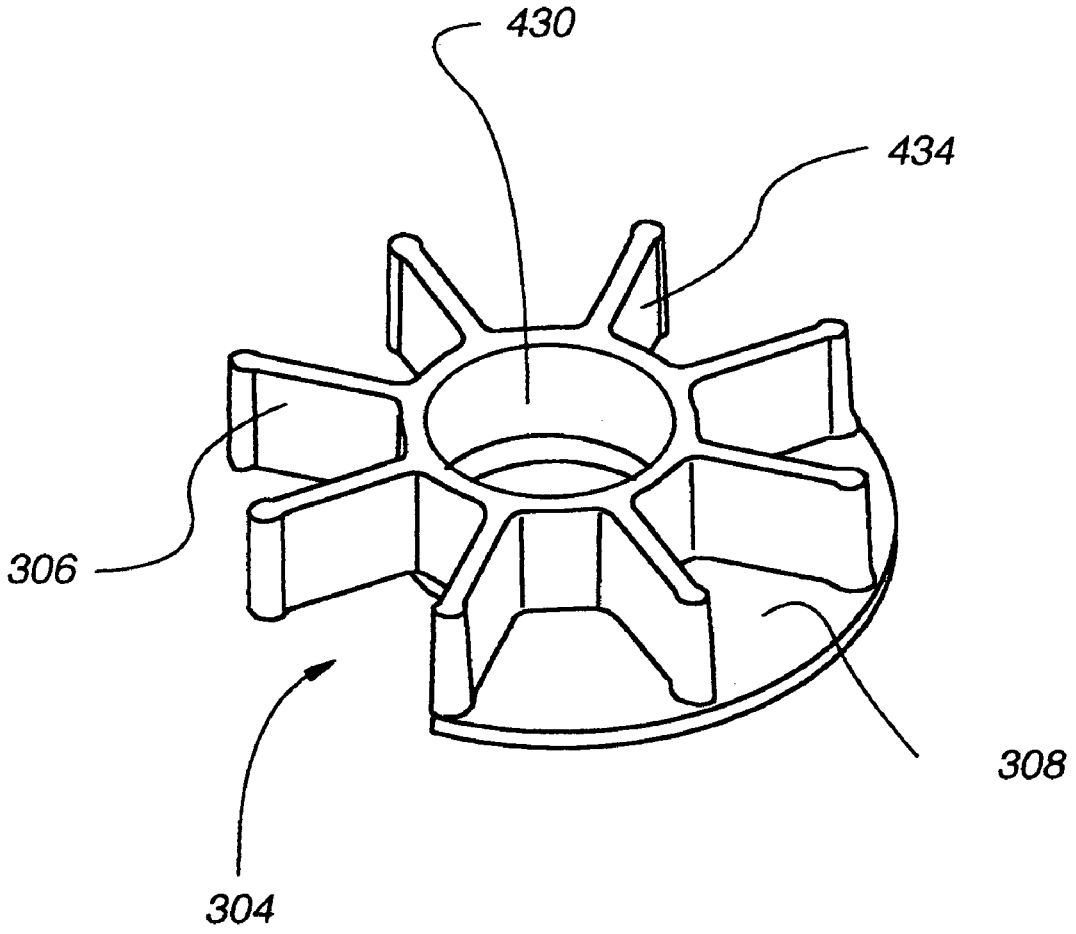
FIG. 49 depicts an isometric view of a turbine.

The positioning of the first 422 and second 424 circular backplate channel generally corresponds to the positioning of the two inner circular plates 294, 296 on the faceplate of the present embodiment. (These inner circular plates were discussed with reference to FIG. 28, and are shown in more detail on FIG. 51.) Still with reference to FIG. 46, a turbine generally sits within the first circular backplate channel 422. One example of a turbine 304 is shown in FIG. 49. The hollow inner portion 430 of the turbine shown in FIG. 49 fits around the inner sidewall 432 of the first circular backplate channel 422. A similar turbine assembly is mounted within the second circular backplate channel 424. It should be noted that the vaned extensions 424 of the turbine generally face the front of the shower head, towards the front of the backplate. Thus, as water is emitted from one of inlet nozzles A, G, or H, the flow impacts the vanes of the turbine, imparting clockwise rotational energy to the turbine. When back flow (or reverse flow) is emitted from inlet nozzle C, the back flow also impacts the vanes of the turbine. However, this back flow imparts rotational energy in a direction opposite to that imparted by the flow emitted from inlet nozzles A, G, or H. Accordingly, the rotation of the turbine is slowed.

Since the valve 328, plungers 338, and actuator ring 336 control the flow of water through inlet nozzles A, G, and H separately from flow through inlet nozzle C, the turbine 304 may operate at two different speeds. The turbine may operate in a first, high-speed mode when flow into the first circular backplate channel 422 occurs only through inlet nozzles A, G, and H. The turbine 304 may operate in a second, low-speed mode when flow into the first circular backplate channel 422 occurs through inlet nozzles A, G, and H, and simultaneously in an opposite direction through inlet nozzle C. This same operation is true with respect to the turbine located in the second circular backplate 424 channel.

The rotational speed of the turbine 304 dictates the pulsation speed of water jets emerging from any of the outer massage nozzles 303. Slower rotational speeds yield slower water jet pulsation, while higher rotational speeds yield faster water jet pulsation. As the turbine rotates, the shield 308 extending along a portion of the turbine circumference momentarily block one or more outer massage nozzles. When these nozzles are blocked, water flow from the circular backplate channel, through the turbine vanes 434, and out through the outer massage nozzles 303 is interfered with. Thus, the water flow out of the faceplate is momentarily interrupted. As the turbine revolves, the shield moves to block different sets of outer massage nozzles. This intermittent blocking of outer massage nozzles produces the aforementioned pulsating effect.

Although the present embodiment employs two circular backplate channels and two turbines, alternate embodiments may employ more or fewer backplate channels and turbines. Further, multiple turbines may be arranged concentrically instead of in a side-by-side manner.

Figure 50:
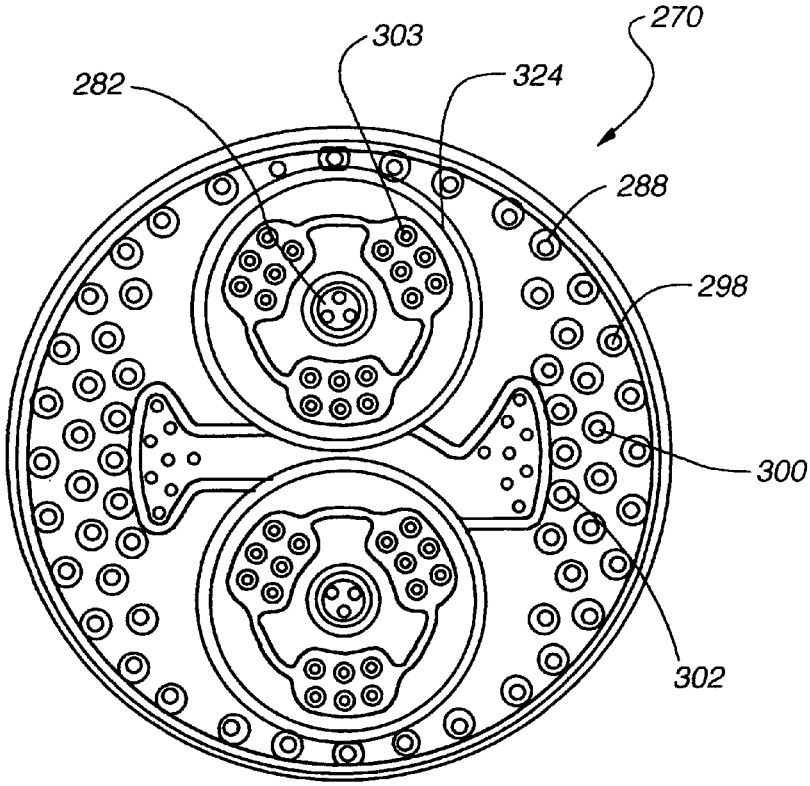
FIG. 50 depicts a back view of a faceplate for use in the fifth embodiment of the present invention.
Figure 52:
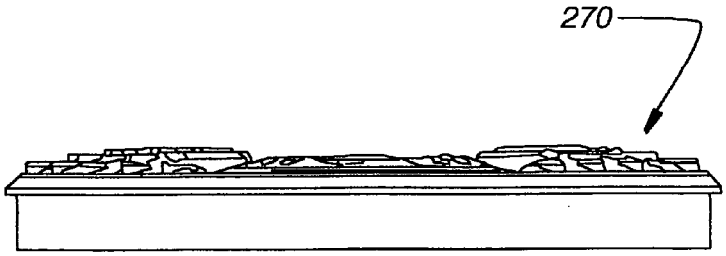
FIG. 52 depicts a side view of the faceplate of FIG. 50.

FIG. 50 depicts the backside of the faceplate 270. Faceplate sidewalls 324 extend outwardly from the back of the faceplate. These faceplate sidewalls generally abut the front sidewalls 326 of the backplate 320 to form the various backplate channels, in much the same manner as flow channels are defined by the combination of the front valve sidewalls and rear backplate sidewalls. The sidewalls 324 of the faceplate 270 may also be sonically welded to the front backplate sidewalls 326, or otherwise affixed thereto in any manner known to those skilled in the art (for example, by an adhesive heat bonding, etc.) The defined backplate channels selectively guide water to certain groups of nozzles. As can be seen in FIG. 50, the inner and outer massage nozzles 282, 303 generally penetrate the faceplate and terminate in the first 422 and second circular 424 backplate channels. Similarly, the first through fourth sets of body spray nozzles 288, 298, 300, 302 penetrate the faceplate and enter an outer backplate channel 428. Thus, when water travels through the backplate via aperture I-1, the water enters and fills the outer backplate channel, and is emitted through one or more of the first through fourth groups of body spray nozzles. In some embodiments, one or more of the first, second, third, and fourth groups of the body spray nozzles may be selectively blocked to permit greater control over the shower spray pattern.

The rear of the faceplate 270 and the front of the backplate 320 also combine to define an inner backplate channel. The inner backplate channel 426 directs water to center spray nozzles located 276 in the inner triangular face 278, 280 (see, for example, FIG. 28). It should be noted the inner backplate channel directs water across the length of the backplate and faceplate, in a direction generally transverse to other flow channels or backplate channels. The inner backplate channel directs water flow between the two circular backplate channels.

Figure 51:
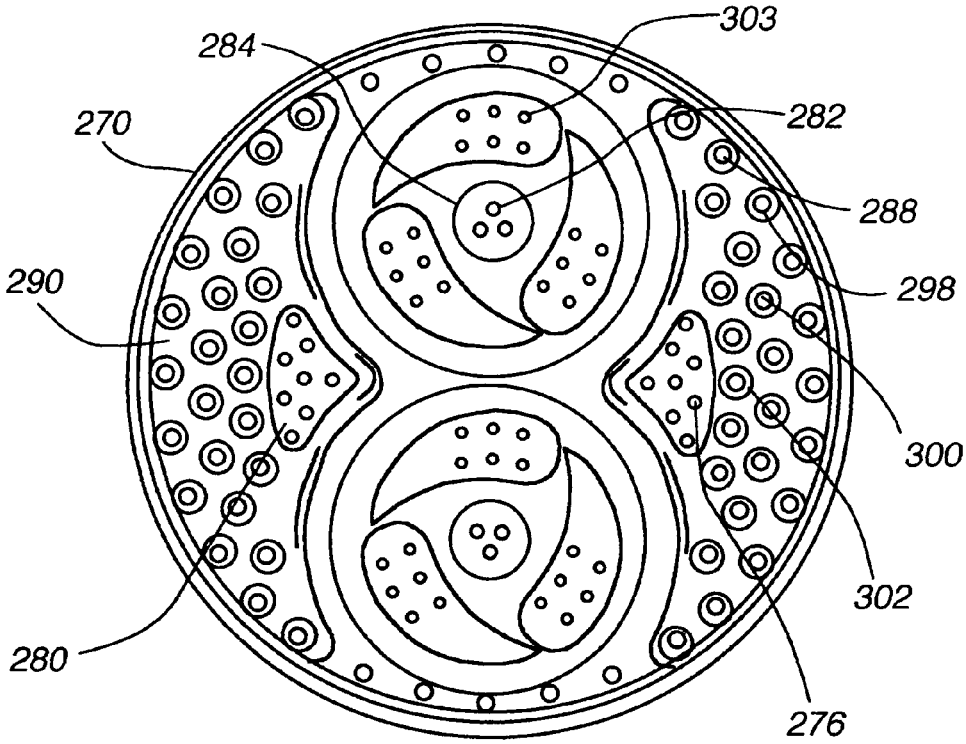
FIG. 51 depicts a front view of the faceplate of FIG. 50.

FIG. 51 depicts the front of the faceplate 270. The close-up view shown in FIG. 51 clearly depicts the first 288, second 298, third 300, and fourth 302 groups of body spray nozzles, the center spray nozzles 276, the outer massage nozzles 303, the inner massage nozzles 282, the outer triangular faces 290, the inner triangular faces 280, and the inner circular plates 284.

Figure 53:
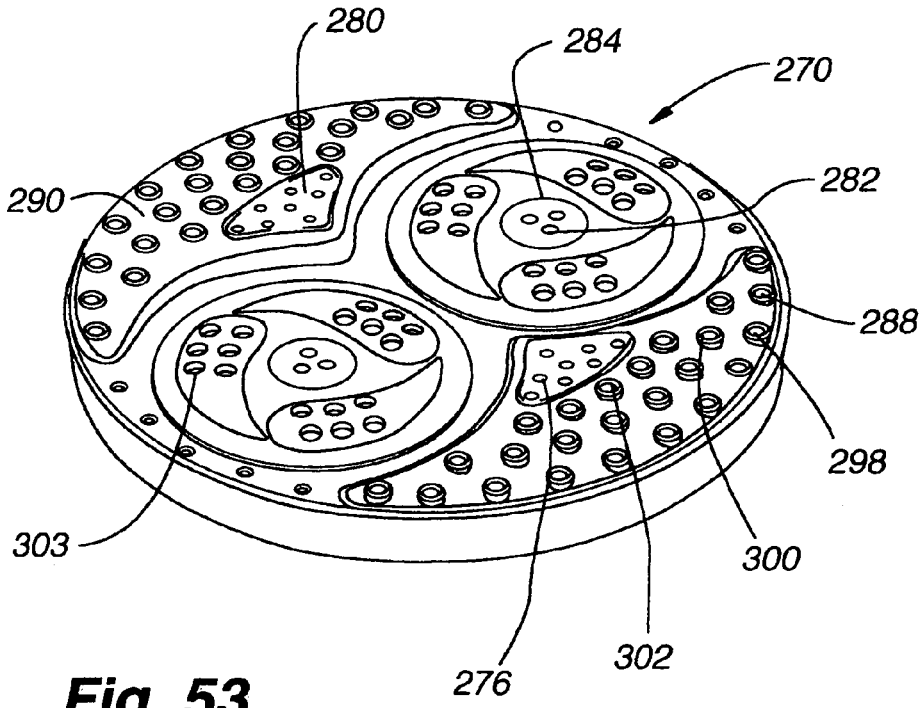
FIG. 53 depicts an isometric view of the faceplate of FIG. 50.
Figure 54:
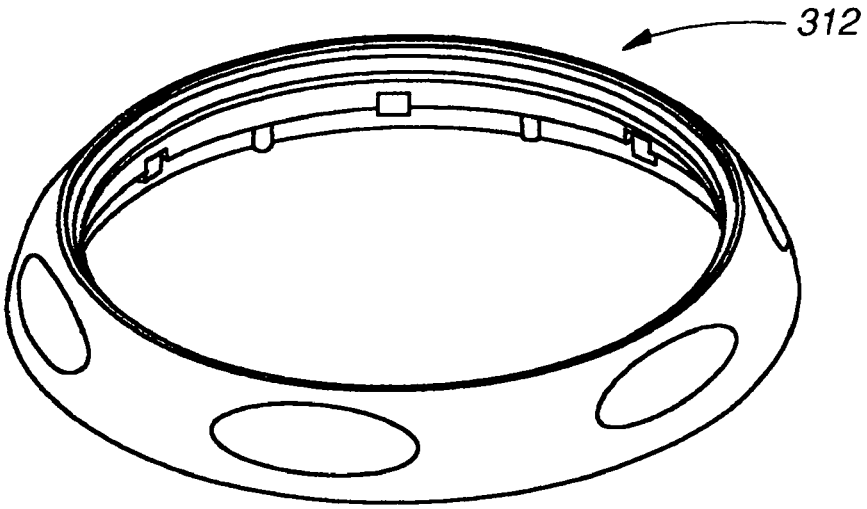
FIG. 54 depicts an isometric view of a mode ring.

FIG. 53 depicts a side view of the front plate 270 used in the present embodiment, while FIG. 53 depicts the same faceplate in an isometric view. It should be noted that alternate embodiments may employ faceplates having different nozzle groups, inner or outer triangular faces, inner circular plates, and so forth. Generally speaking any nozzle pattern or nozzle grouping desired may be implemented in a faceplate of an alternate embodiment. Further, the present embodiment contemplates switching of a mode ring by unscrewing or otherwise removing the mode ring. The mode ring 312 is depicted in FIG. 54.

With respect to assembly of the present embodiment, a variety of faceplates and/or base cones may be chosen prior to sonic welding of components to provide a number of different aesthetic appearances. This may change the appearance of the embodiment by substituting colored or decorative faceplates, base cones having different shapes or colors, and so forth.

Although the present invention has been described with reference to specific embodiments and structural elements, it should be understood that alternate embodiments may differ in certain respects without departing from the spirit or scope of the invention. For example, alternate embodiments may include more or fewer nozzles or groups of nozzles, more or fewer turbines, different flow channel arrangements, and so forth. Accordingly, the proper scope of the invention is defined by the appended claims.

We claim:

1. A shower head comprising:

a body having an inlet for connection to a water conduit;

a first outlet formed on the body;

a second outlet formed on the body;

a first turbine operably connected to the first outlet;

a second turbine operably connect to the second outlet;

a valve in fluid communication with said first and second turbines and operative to at least partially radially channel a fluid to only the first turbine in a first operating state, only the second turbine in a second oneratino state, and the first and second turbines simultaneously in a third operating state.

2. The shower head of claim 1, wherein:

the first outlet comprises one of a first plurality of outlets formed on the body, the first plurality of outlets operable to emit a first pulsating mode; and the second outlets comprises one of a second plurality of outlets formed on the body, the second plurality of outlets operable to emit a second pulsating mode.

3. A shower head as defined in claim 1, wherein:

said first plurality of outlets is positioned adjacent to said second plurality of outlets.

4. A shower head as defined in claim 3, wherein:

said first plurality of outlets is concentric to said second plurality of outlets.

5. A shower head as defined in claim 2, wherein:

said first plurality of outlets is side-by-side said second plurality of outlets.

6. A shower head as defined in claim 3, wherein:
said first turbine comprises a circular, rotating turbine driven by water pressure;
said second turbine comprises a circular, rotating turbine driven by water pressure; and
said water pressure acts on said first and second turbines to create said first and second pulsating modes, respectively.

7. A shower head as defined in claim 6, wherein:
said first turbine is larger than said second turbine; and
said first turbine is positioned concentrically around said second turbine.

8. A shower head as defined in claim 6, wherein:
said first turbine and said second turbine are substantially similar in size; and
said first turbine and said second turbine are positioned side-by-side in the shower head.

9. A shower head as defined in claim 1, further comprising a face valve driven by a rack and pinion system.

10. A flow actuation system, comprising:
an actuator ring;
a valve operably connected to the actuator ring, the valve comprising a flow channel;
a first actuation paint defined on the actuator ring;
a second actuation point defined on the actuator ring; and
at least one plunger situated within the flow channel; wherein
the at least one plunger extends radially outwardly from a center of the valve when aligned with one of the first and second actuation points; and liquid pressure acts to radially outwardly extend the at least one plunger when the at least one plunger is aligned with one of the first and second actuation points.

11. The flow actuation assembly of claim 10, further comprising:
a second plunger; and wherein
the valve further comprises a second flow channel housing the second plunger in an inner position;
the actuator ring further comprises an inner wall;
the second plunger extends radially outwardly from the center of the valve when aligned with first actuation point; and
the inner wail maintains the second plunger in the inner position when the second plunger is aligned with the second actuation point.

12. The flow actuation assembly of claim 11, wherein:
the at least one plunger seals the first flow channel against the flow of liquid when the at least one plunger is in the inner position; and
the flow channel permits the flow of liquid when the at least one plunger is in the radially outwardly extending position.

13. The flow actuation assembly of claim 11, further comprising:
a backplate comprising a rear backplate sidewall extending from a rear of the backplate; and wherein
the valve further comprises a valve sidewall extending from a front of the valve;
the valve sidewall abuts the rear backplate sidewall;
the valve sidewall and rear backplate sidewall at least partially define a flow passage; and
the valve further comprises a flow outlet communicating between the first flow channel and the flow passage.

14. The flow actuation assembly of claim 13, wherein the flow outlet permits liquid flow between the first flow channel and the flow passage when the at least one plunger is in the radially outwardly extending position.

15. The flow actuation assembly of claim 12, wherein:
the plunger comprises an o-ring; and
the o-ring abuts a sidewall of the first flow channel when the at least one plunger is in the inner position.

16. The flow actuation assembly of claim 15, wherein:
the first flow channel comprises a D-shaped first channel cross-section; and
the at least one plunger comprises a D-shaped first plunger cross-section substantially matching the D-shaped first channel cross-section.

17. The flow actuation assembly of claim 16, wherein:
the second flow channel comprises a D-shaped second channel cross-section;
the second plunger comprises a D-shaped second plunger cross-section substantially matching the D-shaped second channel cross-section; and
the D-shaped first plunger cross-section is rotated one hundred eighty degrees from the D-shaped second plunger cross-section.

18. The flow actuator assembly of claim 17, further comprising:
a mode ring; and
at least one pin affixing the mode ring to the actuator ring; wherein
the actuator ring rotates with the mode ring.

19. A shower head, comprising:
an inlet orifice;
a valve in fluid communication with the inlet orifice;
a backplate in fluid communication with the valve;
a first turbine in fluid communication with the backplate;
a second turbine in fluid communication with the backplate;
a faceplate comprising first and second nozzle groups, the first nozzle group in fluid communication with the first turbine, the second nozzle group in fluid communication with the second turbine; wherein
the backplate and faceplate jointly define a first backplate channel and a second backplate channel.

20. The shower head of claim 19, wherein:
the valve comprises a flow channel; and
the shower head further comprises a plunger situated within the flow channel.

21. The shower head of claim 20, wherein the valve and backplate jointly define a flow passage.

22. The shower head of claim 21, wherein the valve further comprises a flow outlet facilitating fluid communication between the flow channel and flow passage.

23. The shower head of claim 19, wherein the backplate further comprises:
a first inlet nozzle facilitating fluid communication between the flow passage and the first backplate channel; and
a second inlet nozzle facilitating fluid communication between the flow passage and the second backplate channel.

24. The shower head of claim 23, wherein:
the first turbine is located within the first backplate channel; and
the second turbine is located within the second backplate channel.

25. The shower head of claim 24, wherein:
the first nozzle group is in fluid communication with the first backplate channel; and
the second nozzle group is in fluid communication with the second backplate channel.

26. The shower head of claim 25, wherein the wherein the backplate and faceplate further jointly define a third backplate channel.

27. The shower head of claim 26, wherein:

the faceplate further comprises a third nozzle group; and the third nozzle group is in fluid communication with the third backplate channel.

28. The shower head of claim 27, wherein fluid communication between the third backplate channel and third nozzle group is unobstructed by a turbine.

29. A flow actuation system, comprising:

an actuator ring;

a valve operably connected to the actuator ring, the valve comprising a flow channel;

a first actuation surface defined on the actuator ring;

a second actuation surface defined on the actuator ring; and at least one plunger situated within the flow channel and extending in a single direction from a center of the valve; wherein the at least one plunger extends outwardly from the center of the valve when aligned with one of the first and second actuation surfaces.

30. A shower head, comprising:

an inlet orifice;

a valve in fluid communication with the inlet orifice;

a first turbine in fluid communication with the valve;

a second turbine in fluid communication with the valve;

a faceplate comprising first and second nozzle groups, the first nozzle group in fluid communication with the first turbine, the second nozzle group in fluid communication with the second turbine; and a valve in fluid communication with said first and second turbines and operative to at least partially radially channel a fluid to only the first turbine in a first operating state, only the second turbine in a second operating state, and the first and second turbines simultaneously in a third operating state.

* * * * *

UNITED STATES PATENT AND TRADEMARK OFFICE

CERTIFICATE OF CORRECTION

PATENT NO. : 7,114,666 B2
APPLICATION NO. : 10/732285
DATED : October 3, 2006
INVENTOR(S) : Harold A. Luettgen, Gary D. Golichowski and Gary L. Sokol It is certified that error appears in the above-identified patent and that said Letters Patent is hereby corrected as shown below:

In column 22, at line 50, delete “oneratino” and insert --operating--.

In column 23, at line 24, delete “paint” and insert --point--.

In column 23, at line 43, delete “wail” and insert --wall--.

In column 25, at line 1, delete “wherein the”.

Signed and Sealed this

Twenty-sixth Day of December, 2006

JON W. DUDAS
*Director of the United States Patent and Trademark Office*

UNITED STATES PATENT AND TRADEMARK OFFICE

CERTIFICATE OF CORRECTION

PATENT NO. : 7,114,666 B2
APPLICATION NO. : 10/732385
DATED : October 3, 2006
INVENTOR(S) : Harold A. Luettgen, Gary D. Golichowski and Gary L. Sokol It is certified that error appears in the above-identified patent and that said Letters Patent is hereby corrected as shown below:

In column 22, at line 50, delete “oneratino” and insert --operating--.

In column 23, at line 24, delete “paint” and insert --point--.

In column 23, at line 43, delete “wail” and insert --wall--.

In column 25, at line 1, delete “wherein the”.

This certificate supersedes Certificate of Correction issued December 26, 2006.

Signed and Sealed this

Thirtieth Day of January, 2007

JON W. DUDAS
*Director of the United States Patent and Trademark Office*